US012722842B2

(12) United States Patent
Bühlmann et al.

(10) Patent No.: US 12,722,842 B2
(45) Date of Patent: Sep. 1, 2026

(54) BRUSH PRODUCT PACKAGING DEVICE

(71) Applicant: TRISA HOLDING AG, Triengen (CH)

(72) Inventors: Benno Bühlmann, Triengen (CH); Andreas Häfliger, Triengen (CH); Silvan Hug, Triengen (CH); Thomas Röthliberger-Büchli, Willisau (CH)

(73) Assignee: TRISA HOLDING AG, Triengen (CH)

( * ) Notice: Subject to any disclaimer, the term of this patent is extended or adjusted under 35 U.S.C. 154(b) by 0 days.

(21) Appl. No.: 18/728,786

(22) PCT Filed: Jan. 12, 2023

(86) PCT No.: PCT/EP2023/050633
§ 371 (c)(1),
(2) Date: Jul. 12, 2024

(87) PCT Pub. No.: WO2023/135203
PCT Pub. Date: Jul. 20, 2023

(65) Prior Publication Data

US 2025/0121979 A1 Apr. 17, 2025

(30) Foreign Application Priority Data

Jan. 12, 2022 (EP) ..... 22151119

(51) Int. Cl.
*B65D 5/50* (2006.01)
*B65D 5/20* (2006.01)
*B65D 5/42* (2006.01)

(52) U.S. Cl.
CPC ..... *B65D 5/504* (2013.01); *B65D 5/2057* (2013.01); *B65D 5/4204* (2013.01)

(58) Field of Classification Search
CPC .. A46B 2200/1066; A46B 9/04; B65D 35/28; B65D 75/008; B65D 5/504;
(Continued)

(56) References Cited

U.S. PATENT DOCUMENTS 1,897,672 A * 2/1933 Neumann ..... B65D 5/504 211/70.1
1,974,674 A * 9/1934 Halladay ..... B65D 5/504 47/41.01

(Continued)

FOREIGN PATENT DOCUMENTS

CH 698997 B1 12/2009
CH 713215 A2 6/2018
EP 3736221 A1 11/2020

OTHER PUBLICATIONS

May 8, 2023 International Search Report issued in International Patent Application No. PCT/EP2023/050633.

(Continued)

*Primary Examiner* — King M Chu
(74) *Attorney, Agent, or Firm* — Oliff PLC

(57) ABSTRACT

A brush product packaging device for receiving a brush product includes an application head and handle, further includes at least one packaging base body to form an at least substantially closed receiving region for the brush product and includes folded hood and card elements applied onto the hood element, the hood and card elements being at least largely made of a paper material, wherein the brush product packaging device further includes at least one holding unit, which projects at least partially into the receiving region and is configured for holding the brush product at least partially in position relative to the receiving region, and is at least largely made of a paper material, wherein the holding unit is realized separately from the packaging base body, wherein the at least one holding unit includes at least two folding elements which project at least partially into the receiving region in different regions.

9 Claims, 43 Drawing Sheets

Figure 1A:
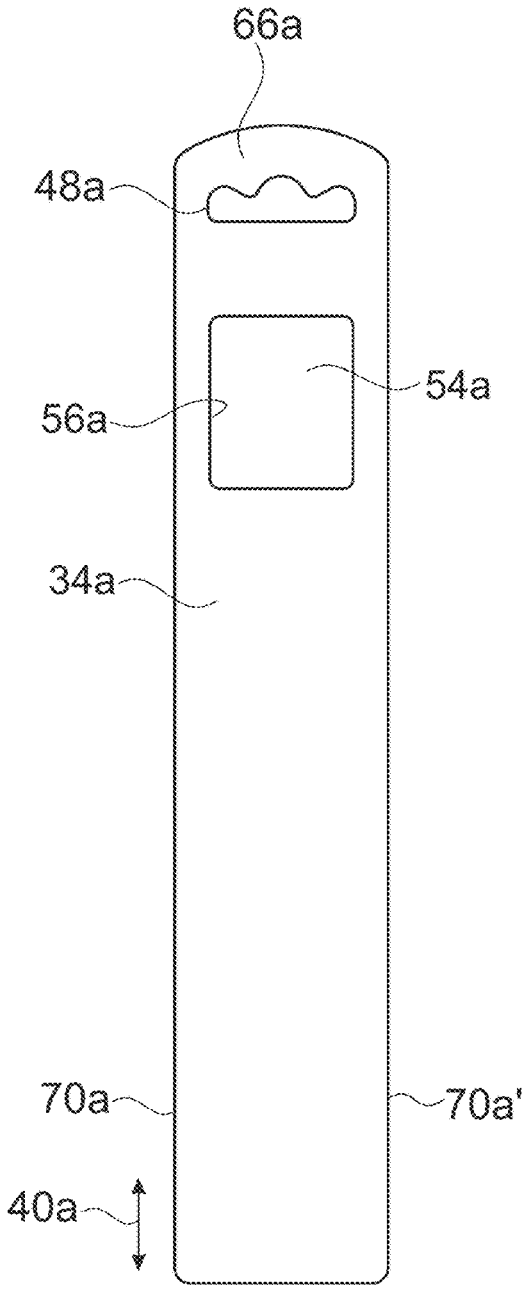

(58) Field of Classification Search
CPC .. B65D 5/2057; B65D 5/4204; B65D 5/0254; B65D 5/4208; B65D 73/0078; B65D 5/5035
USPC ..... 206/362.1, 362.4, 362, 362.3, 362.2, 206/209.1; 15/167.1; 222/93; 211/65
See application file for complete search history.

(56) References Cited

U.S. PATENT DOCUMENTS

| | | | | |
|---|---|---|---|---|
| 4,331,287 | A * | 5/1982 | Wharton, Jr. ..... | B65D 5/504 206/443 |
| 5,713,462 | A * | 2/1998 | Hansen ..... | G11B 33/0444 |
| 2022/0219860 | A1 | 7/2022 | Häfliger et al. | |

OTHER PUBLICATIONS

Jun. 20, 2024 International Preliminary Report on Patentability issued in International Patent Application No. PCT/ EP2023/ 050633.
May 25, 2022 Extended Search Report issued in European Patent Application No. 22151119.9.

* cited by examiner

BRUSH PRODUCT PACKAGING DEVICE

CROSS-REFERENCE TO RELATED APPLICATIONS

This patent application is a U.S. national stage application of international patent application PCT/EP2023/050633, filed on Jan. 12, 2023, which is based on and claims priority of European patent application EP 22151119.9, filed on Jan. 12, 2022, the contents of which are incorporated herein by reference.

PRIOR ART

The invention concerns a brush product packaging device.

A brush product packaging device for receiving a brush product, in particular a toothbrush, with an application head and with a handle, has already been proposed, with at least one packaging base body which is configured to form an at least substantially closed receiving region for the brush product and which comprises a folded hood element and an, in particular planar, card element that is applied onto the hood element, the hood element and the card element being in each case at least largely made of a paper material.

The objective of the invention is in particular to provide a generic device with improved properties regarding manufacturability, protection of the brush product and regarding ecology. The objective is achieved according to the invention by the features of patent claims 1, 12, 14 and 18, while advantageous implementations and further developments of the invention may be gathered from the dependent claims.

Advantages of the Invention

The invention is based on a brush product packaging device for receiving a brush product, in particular a toothbrush, with an application head and with a handle, with at least one packaging base body which is configured to form an at least substantially closed receiving region for the brush product and which comprises a folded hood element and an, in particular planar, card element that is applied onto the hood element, the hood element and the card element being in each case at least largely made of a paper material.

It is proposed that the brush product packaging device comprises at least one holding unit, which projects at least partially into the receiving region and is configured to hold the brush product at least partially in position relative to the receiving region, and which is at least largely made of a paper material, wherein the holding unit is realized separately from the packaging base body, wherein the at least one holding unit comprises at least two folding elements which project at least partially into the receiving region in different regions.

In this context, a "brush product packaging device" is in particular to mean an at least substantially closed device which is configured to accommodate a brush product for sales purposes. In particular, the device serves as a sales packaging for a brush product. Preferably the brush product packaging device is in particular configured for lying and/or standing and/or hanging sales purposes. In particular, the brush product packaging device preferably also comprises a suspension recess, e. g. a euroslot recess, for a suspending of the brush product packaging device. The brush product packaging device is in particular formed by a primary packaging as an actual product packaging. Different from this are in particular secondary packagings which form an outer box in which a plurality of primary packagings are collected. The secondary packagings protect the primary packagings and form a transport unit. The brush product packaging device is in particular configured to receive and/or hold the brush products, in particular toothbrushes, transversely, i.e. with a bristle field oriented orthogonally to a viewing direction. This in particular allows achieving close packing in a secondary packaging. In the brush product packaging device a head of the brush product is in particular at the top. However, it would also be conceivable to accommodate the brush product in a different manner deemed expedient by a person skilled in the art. Preferably a main extension direction of the brush product in an accommodated state extends parallel to a main extension direction of the brush product packaging device.

The brush product packaging device in particular serves for accommodation and protection of a brush product. Moreover, the brush product packaging device in particular serves for product presentation. Product presentation may be carried out in various ways which are deemed expedient by a person skilled in the art. The brush product may, for example, be presented in the brush product packaging device sideways. In this case, the brush product would be visible from the side when the brush product packaging device is opened from the front or through a viewing window in the hood element. In a corresponding presentation, a packing depth may be kept advantageously low. The packing width is in particular subject to certain standards and/or specifications, such that in particular no space can be saved here and a variation must be done with regard to depth. Volume optimization in the brush product packaging device in particular brings about a more compact volume of the outer packaging and thus less transport volume. Alternatively, the brush product may be presented towards the front, such that when the packaging is opened from the front or through the viewing window, the product is visible from the front. Alternatively, the brush product may be presented towards the rear, such that, the product is visible from the rear when the packaging is opened from the front or through the viewing window. Alternatively, the brush product may be presented at an angle which is different from 0°, 90°, 180°, 270° and 360°, such that a viewing is not done perpendicularly onto a side of the product, but rather an edge of the product is presented. Therefore, several sides of the brush product are partially visible when the packaging is opened from the front or through the viewing window. An oblique positioning of the brush product with the brush head against the hood element at an angle of 15° to 75° or 105° to 165°, particularly preferably 25° to 65° or 115° to 155°, is especially interesting. In multiple packagings, the brush products may also be arranged in a combination of the above orientations. Thus it is conceivable, for example, that one brush product is presented sideways while the other brush products are presented towards the front. Alternatively, it would be conceivable that two brush products are arranged at an angle to one another, i.e. in particular with their front sides towards the center.

Packing sizes of the brush product packaging device are conceivable. Individual packagings, i. e. in particular one brush product in one brush product packaging device, are conceivable. Furthermore, multiple packagings are also conceivable in which several brushes are arranged in one brush product packaging device.

A "brush product" is in particular to mean an oral hygiene brush and/or a cosmetic brush and/or a hair brush and/or a household brush. For example, manual toothbrushes, such as multi-use toothbrushes, exchangeable-head toothbrushes, disposable toothbrushes or single-tuft brushes, electric toothbrushes as well as hybrid toothbrushes, interdental cleaners, in particular with screwed-in bristles, in injection-molded form or as flossers (dental floss spanned onto an arc), tongue cleaners and/or dental floss are conceivable as oral hygiene brushes. For example, mascara brushes, nail polish brushes, facial brushes, applicators, in particular also hair-dyeing applicators, massaging devices, makeup brushes, makeup sponges, shaving brushes and/or wet shavers or other body care products are conceivable as cosmetic brushes. For example, dishwashing brushes, floor wipers and/or brooms are conceivable as household brushes. Advantageously, the brush product is designed as a toothbrush, in particular a manual toothbrush, preferably a children's toothbrush, advantageously a purely manual or a partially electric or hybrid toothbrush, for example with a vibration function or the like. However, the brush product may also be an electric toothbrush (chargeable with battery operation or with exchangeable disposable batteries). The brush product may herein be a disposable toothbrush, a multi-use toothbrush or an exchangeable-head toothbrush. The brush product may be a plug-on brush or an exchangeable head for a manual, electric or hybrid toothbrush. Combinations of identical and/or different brush products may also be inserted in a multiple packaging.

The brush product in particular has a longitudinal axis, which is advantageously arranged at least substantially parallel to a main extension direction of the brush product. The longitudinal axis preferably runs at least section-wise within the brush product and in particular through its center of gravity. In particular, the longitudinal axis of the brush product is a central axis of the brush product and/or a central axis of the handle unit. A toothbrush preferably consists of a head portion with bristles, a neck portion and a handle portion. All sub-elements may consist of at least one hard component and/or of one or more soft components. A "central axis" of an object is here in particular to mean an imaginary axis which runs within the object parallel to a main extension direction of the object and intersects with the object in at most two points. "At least substantially parallel" is here in particular to mean an orientation of a direction relative to a reference direction, in particular in a plane, wherein the direction has a deviation from the reference direction that is in particular less than 8°, advantageously less than 5° and particularly advantageously less than 2°. By a "main extension direction" of an object is here in particular a direction to be understood which runs parallel to a longest edge of a smallest imaginary cuboid which just still completely encloses the object.

In particular, the brush product has a length, in particular parallel to the longitudinal axis of the brush product, of at least 110 mm, advantageously of at least 130 mm and particularly advantageously of at least 150 mm; and/or of at most 250 mm, advantageously of at most 240 mm and particularly advantageously of at most 230 mm, wherein of course other lengths, in particular smaller or greater lengths, are also conceivable. In particular, the brush product has a width, in particular parallel to a width axis of the brush product, that is advantageously perpendicular to the longitudinal axis and/or parallel to a main extension plane of the brush product and/or to the handle unit and to the bristle longitudinal axis, of at least 10 mm, advantageously of at least 12 mm and particularly advantageously of at least 15 mm; and/or of at most 30 mm, advantageously of at most 26 mm and particularly advantageously of at most 23 mm. In particular, the brush product has a height, in particular measured parallel to a height axis and/or to the bristle longitudinal axis of the brush product, advantageously measured perpendicular to the longitudinal axis of the brush product and/or perpendicular to the main extension plane of the brush product, of at least 15 mm, advantageously of at least 20 mm and particularly advantageously of at least 23 mm; and/or of at most 40 mm, advantageously of at most 35 mm and particularly advantageously of at most 31 mm.

The term "height" herein in particular refers to a state of the brush product in which it is deposited, for example, on a surface such as a tabletop, a washbasin, an upper side of a piece of furniture, or the like, in particular in such a way that the longitudinal axis is arranged parallel to the surface. By a "main extension plane" of an object is in particular a plane to be understood which is parallel to a largest side surface of a smallest imaginary cuboid that just still completely encloses the object, and in particular runs through the center of the cuboid.

Advantageously, the application head has at least one cleaning region configured for a tooth cleaning application, in particular in an oral cavity of the user. Preferably, the cleaning region comprises at least one cleaning element, in particular at least a brush head, advantageously a toothbrush head, preferably with several bristles and/or bristle bundles. However, the cleaning element may for example also be designed as an interdental brush and/or as a single tuft (e. g. a single large bristle bundle) and/or as an arc spanned with dental floss, in particular as a flosser and/or as a dental floss roll or the like, or as a tongue cleaner. Furthermore, the application head advantageously comprises at least one neck element, which is preferably connected to the cleaning element, in particular directly and/or integrally. "Integrally" is in particular to mean connected at least by substance-to-substance bond, for example by a welding process, a gluing process, an injection-molding process and/or another process deemed expedient by a person skilled in the art, and/or advantageously formed in one piece, such as for example by production from a cast and/or by production in a single-component or multi-component injection-molding process and advantageously from a single blank. "Configured" is in particular to mean specially designed and/or equipped. By an object being configured for a specific function is in particular to be understood that the object fulfils and/or carries out this specific function in at least one application state and/or operation state.

The brush product in particular has a front side and a rear side, which are in particular arranged facing away from one another. Preferably the cleaning region is arranged on the front side of the brush product. The front side is in particular a side of the brush product that is visible in a viewing direction perpendicular to the longitudinal axis of the brush product and perpendicular to the width axis of the brush product. The rear side is advantageously equivalent to a side of the brush product that is visible in a viewing direction opposed thereto. Furthermore, the brush product in particular has an underside on which, for example, the suction cup may advantageously be arranged. In addition, the brush product in particular has an upper side, which is advantageously arranged opposite the underside and in the region of which, for example, an application head, in particular a bristle field, is attached.

Preferably the handle unit comprises at least one handle element, which is advantageously configured to be held with a hand. The handle element is preferably realized so as to be, in particular once or multiple times, waisted. This advantageously allows a secure hold during use and optimizes ergonomics. Particularly preferably the handle element is realized in elongate fashion, wherein a longitudinal axis of the handle element advantageously corresponds to the longitudinal axis of the brush product. The handle element is advantageously realized partially from a soft component and partially from a hard component. In particular, the handle element advantageously comprises at least one thumb grip region and/or at least one handhold region. The thumb grip region is advantageously arranged on the front side of the brush product and in particular on a front side of the handle element. It is conceivable that the thumb grip region and/or the handhold region comprise at least one element and/or a surface structuring made from a soft component.

In this context, a "packaging base body" is in particular to mean a base body of the brush product packaging device, which in particular forms at least a large portion of a material volume of the brush product packaging device. In particular, the packaging base body forms at least 50%, preferably at least 70% and particularly preferably at least 90% of a material volume of the brush product packaging device. The packaging base body preferably delimits the receiving region for the brush product. In particular, the packaging base body completely forms a material delimitation of the receiving region. Furthermore, in this context, an "at least substantially closed receiving region" is in particular to mean a packaging volume of the brush product packaging device which is materially delimited by the packaging base body by at least 80%, preferably by at least 90%, preferentially by at least 95% and especially preferentially by at least 99%. The packaging base body preferably serves to avoid a direct contacting and/or contamination of a brush product accommodated in the receiving region from outside the packaging, wherein production-related folding gaps and/or perforations may be provided which make a complete tightness of the packaging base body difficult.

The packaging base body preferably comprises the card element and the hood element. Normally, the card element is arranged in particular at the front for product presentation, such that the card element is looked at. It is herein conceivable that the card element is provided with a viewing window. Alternatively, however, it would also be conceivable that the card element is arranged at the rear and the hood element is looked at for presentation. It would herein in particular be conceivable that a viewing window is arranged in the hood element. Here it is in particular conceivable that the viewing window entails a recess in the holding unit, such that the brush product can be viewed through the hood element and through the holding unit. For this purpose, a recess in the holding unit would in particular be larger than the viewing window in the hood element, such that tolerances can be absorbed and a visibility of the holding unit through the viewing window can be avoided.

The brush product is in particular held in the packaging base body. The brush product is in particular held only at support points in recesses of the folding elements. Optionally the brush product in particular is moreover adjacent to the hood element at the top and/or at the bottom. Furthermore, the brush product optionally is also adjacent to the card element. However, a variant would also be conceivable in which the brush product does not contact the packaging base body at the top and bottom, but is held in the holding unit and/or at the folding elements by an adapted geometry and does not slip. Herein the brush product does not have to extend over the entire packaging length.

The packaging base body may have a double-layer implementation in order to give the packaging more stability. For example, a double-layer implementation may be provided at the back or at the bottom, i. e. in the falling direction.

The packaging base body preferably comprises an opening mechanism. The opening mechanism is preferably attached to the card element. Preferably means are provided, such as for example perforations for separating and for opening, or punchings where the packaging base body can be opened. The punchings may in particular ensure certain geometries which prevent uncontrolled tear-out. The opening mechanism may also be in combination with a reclosing mechanism. For example, tabs are possible which for the purpose of re-closing may, for example, be bent and inserted into predefined slots. Furthermore, an opening mechanism detached from the card element would also be conceivable. Thus, for example, a tab at a sealing edge would be conceivable, which serves for tearing the packaging base body open.

Preferably the perforations provided for opening are attached outside the sealing edge. It can thus be achieved that when the perforation is torn, the packaging is effectively open. A disadvantage in this case is the space requirement necessary, for example, for a favorable arrangement of perforation and viewing window.

Alternatively or additionally, a counter-scoring perforation would be conceivable, wherein scorings are arranged on the card element both on the front side and on the rear side. Preferably the scorings are arranged in an offset and/or spaced-apart manner, in particular the scorings are arranged in a non-congruent manner. In an implementation it would be conceivable that the card is scored with a two-side offset. Preferably there will be no breakthroughs at the counter-scoring perforation on the card element. This in particular advantageously allows one scoring to be realized in the sealing region and the second scoring to be realized directly next to the sealing region. Preferably the connection breaks between the scorings when opening. This in particular allows realizing an advantageously larger viewing window. In particular, an advantageously larger opening for the removal of the products from the receiving region can be formed.

"At least largely" is in particular to mean that at least a main constituent of a material of the packaging base body is a fiber and/or paper material. Preferably at least 50 wt. % (weight percent), preferably at least 70 wt. % and particularly preferably at least 90 wt. % of the packaging base body are made of a paper material. Particularly preferably the packaging base body is completely made of a paper material. Furthermore, in this context, a "paper material" is in particular to mean a planar material which substantially consists of fibers of organic and/or plant origin. Preferably the material is produced from pulp, ground wood and/or waste paper. The material may herein be realized in one layer or in multiple layers. Multi-layer paper material consists of several layers of paper of different thicknesses and/or of at least partially of different materials. The layers may herein be produced by gluing together or pressing together, in particular without the use of adhesive. The grammage of the paper material is in particular between 50 $g/m^2$ and 1,000 $g/m^2$, preferably between 150 $g/m^2$ and 600 $g/m^2$. Preferably the paper material consists of virgin fiber and/or secondary fiber. The virgin fiber or primary fiber is herein made from new material, like for example FSC wood. The secondary fiber is in particular made from a recycled paper or recycled paperboard. Alternatively or additionally, further filler materials such as other organic fibers, like for example grass for grass paper, are also conceivable. Preferably the paper material includes a recycling fraction of at least 80%, wherein the paper material may contain a fraction of primary fibers. Using new material allows keeping the properties of the paper material in a narrower range. Different paper materials, deemed expedient by a person skilled in the art, are conceivable for the packaging base body. In particular, the packaging base body consists of solid paperboard, in particular of a packaging paperboard. Furthermore, an implementation in corrugated cardboard is also conceivable, in particular in corrugated cardboard with a low height. Furthermore, different surfaces are conceivable for the paper material. The paper material may in particular be painted, i.e. coated, as well as unpainted, i.e. uncoated. Moreover it is conceivable that the paper material is structured or has a structured surface, for example due to a 3D contour. By structuring, in particular a grip and/or the handling of the brush product packaging device can be improved. In particular, the structuring can be realized in the paper material itself, like for example by surface treatment and/or by embossing, but can also be realized in a printing.

The paper material may for example have a printing on water-based varnishes, which are ecological compared to conventional varnishes.

The paper material may be refined. A "refining" is here to mean a surface treatment of the paper material which, for example, results in the paper material obtaining a higher-quality appearance. The refining may in each case be applied/realized partially in one or several places or also over the entire surface. For example, metallic effects, optical distinctions or also product inscriptions can be realized by refining. A suitable coating may also enable a reduction or avoidance of the water absorption of the paper material. Thus the paper material may also be appropriate for multiple use. Refining may, for example, be a varnishing; in such a case, for example, UV high-gloss varnish, structured varnish, soft-touch varnish or glitter varnish can be used. A film lamination and/or hot-film embossing may be used for connecting several layers, for example connecting paperboard with a film. Herein matte films, gloss films or also structured films can be used. As a result, the surfaces will in particular have a longer lifespan. Embossing/embossing film printing may be used; herein in particular a planar or structured embossing is possible. Lamination or sealing-in may also be used for the refining.

The paper material as well as further parts of the packaging may also be fragranced, such that the packaging is provided with a fragrance which is then released, in particular during opening. It therefore makes sense to primarily fragrance interior regions. Furthermore, respective parts may also be provided with an antibacterial agent which allows the packaging to become more hygienic as a whole, wherein in particular certain product-contacting packaging elements, for example in the region of the application head, are provided therewith.

Alternatively, the paper material may also be substituted by a plastic of sustainable material. In this case, the brush product packaging device, i. e. the hood element, the card element and the holding unit, would in each case be completely or partially made of a plastic of sustainable material.

The holding unit is realized as a separate unit, for example as at least one inlay. Furthermore, the holding unit may preferably have a universal shape, thus being usable for different brush products, or may alternatively have an individual shape, thus being adapted to a specific brush product and a specific packaging base body for a specified orientation. In this context, a "holding unit" is in particular to mean a unit which is configured for an at least partial fixing of the brush product in the receiving region of the brush product packaging device. The holding unit may have a certain prestress on the brush product. As a result, the brush product is held in position even in the event of vibrations or movement of the brush product packaging device, and "clanking or rattling" of the brush product is thereby prevented. This prestress is preferably exerted on the handle and/or the neck, wherein the brush head, respectively the bristles, preferably remain free of prestress. The applied prestress is sufficient for holding the brush product in position during transport. Prestressing forces of less than 100 g, preferably less than 50 g, particularly preferably less than 20 g, are usually sufficient for this purpose. Brush products are usually made of hard plastics, soft plastics and bristles. In order to provide maximum protection, any prestress is preferably exerted substantially on the hard plastic of the handle and less preferably also on the soft plastic of the handle, but neither on the bristles nor on the bristle field. Herein a fixing may be achieved in particular by accommodating a portion of the brush product in a recess of the holding unit and/or by clamping and/or abutting the brush product in the receiving region, for example opposite the inner face of the packaging base body. Preferably, the holding unit is configured to reduce a movement play of the brush product in the receiving region as compared to an absence of the holding unit. In particular, the holding unit is configured to reduce damage and/or deformation of the bristles of an application head of the brush product caused by a movement of the brush product within the receiving region. By means of the holding element, it is in particular possible to avoid a clanking or rattling noise caused by a movement of the brush product in the brush product packaging device, in particular in the event of shaking or during transport of the brush product packaging device. Furthermore, a protective function is achievable. In particular, product parts such as the brush head or the bristle field can be protected by the brush being supported/held in such a way that the bristles are not subjected to a load. Furthermore, deformable product parts made of soft plastic material, such as suction cups, tongue cleaners, handle elements, may also be protected from deformation. This in particular allows achieving a reliable securing of the brush product in the brush product packaging device. In particular, damage to the brush product during transport can be avoided.

In particular, different holding units, deemed expedient by a person skilled in the art, are conceivable. It is conceivable, for example, that the holding unit comprises at least one element which is formed in the receiving region of the brush product packaging device when the packaging base body is uprighted. Such an element may, for example, be glued in and may project into the receiving region as a projection. Such an element may in particular be fastened via an edge, wherein the element is fastened on two sides respectively and there are creasings and/or perforations provided in between. When the sides are uprighted relative to each other, the element is erected and a folding element is formed. Alternatively or additionally, it would be conceivable that the holding unit comprises an additional part, which is adapted to the product shape, as a holding means, said additional part being inserted in advance into the packaging base body and/or being produced with the packaging base body and/or being introduced together with the brush product. When filling from an underside or an upper side, it would in particular be conceivable that the additional part is brought together with the brush product before being introduced into the packaging base body and this combined unit is introduced together into the packaging base body and/or into the receiving region. The additional part in particular has a precisely fitting shape. Furthermore, the additional part may be glued and/or sealed into the packaging base body, or may be clamped into the receiving region without fixed fixing or anchoring, or may also not be fixed at all. In particular, the additional part may also be designed as a formed blister and/or as a formed deep-drawn part, wherein the latter is preferably produced from plastic film and this is preferably produced from a sustainable plastic, i.e. in particular recycling material or a renewable raw material as a base.

Furthermore, an implementation of a holding unit is possible which is introduced into the correspondingly designed brush product packaging device along the main extension direction of the brush product packaging device and/or of the packaging base body. This may for example be used in the implementation of the brush product packaging device as a rectangular-cuboid-shaped casing. The holding unit is here preferably designed so as to include one, two or even more designed fixing regions which fix the brush products or other co-packaged parts. The fixing regions may in this case have different shapes, in each case adapted to the brush product that is to be fixed. Herein, for example, different brush products may be packaged in a brush product packaging device, for example an exchangeable-head toothbrush with a plugged-on exchangeable head and one or several further exchangeable heads in parallel thereto. The holding unit is herein designed in such a way that it fits precisely into the casing when it is equipped. For this purpose, the outer contour is in the prepared state designed to fit with the inner volume of the casing, such that there will be no displacement of the holding unit in this X-Y plane. For the positioning in the Z-plane of the height, side tabs may be formed on the holding unit which fix the unit of brush product and holding unit together with the possibly protruding brush product in the respective direction.

The side tabs are herein formed at least on two opposite-situated sides. Preferably the tabs are herein formed on the sides with the longest extents, i. e. on the sides realized parallel to the main extension direction. The tabs on the other sides may also be formed, such that a total of preferably 2 to 4 tabs are formed which are realized over the entire length of the holding unit. For the optimal fixing of the holding unit, it is further possible to orient two tabs to the front side and two tabs to the rear side of the brush product packaging device, such that the holding unit is optimally fixed in all directions.

Furthermore, it is possible to design the tabs at least partially over the creasing of the fold, such that on both sides of the creasing a partial tab is realized. This allows achieving a fixing of the holding unit in the height direction.

The tabs may of course also be subdivided, such that quasi several tabs are realized per side. This may, for example, serve for exposing respective countergeometries. For example, the tab may be divided in two perpendicularly to the main extension direction if, for example, a re-entrant element, which is in the way of the tab, is formed in the casing. Or a tab may be excluded, such that the respective brush product can be fixed well in the holding unit. Furthermore, fixing regions for brush products may, for example, also extend as far as the edge of the holding unit, thus entailing interrupted tabs.

The casing may, for example, also be equipped with one or several viewing windows, wherein the holding unit with the fixing region(s) is preferably designed in such a way that at least a portion of a brush product can be seen through a viewing window.

The larger-dimensioned implementation of the holding unit in connection with the use of a casing may provide further advantages. The casing may, for example, be provided with an opening aid designed so as to enable, for example, reclosing. Thus, for example, in the case of a brush product packaging device with several brush products inserted therein, it is achievable that the holding unit can be pulled out, the required products can be removed and the remaining products can be stored in a neatly packaged manner. Furthermore, this product structure may also be used as a travel case if, for example, only one product is packaged.

Furthermore, a holding unit designed as described above may also be used for a brush packaging device which is filled from the front side and/or from the rear side. The aforementioned design inter alia of the tabs may also be realized as described.

In particular, rather complex holding units can be designed capable of having larger dimensions and in particular also of holding/accommodating several different products. A more complex holding unit is designed so as to create an inner geometry which is later slid or laid into a rectangular-cuboid-shaped, casing-like packaging base body. The packaging base body is herein designed in rectangular-cuboid fashion and provided with respective openings and tabs such that the holding unit can be slid into the casing-like packaging base body along the main extension direction. The holding unit is therefore designed as a precut that is separate from the packaging base body. The holding unit may comprise elements for holding a brush product-which is presented, for example, in a viewing window of the packaging base body. Furthermore, the holding unit may comprise elements for holding accessories or replacement parts such as plug-on brushes. The holding unit is already equipped with the products before it is slid into the packaging base body.

The slid-in holding units may comprise elements/geometries on the precut that enable their being pulled out of the casing. For example, punchings may have been introduced which can be pressed in, such that the holding unit can be grasped (e. g. with a finger).

It would also be conceivable that the holding unit and the brush product interact directly. Thus it would be conceivable, for example, that the brush product bears against the holding unit and stabilizes the folding elements of the holding unit. For example, it would be conceivable in the case of plug-on brushes that a portion of the holding unit is fixed with the brush products.

Furthermore, it would also be conceivable that several holding units are provided. Preferably, however, only a one-piece holding unit is provided. A one-piece holding unit provides advantages with processing, since only one element must be moved, folded and sealed. The holding unit is preferably connected to the hood element. The connection may be realized, for example, by adhesive bonding, sealing or welding. In the case of sealing, in particular the underside of the holding unit is provided with sealing wax such that it can be sealed against the hood element. Alternatively, there is also the possibility that there is no connection between the holding unit and the hood element, wherein the holding unit is merely clamped in the hood element and/or is at least partially inserted in the hood element in a form-fitting manner. For this purpose, it would in particular be conceivable that in the final stage the holding unit bears against the side parts and/or the end walls of the hood element and is thus clamped. Clamping may be realized both between the side parts, i. e. left and right, and/or between the end walls, i. e. between bottom and top. Preferably, the holding unit comprises one or more connection points to the hood element. If there are several points, these are preferably spaced apart from each other. Preferably a connection is created on both sides of each folding element. Preferentially therefore at least three connection points are provided. Production of the holding unit may be realized both inline on site of production or prefabricated as flat precuts. If the holding units are produced inline (i.e. on the packaging machine), in particular material supply from a roll or from a sheet would be conceivable, wherein the material is subsequently cut to size on site by punching, creasing, perforating or the like, and is then shaped and is welded into the hood element. In the case of prefabricated holding units, these are in particular supplied in stacks, wherein punchings, creasings and perforations have already been introduced. In production, a machine may then stack the holding units individually, shape them and weld them into the hood element. Furthermore, the holding unit may optionally be printed. It is conceivable that the upper side is printed, such that the color is visible through the viewing window. Production without printing is also possible.

Furthermore, additional functions for the holding unit are conceivable. The holding unit may also be used for fixing additional products or accessories by means of it. For example, recesses may be provided in the holding unit for head receptacles, toothpaste or other brush products. The recesses are, for example, somewhat smaller than the required outline of the product, such that the product quasi rests on the holding unit. In a completely packaged state, the product is then held between the holding unit and the card element. In particular, flush adjoining would be advantageous, such that the product does not clatter when shaken.

The holding unit with the folding elements and with the brush products inserted therein is preferably designed in such a way that further products can be arranged in between. The shape of the holding unit does not have to be formed symmetrically to the longitudinal axis, for example if different products are fixed. For example, two different brush product models may be adopted side by side in a brush product packaging device. Alternatively, for example, a brush product and a head receptacle may be accommodated in a packaging. In this case, the asymmetry may be created, for example, by asymmetrical recesses and/or by an asymmetrical arrangement of the folding elements.

Preferably, the folding element is realized as a separate component that is different from the packaging base body. The holding unit comprises several folding elements. In particular, several folding elements may be expedient if there are several brush products in the same receiving region. However, it is also conceivable that several folding elements are required depending on a brush geometry of the brush product. If there are several folding elements, the brush product may in particular be inserted once and clamped once, or may be inserted several times and clamped several times. In this context, a "folding element" is in particular to mean an element produced by deformation, in particular folding, of a paper material. In particular, the folding element is preferably produced from a flat precut in which the folding options, in particular in the form of creases and/or perforations, are already integrated. Preferably, the folding element is realized as an inlay part for the packaging base body. In particular, the folding element is configured to be arranged in the receiving region of the brush product packaging device. In particular, the folding element is configured for a fixing of the brush product in the receiving region. As already described, a fixing may be achieved in particular by pre-tensioning and/or clamping and holding and/or at least partially form-fitting positioning of the brush product between the folding element and the inner face of the packaging base body, and may also be achieved by a recess in the folding element into which the brush product is inserted directly. In principle, a combined folding element with a recess and with a clamping option would also be conceivable. A "crease" is in particular to mean a deformation in a paperboard produced by means of a forming method. For example, for better folding of paperboard sheets, the paperboard is weakened beforehand at the fold by means of a so-called crease line. Herein in particular linear material displacement of the material takes place in order to create better bending capability. In this context, a "perforation" is in particular to mean a through-holing of hollow bodies or flat objects, also in order to create better bending capability. This in particular allows achieving a reliable securing of the brush product in the brush product packaging device. In particular, damage to the brush product during transport can be avoided. In particular, this allows achieving an optimized fixing of different brush products independently of the packaging base body. In particular, different brush products can be packaged in the same packaging base body.

Furthermore, it is conceivable that, depending on a folding angle of the folding element, different heights of the folding element can be realized, which of course also brings about differences in the length and/or width dimensions, which due to the lower height increase with the same component. As a result, preferably with the same folding element different effective sizes of an accommodation can also be realized and thus also different brush products with different shapes or geometries can be fixed. The folding elements in particular stand or assume their intended shape independently and are not supported by further elements of the packaging. Alternatively or additionally, the folding elements may be fixed or brought into their intended shape by sealings. Alternatively or additionally, the ends of the folding element may be fixed to each other and the fixed place or another place is connected to the packaging. The folding elements can be produced individually, are inherently stable and can be fixed subsequently. Fastening and positioning of the folding element can be carried out in various ways which are deemed expedient by a person skilled in the art. The folding element may be merely laid in, and may be positioned at least partially in a form-fitting manner, for example by clamping between the side surfaces/side parts and/or the end walls. Alternatively, the folding element can be fixed, like for example by adhesive bonding, by hooking in, by clamping in recesses and/or cutouts and/or by sealing.

The position for a fixing of the brush product is in particular variable. In particular, the position depends on a geometry of the receiving region and on a geometry of the brush product. A preferred position for a fixing of the brush product is in particular a neck of the brush product. This in particular allows achieving both a reliable fixing and a reliable protection of the bristle field.

The at least two folding elements, in particular allow the brush product being laid into several places in a respective folding element. In particular, a fixing between the folding elements or outside the folding elements is possible. The folding elements are in particular configured to prevent a displacement of the brush product in a transverse and a longitudinal direction. Preferably, the brush product is configured to interact, with a product contour, with a contour of the folding elements, in particular with a contour of a recess of the folding elements. Following the contour of the brush product, the contour of the brush product in particular bears against a first folding element in one region and bears against the second folding element in a second region. If there are more than two folding elements, the brush product may in particular be inserted in several places in a respective folding element. The provision of more than two folding elements per holding unit results in more difficult production. In addition, the brush product and the folding element must be adapted to one another very precisely. However, by means of more than two folding elements a pre-tensioning of the brush product is achievable. Additionally or alternatively, however, a variant with a large plateau-shaped folding element would also be conceivable.

The folding elements are in particular formed from the holding unit by perforations or creasings in the paperboard for the actual folding edges. For a triangular folding element, in particular three folding edges are required. Herein in particular two folding edges are arranged on a fastening side of the holding unit at the transition into the flat region, while one folding edge is arranged on a free vertex of the folding element. In the case of a plateau-shaped folding element, in particular at least four folding edges are provided, wherein in particular two free-standing upper folding edges are provided. Furthermore, it is also possible to design a folding element with two folding edges: herein instead of a triangular cross-section an arc is formed, i. e. a cross-section shaped like a semicircle or half an oval. Preferably several folding elements are provided per holding unit. In particular, two to four folding elements, preferably precisely two folding elements, are provided per holding unit. Using three folding elements with recesses allows realizing a clamping of the brush product, with the brush product being thus held in an even more favorable manner. Quasi a three-point support is formed and the product is clamped transversely. Different shapes of folding elements may also be combined. For example, in a sequence respectively one folding element with a triangular, a semi-oval and/or a triangular cross-section may be formed. Herein the semi-oval folding element may be designed as a support element which supports the brush products inserted into the triangle-shaped folding elements. The brush products are not passed through the semi-oval folding element but are merely adjacent to the semi-oval folding element. The folding elements in particular in each case have a height of 8 mm to 35 mm, preferably of 10 mm to 25 mm. Usually the folding elements in particular essentially extend from a bottom of the hood element upwards as far as the card element. Preferably the free upper folding edge of the folding element adjoins the card element. This provides the brush product packaging with additional stability. However, it would also be conceivable that the folding element is slightly spaced apart from the card element. It would be conceivable, for example, that another inlay is put onto the folding elements and the folding elements would thus have to be reduced in height. The height of the folding elements, the recess and the receiving region are in particular adapted to one another in such a way that the accommodated brush product is pressed against the card element. In this way it would in particular be possible to avoid clanking when the brush product packaging device is moved and/or shaken. In particular, it can be achieved that the brush product is positioned without play and/or snugly. The folding elements in particular in each case have a width, i.e. a length of the upper folding edge, that corresponds to a width of the receiving region. In particular, a width of the folding elements corresponds to a width of the holding unit.

Alternatively, however, it is also possible that the folding elements are arranged differently than transversely to the longitudinal direction of the packaging base body, wherein the folding elements in such a case in particular have a width, namely in the longitudinal direction of the packaging base body, and/or a length of the upper folding edge of 20 mm to 200 mm, preferably of 30 mm to 70 mm, respectively of 150 mm to 180 mm. Herein the folding element may extend over a portion of the length of the receiving region or over the entire receiving region.

A length of the folding elements, that is an extent between the lower folding edges, is in the case of a triangular folding element in particular 5 mm to 35 mm, preferably 10 mm to 20 mm. In an implementation of the folding element as a plateau, a length of the folding element is in particular 20 mm to 160 mm, preferably 40 mm to 100 mm. An angle of the folding of the folding elements may in particular be respectively 8° to 90°, preferably 20° to 45°, measured at the free-standing upper folding edge.

The angle of the folding of the folding elements may in particular be specifically realized to be 0° to 5°. In this way the folding element is in particular implemented as a divider. In particular, the divider divides the receiving region of the hood element into different zones, wherein products can be arranged between the folding elements. In particular, the special folding elements which act as dividers can be realized in the longitudinal and/or in the transverse direction and/or in any direction deemed expedient by a person skilled in the art. In particular, such folding elements may be designed without recesses, since they act as dividers and do not necessarily accommodate a product.

The folding elements may have different shapes deemed expedient by a person skilled in the art. In an implementation the folding elements preferably have a folding in the shape of a vertex, such that the folding elements are in each case triangle-shaped in cross-section. Preferably an isosceles triangle is provided, the legs being respectively formed by the sides converging to form the vertex. However, other triangle shapes are also conceivable. Irregular triangles are also possible. For example, slopes rising towards an upper folding edge with a low gradient bring about a longer guidance of the brush product in the receiving region, wherein a high stability of the folding element is in turn achievable by a steep opposite side. For a stabilization of the triangle shape, the folding elements are in particular sealed to the left and right of the folding. Furthermore, round shapes are also possible, wherein the cross-section substantially forms the shape of a semicircle or of half an ellipse.

Alternatively or additionally, folding elements having several vertices, i.e. in particular a line-up of triangle cross-sections, would also be conceivable. Herein a sealing could be realized, for example, only at the top and at the bottom, but not between the vertices. However, a disadvantage of such a shape could be its stability, which is lower than in the case of a sealing next to each folding element. As a result of the serrated manufacturing of the folding elements, a product can in particular be fixed multiply in the folding element. Moreover, in the case of serrated manufacturing, it would be conceivable that a recess serves as a guide, while a further folding forms an end abutment.

Alternatively or additionally, folding elements that form a plateau would also be conceivable. Such folding elements may be combined, in particular, with triangle-shaped folding elements that start from the plateau. The plateau is in particular fixed with further sealed sub-elements of the holding unit. Portions of the plateau are supplemented by a triangular folding element that directly adjoins the plateau. The plateau would otherwise be just a parallelogram in cross section, which does not provide great stability. By means of an introduced triangular structure, it is in particular possible to create a statically defined system. In an implementation of the folding element as a plateau, the folding element in particular has a recess for a brush product, wherein the brush product may be held in the plateau entirely or only partially. The brush product may therefore be held in a plane of the plateau such that it is surrounded by the material of the folding element in an at least partially form-fitting manner. In particular in the case of plateau-shaped folding elements, it is possible not to form the precuts during filling, but to design them such that they are preformed and only have to be uprighted. The folding elements herein in particular form in each case a parallelogram in cross-section, such that subsequent uprighting is possible. In an implementation as a plateau, the folding elements are preferably already pre-glued and only have to be erected or uprighted. In addition to the uprighting, of course the folding elements implemented in this way still must be fixed and/or positioned in the packaging base body such that they maintain the desired shape and do not collapse again.

The positions of the folding elements are in particular adapted to the shape of the brush products in correlation with and/or adaption to the recesses in the folding elements. In particular, an arrangement of the folding elements at the end of the receiving region is conceivable, wherein corresponding folding elements hold the brush product at the end of the brush product. Suitable folding elements may form a passage through a recess or may have only a one-sided recess with an end abutment. It is in particular also possible, in each holding unit, that the folding elements are displaced and/or that they do not occupy the entire width of the holding unit. Thus a slitting downwards is possible, which ends freely. The slitting may be provided with holding points which are broken during the forming. In particular, sufficient stability for further machine-processing is achievable by suitable holding points. Alternatively, a slitting only between the folding elements, which does not peter out, would also be conceivable. However, in such a case the folding elements must use the same amount of material, such that the holding unit will not warp during forming. Here, too, holding points may be provided which are not punched, wherein the holding points are torn only when the folding is carried out. As a result, stability is increased until the folding, which brings about a more stable production process.

The folding elements are preferably not arranged in the viewing window region, at most certain flanks of the folding element are visible through the viewing window. Furthermore, the folding elements are preferably not provided at the end of the receiving region of the packaging. In particular, it is optionally possible that the holding unit and/or the folding elements are arranged also in the end region in such a way that the delimiting surfaces at the top and bottom or also on the lefthand and righthand sides are reinforced with paperboard from the holding unit, respectively from the folding element. On the packaging machine, respectively in the packaging, the folding elements are preferably always in the same place, as a result of which a number of product-specific and/or packaging-specific parts in the machine is reduced. As a result, fewer format sets are required.

In the hood element the bottom, the end walls (top and bottom) and the side parts (left and right) form the delimiting surfaces. In a view of the packaging base body, the delimiting surfaces delimit the receiving region, such that part of the card element also belongs to of the delimiting surfaces.

The priorities for the positioning of the folding elements are in particular in the first place the secure and preferably clearance-free holding of the brush product, in the second place taking the viewing window into account (and/or avoiding the viewing window region) and in the third place positioning the folding elements equally between different packagings and products. A preferred arrangement is in particular the case if the brush products are passed through recesses of the folding elements. Furthermore, it is in particular advantageous if the vertex-to-vertex distance of the folding elements with respect to the total length of the receiving region along the longitudinal axis amounts to 20% to 60%, preferably 25% to 40%. Preferably a first, upper folding element is arranged after 15% to 40%, preferably after 20% to 35%, of the total length of the receiving region, measured from the end of the receiving region to the vertex of the respective folding element. A second folding element is in particular arranged after 50% to 75%, preferably after 55% to 65%, of the total length of the receiving region, measured from the end of the receiving region to the vertex of the respective folding element. A preferred distance between the folding elements from vertex to vertex, i.e. in particular from free folding edge to free folding edge, is in particular 30 mm to 190 mm, preferably 40 mm to 150 mm.

The folding elements are in particular oriented in such a way that the folding edges preferably extend perpendicularly to the longitudinal axis of the packaging base body. The recesses of the folding elements are therefore in particular formed in such a way that a brush product can be laid in in the longitudinal direction of the packaging base body. Alternatively, however, it would also be conceivable that the folding edges of the folding elements extend parallel to the longitudinal axis, for example for small products which are inserted transversely or also for supports of products. Several folding elements are also possible per each orientation. Furthermore, a combination of different folding elements is also possible. Thus, for example longitudinally-oriented and transversely-oriented folding elements may be provided in the same packaging, respectively on the same holding unit.

Folding elements with folding edges parallel to the longitudinal axis may be sealed, and they may also, for example, bear against delimiting surfaces of the hood element. Suitable folding elements with folding edges parallel to the longitudinal axis may for example also be used for placing brush products at an angle with the bristle field resting on the longitudinal folding element. Folding elements may also be arranged and/or oriented at any angle to the longitudinal axis, wherein a precut must in particular be suitably adapted in such a way that it can then be processed further. In the case of folding elements at an angle, the material requirement for the folding elements must be arranged at an angle to the longitudinal axis of the folding element. In any case, the material feed perpendicularly to the folding axis must be taken into account.

Different orientations of the brush products are achievable by means of the folding elements. For example, the brush products may be oriented identically, preferably along the longitudinal axis with a brush head facing upwards. Alternatively, the brush products may also be oriented non-identically. For example, in the case of two toothbrushes one head may be oriented upwards and one head may be oriented downwards. Alternatively or additionally, brush products, for example in the case of interdental brushes, may be oriented towards one another, wherein the folding element is in particular arranged partially in the center.

Alternatively or additionally, it would be conceivable that the folding element is arranged partially at the card element. Optionally, a folding element may be attached to the card element. Thus, in particular an interaction of different folding elements from the hood element and from the card element is possible. For example, a folding element realized as a hold-down element may be provided if a recess of a further folding element is not entirely filled out or if a brush product is not held well. However, it is also possible that folding elements arranged at the card element are realized in the packaging base body without further folding elements coming from the hood element.

Preferably, in an assembled state the hood element is fixedly connected to the card element. Preferentially an extent of the hood element along the main extension direction of the brush product packaging device at least substantially corresponds to an extent of the card element along the main extension direction of the brush product packaging device. The card element is in particular arranged on a front side of the brush product packaging device and in particular preferably has at an upper end a suspension recess, for example a euroslot recess. The card element may in particular also be realized as a rear side, such that the hood element forms the front side and/or visible side. Preferably, the card element is realized at least substantially rectangular. In principle, the card element may be realized so as to be at least partially contoured, but preferably only outside the sealing. Herein a sealing may take place within the card element while the contoured part of the card element protrudes beyond the sealed region. Furthermore, the card element is preferably realized in flat and/or planar fashion. This in particular allows realizing a sealing edge in a plane. In principle, however, it would also be conceivable that the card is angled and/or has one or more bends, or also that it has a curved or corrugated shape. For this purpose, the sealing tool must in particular be constructed with several planes, such that the sealing surface is angled. Depending on an implementation, a sub-optimal stacking can be created in this way, which however also depends on an implementation of the hood element. The hood element is in particular arranged on a rear side of the brush product packaging device. The hood element in particular has delimiting surfaces which delimit the receiving region, and has sealing edges which are connected to the lateral delimiting surfaces and are configured for a connection to the card element. The sealing edges are in particular connected to the delimiting surfaces via perforations and/or creasings. If there are perforations, these in particular have a cut length of 1.5 mm to 7 mm, preferably of 2.5 mm to 5.5 mm, and a holding length of 1 mm to 4 mm, preferably of 1.5 mm to 3 mm. Herein the perforation should in particular be stable so as not to break if there are impacts during transport. In the case of creasing, in particular a notch is mechanically introduced into a paper-containing or paperboard-containing material such that a crease is created, as a result of which the material can be folded in this point in a defined manner with lower force input. Preferably the hood element does not have pure creasing at the transitions to the sealing edges, but rather a creasing with perforation. This in particular allows providing an advantageously manufacturable packaging base body. In particular, advantageous equipping of the packaging base body is achievable. In particular, laying the brush product in from a front side is enabled. In particular, a trough formed by the hood element is accessible from the front, such that top loading, namely the filling of the hood element from the front, is possible. This allows achieving advantageous automatization.

The hood element in particular has a rectangular or trapezoid-shaped cross-sectional shape. However, other cross-sectional shapes, deemed expedient by a person skilled in the art, would also be conceivable, such as for example a triangular cross-section. A triangular cross-section would, for example, allow the brush product being laid into the hood element with the delimiting surfaces of the receiving region defining the manner in which the product is eventually fixed in the receiving region, and no holding unit is realized. In the case of a triangular cross-sectional shape, the dust tabs are in particular triangular. The triangles of the end walls do not have to be symmetrical or isosceles-shaped. Via the shape of the triangle in particular an angular position of the brush product in the receiving region can be defined. The triangular cross-section may vary in size over the length along the longitudinal direction. It is in particular also conceivable that for a longitudinal stabilization and for a fixing of the brush product, the brush product abuts the packaging base body, in particular the hood element, at the bottom and at the top. Furthermore, the triangular shape allows achieving rotational stabilization of the brush product. Furthermore, by the triangular shape the bristles abut on the card element. It would moreover be conceivable that several kinks (e. g. triangle shapes arranged in a row) and/or corrugations are provided in the hood element for an accommodation of several brush products. In this way a multi-pack or a multiple packaging could be created, wherein the brush products are substantially separate. The individual triangular receiving regions created by the hood element may in particular be realized so as to be sealed individually, i. e. separate with sealing surfaces, and also so as to be open within. The triangular cross-section in particular enables packaging of individual products without a holding unit. Furthermore, material input and costs can be kept low. Alternatively, any n-gonal cross-sectional shape of the hood element would also be conceivable, wherein the cross-sectional shape in particular must allow filling of the receiving region. For this purpose, in particular straight walls on a sealing side of the hood element would be advantageous. Optionally the formation of an undercut would be conceivable, wherein after the filling the side parts of the hood element are pressed in. The tool for pressing could later on be used as a counter surface for the sealing. Alternatively, a progression of the cross-section of the hood element along the longitudinal axis would also be conceivable, for example from triangular to tetragonal or vice versa. In this context, a "cross-sectional shape" of the hood element is in particular to mean a cross-sectional shape of the hood element when the receiving region that is delimited by the hood element is viewed in a plane perpendicular to a longitudinal axis of the brush product packaging device.

"Configured" is in particular to mean specifically programmed, designed and/or equipped. By an object being configured for a specific function is in particular to be understood that the object fulfils and/or carries out this specific function in at least one application state and/or operation state.

The implementation of the brush product packaging device according to the invention in particular allows providing a packaging that can be produced in an advantageously simple and cost-effective manner and in which a brush product can be accommodated in an advantageous and safe manner. In particular, an advantageously flexibly manufacturable and printable brush product packaging device can be provided. Furthermore, an advantageously high degree of protection of an accommodated brush product is achievable. In particular, an advantageously stable brush product packaging device can be provided. Furthermore, an advantageously high ecology level of the brush product packaging device is achievable. In particular, a high ecology level is attainable by using recycled paper material. Furthermore, it is possible to provide a brush product packaging device made of renewable materials.

It is further proposed that the holding unit comprises at least one base side element, via which the folding elements are connected to each other. Preferably the base side element extends with a main extension plane in particular parallel to a main extension plane of the brush product packaging device. The base side element in particular bears against a bottom of the hood element. Preferably the base side element in particular serves for a fastening and/or for an orientation of the holding element in the receiving region. The base side element may be realized in a one-part or multi-part implementation. Preferably the base side element forms fastening tabs in end regions of the holding unit, which are in particular connected directly only to a folding element and have free ends towards the ends of the holding unit. The base side element is in particular largely made of a paper material. This in particular advantageously allows providing a coherent holding unit. As a result, in particular manufacturing expenditure can be kept low. The holding unit may in particular be laid into the hood element of the brush product packaging device as one part.

Furthermore, it is proposed that the folding elements are connected to each other integrally via the base side element. Preferably, the folding elements and the base side element are connected to each other integrally. Preferably, the folding elements and the base side element are realized in a one-part implementation. Preferably the folding elements and the base side element are produced from a precut. Advantageously, "integrally" is also to mean in a one-part implementation. "In a one-part implementation" is in particular to mean formed in one piece. Preferably this one piece is produced from a single blank, from a mass and/or from a cast, particularly preferably in an injection-molding procedure, in particular a single-component and/or multi-component injection-molding procedure. This in particular advantageously allows providing a coherent holding unit. As a result, in particular manufacturing expenditure can be kept low. The holding unit may in particular be laid into the hood element of the brush product packaging device as one part.

Beyond this it is proposed that the holding unit extends at least over a large portion of a main extent of the packaging base body. The main extent of the packaging base body is herein in particular realized as an extent of the packaging base body along the main extension direction. The length of the holding unit in the flat state corresponds to in particular 50 mm to 240 mm, preferably 80 mm to 200 mm. A width of the holding unit in the receiving region in particular corresponds to the width of the transversely arranged folding elements. In regard to its width, the holding unit is in particular configured to adjoin side walls of the hood element. Furthermore, the folding elements preferably also serve to increase a stability of the side walls of the hood element and/or to support them, in particular as it is then less easy to push said side walls towards the receiving region of the hood element. The width of the holding unit in particular depends on the number of products in the brush product packaging device. The width of the holding unit is in particular 20 mm to 90 mm, preferably 30 mm to 70 mm. A total height of the holding unit in particular corresponds to a height of the folding elements. This in particular allows providing an advantageously stable and positionally fixed holding unit. In particular, simple insertion of the holding unit is enabled. Furthermore, in particular a twisting of the holding unit can be avoided.

An alternative implementation of the holding unit provides that the width varies in the individual holding unit. For example, depending on the structure of the hood element, in particular with regard to shape and material, in particular the edges between bottom and side part and/or between bottom and end wall may differ from the remaining hood element with regard to material distribution. As a result, in particular the implementation of a holding unit contacting the edge over the entire length is rendered sub-optimal, since the material displacement may also have an effect on the holding unit. For this reason, in particular the holding units may have indentations which preferably create a distance between the edges of the holding unit and the corresponding edge at the hood element.

In particular, the indentations are not formed in the region of the folding elements, which means that the folding elements are preferably formed in regions constituting the maximum width of the holding unit. Preferably the indentation is formed along the edge of the holding unit before and after the folding element and spaced apart from the folding edge of the folding element, preferably spaced apart from the folding edge by 2 mm to 8 mm, preferably 3 mm to 6 mm. The indentation in particular has a depth of 1 mm to 5 mm, preferably between 1.5 mm and 3 mm.

Alternatively or additionally, in particular the corners of the holding unit may be deburred. Advantageously, the holding unit does not contact the corner of the hood element as it has a material displacement of two side edges and in particular no deformation is transferred to the holding unit.

It is further proposed that the holding unit comprises an anti-twist guard. In particular, the anti-twist guard has no function in the packaging unit itself. Preferably, the anti-twist guard serves to take care of the holding unit in the flat state being correctly laid into the magazine in the packaging machine. The anti-twist guard is preferably formed at an edge of the holding unit, preferably eccentrically. The anti-twist guard in particular follows the Poka Yoke principle. The anti-twist guard is in particular realized as an indentation, preferably as a round shape, in particular as a circle segment. The indentation is preferably not formed in an angular shape as in particular re-entrant corners tend to tear.

Furthermore, it is proposed that the indentations are formed asymmetrically, which means that the outer edge of the holding unit is in particular not formed mirror-symmetrically to the longitudinal axis. The anti-twist guard is in particular excluded therefrom and is asymmetrical as it can fulfil its purpose in particular by this implementation.

It is also proposed that in the region of the folding element the edge of the holding unit is formed in projecting fashion, such that the holding unit reaches its maximum width in particular in the region of the uppermost folding edge (in the folded state). Moreover it would be conceivable that the width is implemented in such a way that in the assembled state an angle in the range of 1° to 8°, preferably of 2° to 5°, from the side part to the normal (towards the bottom) is reached, and the side part bears flat against the folding element. In particular, advantageously reliable accommodation of a brush product is achievable. Advantageously, in this way the folding element stabilizes the side part against buckling-in.

It is further proposed that the folding elements in each case delimit at least one recess for receiving at least one subregion of the brush product, wherein a first recess of a first folding element of the folding elements essentially differs from a second recess of a second folding element and is configured for receiving a different subregion of the brush product. In particular, the folding elements each form a groove-shaped recess. The recesses are in particular realized as grooves. Preferentially the recesses are in particular in each case introduced in at least two surfaces of the folding element. Said surfaces of the folding element are herein in each case situated between the folding edges, i.e. in each case between the folding edge on a fastening side of the holding unit at the transition to the flat region and the folding edge at a free vertex of the folding element.

In particular, at least two surfaces of the folding elements each have a recess, the recesses being connected to one another on at least one side. The recesses may have different shapes and/or different sizes. Preferably the first recess of the first folding element of the folding elements is essentially different in size from the second recess of the second folding element. Preferentially, a larger one of the recesses, with respect to a surface delimited by the folding element, is larger than a smaller one of the recesses by at least 10%, preferably by at least 20% and particularly preferably by at least 30%. Preferably, in a folded state of the respective folding element, the recesses taper conically from a free end, i.e. from the end at the free vertex of the folding element; this in particular brings about better clamping or fixing. Furthermore, other implementations of the recesses, deemed expedient by a person skilled in the art, are also conceivable. Particularly preferably recesses are, for example, trapezoid-shaped or semi-oval-shaped. In particular, the grooves have in a lower region a width of 3 mm to 10 mm, preferably of 3 mm to 6 mm. Furthermore, the recess has at a free open end a width of in particular 4 mm to 15 mm, preferably of 5 mm to 10 mm. The depth of the recesses is in particular 3 mm to 12 mm, preferably 5 mm to 10 mm, measured on the surface of the respective folding element. The shape of the recesses is in particular designed for an accommodated brush product. Preferably, in an accommodated state a brush product lies relatively snugly in the recess. Furthermore, a standard size for the recesses would also be conceivable, wherein a brush product may fit precisely or may have space and/or play. Preferably, the folding elements may in each case have one recess or a plurality of recesses, in particular grooves, wherein, for example in the case of multipacks, several brush products may lie in a folding element side by side in several grooves. This in particular allows achieving advantageously direct and clearance-free securing of the brush product in the brush product packaging device. In particular, damage to the brush product during transport can be avoided.

The recesses in particular serve for a fixing of the brush product. Normally, in particular one brush product is provided per recess, wherein several products per recess are also possible. It is in particular possible that several brush products are arranged side by side in one recess. For this it would also be conceivable that the recesses in each case have separating sections in which the brush products are partially spaced apart from one another. Moreover, it would be conceivable that several brush products are arranged one above the other in one recess. Thus it is conceivable, for example, that several flossers are stacked in one recess. Furthermore, different geometries of the recesses are conceivable. A geometry of the recesses is in particular adapted to a brush product. However, it would also be conceivable that the recesses in each case have general geometries suitable for different brush product geometries. The folding elements may in each case have recesses which allow the brush product being at least partially passed through the recess, in particular in the longitudinal direction of the brush product that is to be held. Alternatively or additionally, the folding elements may have recesses designed in such a way that the brush product is only laid in but is not passed through, i.e. projects only partially into the recess. For this the recess is in particular designed to be closed towards one side along the main extension direction. For example, the handle end of a brush product may accordingly be laid into such a recess, the design of the recess preventing the product from slipping off due to a closed side. In this way the brush product can in particular be held securely in the longitudinal direction. As a result, the folding element in particular has the function of an end abutment. The geometries of the recesses may herein differ between the folding elements used in a packaging device, which in particular means that a first folding element has a first recess with a first geometry and a second folding element has a second recess with a second geometry. Alternatively or additionally, it would be conceivable that in one folding element several recesses with different geometries are provided. The recesses are in particular created in in the folding element in the planar region, wherein a 3D geometry is produced when the packaging is righted.

If in the folding elements mutually opposite-situated recesses are respectively designed such that one side is closed, quasi end abutments are designed which are situated opposite one another, and the product can be clamped therebetween.

The dimensions of the folding elements may differ between different folding elements of the same brush product packaging device. Differences in particular result from the portion of the brush product that is to be held and from the positioning. With the dimensions of the folding element as well as with the recess and its positioning, it is in particular possible to define the position of the brush product and the manner in which it is presented. For example, different heights are conceivable in order to position the product in a straight manner and not at an angle. Furthermore, it would for example be conceivable to lift a handle end of the brush product, thus lowering the brush head of the brush product. For a favorable fixing of the brush product, different widths are also conceivable. The recesses in particular have a maximum width of 4 mm to 15 mm, preferably of 5 mm to 10 mm. The maximum width in particular generally depends on the number of laid-in brush products, wherein preferably one brush product is laid in per recess. The width of the recesses preferentially has a progression wherein the point of greatest width is in particular located in a region of the upper folding of the folding element. In addition, different progressions on the two sides of the folding are also possible. The recesses in particular have a maximum depth of 3 mm to 12 mm, preferably of 5 mm to 10 mm. The depth in particular generally depends on the number of laid-in brush products, wherein preferably one brush product is laid in per recess. The depth of the recesses may in particular have a progression. The recesses in particular do not necessarily have a straight lower edge. Moreover, different progressions of the lower edge are also possible on the two sides of the folding of the respective folding element. In particular, 1 recess to 10 recesses, preferably 1 to 5 recesses, per folding element is/are conceivable. The recesses may be arranged offset with regard to their orientation and position. It is in particular conceivable that a brush product is held in two recesses, wherein it is in particular possible that the recesses have different sizes and are not located on the same axis in the longitudinal direction.

Different shapes of the recesses, deemed expedient by a person skilled in the art, are conceivable. Preferably the recesses in particular have a U-shape, wherein the recess is open at an upper edge. However, recesses that are alternatively or additionally open at the edge are also conceivable. These may be arranged at the lateral end of the folding element. Thus, for example, L-shaped recesses are conceivable, wherein the brush product is on one side pressed against a side wall of the hood element. The recess is in this case partially realized in the folding element and one side is formed by the hood element. The folding element herein has a recess that is in the uprighted state of the folding element open on two sides. The bottom of the recesses may be realized in planar fashion or with a geometry. By means of a geometry, in particular better holding of the individual brush product, or in the case of several products holding of the respective brush product, could be realized. Furthermore, an angled arrangement of the brush product can be realized by means of the recess. In this case it would in particular be conceivable that the brush product is inserted into the recess at an angle. In this way product presentation at an angle could be realized. It would for example be conceivable that the recess receives the brush product in an arrangement rotated by 45°+/−20°, respectively 135°+/20°, around the longitudinal axis of the brush product. By smaller recesses in particular an advantageously high level of stability of the folding elements can be provided. For further stabilization of the folding element, it would in particular be conceivable that the recesses are arranged spaced apart from foldings, respectively creasings, in particular from a folding of the folding element that adjoins the hood element, and from punchings of the folding element. The recesses preferably have a distance from foldings and punchings, in particular a distance from the lower end of the recess to the bottom, respectively the fixed part of the folding element, of 2 mm to 8 mm, preferably of 2.5 mm to 4 mm.

By means of the recesses, different positionings and/or orientations of the brush products are conceivable. The recesses of the different folding elements in particular define the orientation of the products. For this purpose, the products are in particular laid into the groove. The shape of the recesses may have the effect that brush products are oriented differently. Herein in particular not all brush products of a packaging are necessarily oriented identically. It is for example possible that one brush product is arranged in the brush product packaging device perpendicularly with its brush head facing forwards and one brush product is arranged with its brush head sideways. The brush products may in particular be presented at different angles. Preferred are in particular orientations of the brush product around the longitudinal axis at an angle of 0°, 90°, 180° or 270°, wherein 0° corresponds to a bristle field facing forwards and 180° to a bristle field facing rearwards. Depending on the product, angles situated in between may also be realized, for example angles in the range of 45°+/−20° or 135°+/−20°. Geometries of the product, in particular at the position of the folding element, and of the recesses must in particular enable this together. Furthermore, a stabilization of the product by further elements, in particular folding elements, would in particular be conceivable, for example in the case of products presented at an angle by folding elements which are arranged such that the bristle field is at least partially supported sidewise. This in particular allows creating a stable angular position.

In particular, different variants for products with recesses are conceivable. In one implementation, a geometry of the product, in particular a subregion of the product, is inserted into recesses of the folding elements. Alternatively or additionally, a variant would be conceivable in which two grooves are arranged side by side in the folding element and between them together form a projection of the folding element, which is then insertable into a recess in the brush product. Herein, the brush product is quasi plugged onto the folding element, in particular the projection. In this variant, in particular grooves of different depths should be provided, wherein the brush product when plugged on lies obliquely due to the different depths of the grooves. The difference in depth allows creating an angular position. In a further variant, for example, only half a recess may be punched, wherein the punched element is not punched out and removed, but is merely erected, such that a projection is formed when the folding element is uprighted. After the folding element has been uprighted, the respective part protrudes beyond the upper folding edge of the folding element. Herein, the brush product is quasi plugged onto the folding element, in particular the projection.

It is further proposed that at least one folding element of the folding elements forms a projection which is configured to engage in a recess of the brush product, in particular for a fixing of the brush product. Preferably the projection is in particular formed by a free-standing, upward- and/or frontward-projecting element of the folding element. The projection may herein in particular be formed by a precut of the folding element which is folded upwards and/or frontwards (projection protruding beyond the upper folding edge) and also by forming at least two recesses which are realized on two sides of the projection (projection is formed "within" the folding element). The projection is in particular configured to engage and/or project into recesses of the product. Preferably the projection is with its geometry configured to be inserted into recesses of the brush product. In one implementation it would be conceivable that two grooves, which are situated side by side, between them form the projection which is inserted into the recess in the product. The brush product may herein be inserted into the recesses, being at the same time plugged onto the projection. Alternatively, it would be conceivable that only half a recess is punched into the folding element and the partially punched element is not punched out and removed, but is held on one side and is erected as a projection. The projection herein protrudes beyond a remainder of the folding element. The projection is configured to be inserted into a recess of the product. This in particular allows achieving advantageous fixing of a brush product. In particular, brush products with special geometries, in particular with geometries comprising depressions and/or recesses, can also be held expediently and securely.

Beyond this it is proposed that at least one first folding element of the folding elements delimits at least two recesses, which are respectively configured for receiving different brush products. Preferably the recesses are arranged side by side transversely to a main extension direction of the brush product packaging device. The recesses may herein in particular be realized identically or differently. Both recesses in particular extend over an upper folding edge of the folding element. The recesses in particular in each case serve for receiving a brush product, wherein the brush products are in particular arranged side by side in the brush product packaging device. This in particular allows accommodating a plurality of brush products in the brush product packaging device. In particular, selective spacing of the brush products in the brush product packaging device is achievable.

It is further proposed that the at least one holding unit comprises a third folding element, wherein the second folding element of the folding elements is configured to fix a first brush product of the brush products, and the third folding element is configured to fix a second brush product of the brush products. The third folding element may herein in particular be arranged directly next to the second folding element or offset with respect thereto. The third folding element is arranged along the main extension direction of the brush product packaging device in particular next to the second folding element, while the first folding element is arranged along the main extension direction of the brush product packaging device in particular behind the second folding element and the third folding element. In particular, a further, second brush product different from a first brush product may be accommodated by the third folding element. This in particular allows reliably accommodating a plurality of, in particular different, brush products in the brush product packaging device. In particular, brush products of different sizes can be accommodated.

It is further proposed that the third folding element is arranged spaced apart from the second folding element along the main extension direction. The third folding element is in particular arranged offset from the second folding element. Preferably the third folding element is arranged along the main extension direction of the brush product packaging device without overlap with the second folding element. Particularly preferentially the first folding element is arranged along the main extension direction of the brush product packaging device overlapping with the second folding element and the third folding element. This in particular allows reliably accommodating a plurality of, in particular different, brush products in the brush product packaging device. In particular, brush products of different sizes can be accommodated.

It is moreover proposed that a distance of a first folding element of the folding elements from a second folding element of the folding elements is equivalent to 20% to 60% of a total extent of the receiving region along the main extension direction. Preferably a distance of the first folding element from the second folding element along the main extension direction amounts to 20% to 60%, preferably 25% to 40%, of a total extent of the receiving region along the main extension direction. The distance is here in particular viewed from vertex to vertex of the respective folding element with respect to the total length of the receiving region of the hood element. Preferably, viewed from a lower end, the second folding element is arranged after 15% to 40%, preferably 20% to 35%, of the length of the receiving region along the main extension direction. Measured from the lower end of the recess of the hood to the vertex of the respective folding element, the first folding element is arranged in particular after 50% to 75%, preferably after 55% to 65%, of the length. This in particular allows achieving an advantageous arrangement of the folding elements. In particular, advantageously reliable accommodation of a brush product is achievable.

It is further proposed that at least one of the folding elements delimits a recess for an accommodation of at least one subregion of the brush product, which in a folded state of the folding element forms an undercut. The undercut may herein be arranged at an upper end of the recess and may as well be arranged in a central region of the recess. The undercut is in particular configured to prevent brush products from falling out or to reduce the falling out and to fix the brush products essentially without play. It is for example conceivable to provide a U-shaped recess as possible undercuts, wherein the recess becomes somewhat narrower again towards an upper, open end and/or projections project into the recess. Alternatively or additionally, it is conceivable that run-ins are provided in the recess, wherein edges of the folding element delimiting the recess are finished in such a way that the products are passed into the recess during insertion. The edge finishing may be realized to be large, such that an insertion slope is formed which comprises more than the edge finishing, which means that the insertion slope is introduced far into the recess and is meant to guide the products well into the recesses. It is for example conceivable to provide as a possible run-in a U-shaped recess that widens at an upper, open end. This in particular allows providing a particularly advantageous recess. In particular, advantageously secure insertion and holding of the brush product is achievable.

Furthermore, in particular use of the interstices between the folding elements and/or in the eventually closed receiving region is basically conceivable. The interstices may, for example, be used for accessories, additional products, replacement parts, e. g. in toothbrush packagings. Conceivable are here, for example, head receptacles, toothpaste tubes, in particular mini-tubes, hourglasses, replacement heads, gadgets, e. g. toy figures for children, instructions for use, advertising leaflets or the like. In individual packagings, possible interstices in the eventually closed cavity are, for example, located between the brush product and delimiting surfaces of the hood element and/or of the card element, and/or between the brush product and at least one of the folding elements, and/or between the folding elements, and/or between one of the folding elements and delimiting surfaces of the hood element. Alternatively or additionally, it would be conceivable that an interstice is created between side walls of a recess, in particular quasi recessed in the holding unit.

Furthermore, it is proposed according to the invention that the card element comprises at least one suspension recess, e. g. a euroslot, and the hood element comprises, in a proximity of the suspension recess, at least one reinforcing element, which is configured for a stabilization of the card element in a region of the suspension recess and whose main extension plane is angled with respect to a main extension plane of the card element. Preferably a main extension plane of the card element runs parallel to a longitudinal extent of the brush product packaging device. The suspension recess in particular serves for a suspension of the brush product packaging device. The suspension recess is in particular realized as a euroslot. However, other implementations of the suspension recess, deemed expedient by a person skilled in the art, are also conceivable (for example as a circle, rectangle or elliptical shape). The suspension recess in particular serves for a hanging presentation of the product in the brush product packaging device. It is conceivable to design the suspension recess with two layers in such a way that the visible side is smaller than the other side, wherein the visible side is in particular as large as a euroslot per se. The rear side, in particular the hood element or a second layer of the card element, preferably has a larger euroslot or a recess in an adapted shape that is larger than the euroslot in the front side. In this way in particular tolerances are compensated during joining. On the visible side the suspension recess should in particular be beautiful and should not be covered. The rear side in particular must not protrude into the hole of the front side. In the suspension recess in particular an advantageously high level of stability must be provided. For this purpose, for example, a stronger paperboard may be used for the card element if the suspension recess is located in the card element. In addition, there is the possibility of a double-layer implementation with a suspension recess in the card element and a corresponding suspension recess in the hood element. In this context, a "reinforcing element" is in particular to mean an element which counteracts a weakening or destruction of the suspension recess, in particular by the card element being torn open and/or bent in a region of the suspension recess. Preferably the reinforcing element in particular forms a material reinforcement and/or a static reinforcement of the card element in a region of the suspension recess. Preferably the reinforcing element in particular serves for a static reinforcement of the card element in a region of the suspension recess. Preferably the reinforcing element is in particular configured for a static stabilization of the card element by means of a section extending transversely to the card element. By "angled" is in particular to be understood, in this context, that a main extension plane of the reinforcing element extends transversely to a main extension plane of the card element. "Transversely" is here in particular to mean an orientation of a direction and/or of an axis and/or of a plane relative to a reference direction and/or a reference axis and/or a reference plane, wherein the orientation of the direction and/or the axis and/or the plane at least differs from an at least substantially parallel orientation to the reference direction and/or the reference axis and/or the reference plane, and in particular includes an angle>0° or is perpendicular to the reference direction and/or the reference axis and/or the reference plane. In this context, a "proximity" is in particular to mean a spatial region extending spherically around a geometric center of the suspension recess, the radius of said spatial region being equivalent to maximally twice the maximum extent of the suspension recess. By means of the reinforcing element, in particular a stability of the suspension recess can be improved. In particular, damage to the suspension recess can be avoided. It is in particular possible to ensure that in a fall onto the suspension recess a bending in the longitudinal direction bending-off is avoided and associated standardized transport tests can be passed.

Different, also alternative, variants of the reinforcing element are conceivable. For example, a double pass-through through the hood element and the card element is conceivable, wherein the elements adjoin each other directly. Furthermore, a double pass-through through the hood element and the card element would also be conceivable, with the elements being spaced apart from one another. For this the hood element and the card element are in particular oriented so as to be angled relative to each other in a region of the suspension recess. Preferably a euroslot holder is guided through both elements for a suspension of the brush product packaging device. For this the card element has a suspension recess and the hood element also has a recess in the corresponding region. In a region of the suspension recess, the card element is in particular supported on the hood element by the reinforcing element of the hood element.

It is further proposed that the hood element has at least one side part which extends beyond the receiving region and which in the region of the suspension recess forms a stabilizing wall that forms the reinforcing element and extends at least substantially perpendicularly to the card element. The hood element preferably comprises a bottom and two side parts adjoining the bottom and two end walls adjoining the bottom. Preferably the hood element further comprises two side parts which extend beyond the receiving region and which in the region of the suspension recess each form a stabilizing wall that forms the reinforcing element and extends at least substantially perpendicularly to the card element. The expression "substantially perpendicularly" is here in particular meant to define an orientation of a direction and/or of a plane relative to a reference direction and/or a reference plane, wherein the direction and/or the plane and the reference direction and/or the reference plane, in particular viewed in a projection plane, include an angle of 90° and the angle has a maximum deviation of in particular less than 8°, advantageously less than 5° and particularly advantageously less than 2°. The reinforcing element herein in particular forms a support geometry in the form of a stabilizing wall. In the case of brush product packagings that are not that wide (42 mm or less), it is in particular conceivable that the suspension recess is integrated in the card element, wherein the at least one reinforcing element extends in the assembled state as far as the edge of the suspension recess. The stabilizing wall is in particular folded from the side part of the hood element. The hood element preferably has sealing surfaces around the receiving region, wherein these may be combined at the front with the surface around the suspension recess. In the case of wider geometries of the brush product packagings, the suspension recess may in particular be integrated in the hood element and/or in the card element. The suspension recess in the hood element may therefore in particular also be combined with a suspension recess at the card element, otherwise the length of the card element must be adapted in such a way that the euroslot is accessible. Creasings, scorings and/or perforations may also be provided in order to assist with the folding, in particular the folding of the hood element with the at least one reinforcing element. Via an angled creasing for the reinforcing element, the reinforcing element, respectively the end wall and the stabilizing walls, may in the inner region between the outer sides of the reinforcing element assume different angles with respect to the longitudinal axis. In the flat state of the precut for the hood element, for example an angle of 45° would be conceivable such that the receiving region in the hood element has a straight end wall. Flatter angles make the end wall petering out more towards the suspension recess. In particular, an angle between 25° and 60°, preferably between 30° and 45°, is conceivable. The creasing and/or the outer geometry of the hood element in the region of the at least one reinforcing element at the end define/s an orientation of the reinforcing element and of the end wall. Straight lines will in particular result in a perpendicular end wall. An outer geometry protruding at the corners will in particular bring about an undercut in the end wall. Receding corners of the outer geometry in particular result in a petering-out end wall. The edge from the corner herein in particular meets the edge with the creasing. Furthermore, this also determines whether the reinforcing elements and the stabilizing walls adjoin each other. If an angle other than 90° is generated, they will no longer adjoin each other.

Furthermore, it is proposed according to the invention that the packaging base body has at least one viewing window. The viewing window in particular serves for enabling color recognition as well as a presentation of the brush product in the brush product packaging device. The viewing window in particular serves for making products, a number of products, colors and the like visible. Preferably, a bristle field of the brush product is visible through the viewing window. In order to achieve a pure cardboard packaging, in particular only a hole or a recess may be provided. The hole may in particular be at least partially closed by the brush product. For example, a surface of the handle region may cover the hole, thus making the color of the brush product visible. Alternatively or additionally, a head receptacle, which protects the brush head, may also be provided at and/or attached to the brush product, wherein the head receptacle closes the hole or passes through and thus closes the hole. As a result, in particular the bristle field, the bristle type and the bristle color would be visible and could signalize a color of the product. Herein the head receptacle would in particular have to be adapted so that possible air holes are not situated in the open region, i.e. in the region of the hole. However, it would also be conceivable that the hole simply remains open. Alternatively or additionally, the hole may also be closed by a fastened film. The closing of the hole may be provided before or after the insertion of the brush product into the packaging base body. The closing preferably takes place with a transparent or translucent element/material. Herein plastic with a high recyclate content, in particular 100% plastic film made of recyclate, and/or of renewable raw material, biodegradable such as pulp, cellulose or the like and/or transparent paper, is conceivable. Transparent paper may be provided in translucent or transparent fashion. As plastics, in particular cellulose-based plastics such as cellulose hydrate, PLA or PET-A, in particular 100% recycled, are conceivable. Furthermore, R-PET and/or PET, OPP or the like are conceivable as a material. Alternatively, water-soluble plastics, e.g. PVA, are also advantageous. This has the advantage that no foreign substances occur in paper recycling. The material thickness of the film is in particular 10 my to 30 my, preferably 15 my to 25 my. The implementation of the material is in particular such that recycling in the normal recycling stream is possible. In particular, the percentage content and the material correspond to the regulations such that recycling is possible. With respect to the total weight of the packaging, the viewing window weight accounts for no more than 5% of the weight of the entire packaging. Fastening of the film may be realized by sealing or gluing, in particular within the packaging base body, or on its outside. The film may in particular form a portion of the outer contour, for example as an overhang label (this means that certain regions of the film outside the hole can be lifted off the packaging base body or are not supported by the packaging base body) or as a reinforcement for the contour of the euroslot recess or as a euroslot recess in the label. The film may in particular be glued together with a label and/or as a label, for example onto the packaging base body, such as in particular onto the hood element or the card element. The film may be neutral or be printed. Application of the film is herein realized in particular from the outside when the packaging is already finished, in particular sealed. Preferably the label and/or the film is provided outside the sealing region. If there is a printing of the film, features of the product may be highlighted with suitable graphical designs, for example by arrows or words. This may take place on all transparent windows, not only on the label. The film may also substantially envelop the entire packaging base body. It would also be conceivable that the film is not fastened and, for example, is only laid into the packaging base body. The film may in particular be laid in and clamped between different paperboard parts in the packaging base body. This could achieve simple separability for recycling and disposal. The film may herein be straight or formed, such as for example as a 2D or 3D shape. A 3D shape could, for example, be produced by deep drawing and could constitute an integrated element for holding the brush product. Furthermore, it is conceivable that, for example, the hood element is designed such that a rear side is formed like an overhang label, i.e. the rear side is also formed from a portion of the side surface. The film herein closes the rear side and the exposed side surfaces, wherein several "holes" are closed by a film. As a further option, the viewing window may at the same time form an opening for a travel box that can be opened and closed several times. Furthermore, a 3D viewing window would also be conceivable. This could be realized by means of a head receptacle projecting through the hole. The viewing window may also extend over a corner, wherein the viewing window may, for example, be arranged in the hood element, both in the bottom and/or in the side part and/or in the end wall. Furthermore, for color recognition a specific card showing the color would also be conceivable. For example, it would be conceivable that the brush product is identified inline in the packaging machine, wherein the color is determined, a specific blister card is selected or a specific printing is initiated, in particular inline. This in particular allows achieving particularly advantageous product presentation.

Preferably at least one viewing window is provided in the card element. Preferably, viewed in the finished packaging, the viewing window is substantially always inside the sealing edge. The sealing surface therefore in particular does not extend into the viewing window, such that the sealing edge is not seen. Viewing is therefore done directly into the hood element and not onto a sealing surface. Moreover, the sealing edge should in particular be planar for optimal pressure distribution during sealing, the sealing edge may therefore also be divided to several planar partial sealing edges. In order to improve stability, it would also be conceivable to provide several viewing windows which are spaced apart by webs instead of one large viewing window. Webs altogether help in particular to achieve improved stability despite a weakening of the material due to punched-out windows. The webs in particular also serve to reduce twisting during processing. The webs preferably have a width of 2 mm to 10 mm, preferably of 3 mm to 5 mm. The shape of the at least one viewing window is in particular predetermined by a shape of a punching knife, and is limited by the possibilities for punching knives. The shape of the at least one viewing window may, for example, be a free-form contour, adapted for example to the product and to the graphical design. Circle-shaped, oval, circular segment-shaped, n-gonal, square, rectangular, diamond-shaped, rhombus-shaped and/or parallelogram-shaped viewing windows are conceivable. The viewing window preferably has rounded corners. The viewing window is in particular adapted to the artwork. A film of the viewing window is in particular applied by lamination. Herein the lamination may be realized entirely or only partially. The film may thus be applied over the entire surface of the card element or only in a strip. The paperboard of the card element is preferably laminated with the film of the viewing window. The film is preferably laminated over a large region of the card element. Lamination over the entire card will result in simpler processing of the pre-assembled product. In particular, everything may be laminated in the case of viewing windows which are located far apart. Alternatively, there is the possibility of laminating only subregions, i. e. in particular only where viewing windows are located and the respective adjacent fastening region for the film. This allows achieving cost reduction since less film is required. In contrast, the film must be precisely positioned with great effort during production. As a whole, the card element will in particular become more stable as a result of the lamination. Thus the lamination may in particular be used deliberately in order to make the card element more stable in certain regions, for example in order to achieve higher stability of the suspension recess. A graphical design of the printing may in particular be adapted to the viewing window, or vice versa with the brush product continuing visually from the card element to the viewing window and then in turn to the card element. In this way certain product parts may be shown on the card element in printed form while certain product parts are actually shown in the viewing window. Furthermore, in the case of a double pack, the viewing window may extend not only over one brush product, but two products may be visible in part. Alternatively or additionally, two viewing windows for one brush product or also four viewing windows for two brush products are conceivable. In the case of two offset viewing windows, in particular different portions of different products may be made visible. An asymmetry of the viewing windows on the brush product is also conceivable. Furthermore, viewing windows on only one product, while a second product is completely covered, are also conceivable.

Alternatively or additionally, a suitable printing of the brush product packaging device is conceivable, such as for example by inline printing. Herein in particular large regions may be specifically printed, wherein the brush product is in particular laid in in a color-defined manner before printing and/or a camera identifies a color of the brush product. Alternatively, there is also the possibility of specifically printing smaller regions, wherein in particular a color selection is printed onto the brush product packaging device and inline a tick for the color selection is placed in the correct place.

It is also proposed that the hood element of the packaging base body delimits at least one recess that forms the viewing window. The viewing window is in particular realized so as to correspond to a viewing window in the card element. The viewing window may herein in particular be arranged in the bottom, in one of the side parts or in one of the end walls of the hood element. Furthermore, it would be conceivable that the viewing window extends over an edge of the hood element and is arranged on at least two sides. The viewing windows may furthermore also be combined, i. e. the viewing window may in particular be arranged both in the card element and in the hood element. Portions of the brush product may be visible from the front, others from the side or from the rear. Furthermore, a variant would be conceivable in which viewing windows are arranged in a longitudinal position around the brush product, i. e. in particular on the card element, on the lateral side parts of the hood element and in the bottom of the hood element. This in particular enables visibility of the brush product from different directions.

The packaging base body preferably comprises dust tabs, in particular independently of an implementation. The dust tabs are in particular elements at an upper edge, such as for example at an edge of the hood element, in order to prevent or reduce the entry of dust. The dust tabs are in particular non-fixed or may be fixed, like in particular by gluing, sealing or the like, folded and adjoined. Dust tabs may in principle be provided on the packaging base body wherever miniature openings occur in the packaging base body and had better be closed. Dust tabs are preferably not separate elements, but are realized integrally with other components of the packaging base body that have already been described. In the case of an automated closing process, a long dust tab, realized in a completely overlapping fashion, may be provided on the upper side over the entire width, in particular for enhanced counter-pressure in the gluing process. In this context, a "dust tab" is in particular to mean a component of a folding box configured to prevent the entry of dust and other foreign bodies into the interior of the box. Moreover, in particular by applying counter-pressure, dust tabs ensure that a cover tab does not break into the folding box. They quasi serve as counter-pressure. The dust tabs furthermore also serve for the stabilization of the packaging base body; when fixed they usually bring about connections over corners, which is mechanically advantageous. The shape of the dust tabs in particular depends on the packaging shape, on the function(s) to be fulfilled and on the processing in the machine.

For example, the dust tabs in hood elements may extend as far as the bottom or may be spaced apart planarly. In particular, the dust tabs in the hood element bear against the end wall and close the edge between the side part and the end wall at least partially, wherein the transition between the dust tab and the side wall/end wall in the hood element at least substantially forms the edge. Preferably, the dust tabs support the side part and/or the end wall with respect to the bottom if the dust tabs extend as far as the bottom. In particular, dust tabs may have a wide variety of shapes. In each case one side is attached to the side part and/or to the end wall, wherein in particular the remaining contour connects the two ends of this connection. Preferably a closed contour is formed which may be realized as desired, for example as an n-gonal form or as a free-form surface.

Furthermore, it is proposed that the recess of the viewing window is arranged in a bottom of the hood element. Preferably, the recess for the viewing window is introduced into the bottom of the hood element. This in particular enables visibility of the brush product from different directions. When the viewing window is introduced into the bottom of the hood element, care is to be taken that the viewing window is not covered by elements of the holding unit and thus the viewing window is closed. For this reason, a viewing window in the bottom of the hood element usually also involves an adaption of the holding unit, for example in the form of punched-out portions.

It is further proposed that the viewing window has a main extension area equivalent to 5% to 40% of a main extension area of the card element. The size of the cumulated viewing windows is in particular 5% to 40%, preferably 8% to 20%, in relation to the total area of the card element. A number of viewing windows in particular depends on a number of webs in between. Preferably 1 to 8 viewing windows, preferably 3 to 5 viewing windows, are conceivable. This in particular enables visibility of the brush product from different directions.

Furthermore, it is proposed according to the invention that the hood element has at least one, in particular planar, bottom, the main extension plane of which extends at an angle of 2° to 15° relative to a main extension plane of the card element. Preferably the angle is 3° to 10°. The brush product packaging device in particular forms a trapezoidal packaging, wherein the brush product that is to be accommodated is in particular designed in a suitable manner and is adapted to the shape of the brush product packaging device. The brush product packaging device and the brush product are in particular configured to interact in such a way that due to their shape no holding unit is required. In addition, it would be conceivable for the hood element to be formed conically in depth. This in particular allows dispensing with a folding element. In particular, a volume-optimized packaging can be provided. Moreover, it is conceivable that in the case of several packaged products, the products are also swedged against one another. Furthermore, it is conceivable that the side parts of the hood element have such a progression in their angle relative to the card element that a twisted side surface is formed. Furthermore, a dimension of the hood element preferably decreases from the front side to the rear side and from top to bottom. Depending on the product, it is also conceivable that a progression of the dimensions is reversed. Preferably the surfaces of the packaging base body that delimit the receiving region are designed at least partially in such a way that they form tangents to the brush product. Furthermore, a dimension of the hood element preferably increases from the lefthand side to the righthand side and from top to bottom. Depending on a product, it is also conceivable that a progression of the dimensions is reversed. Preferably the surfaces of the packaging base body that delimit the receiving region are designed at least partially in such a way that they form tangents to the brush product. Preferably the trapezoidal packaging is wider at the top. In a plane perpendicular to the longitudinal axis, the side parts in particular have an angle, in particular relative to a perpendicular of the main extension plane of the card element, of 2° to 30°, preferably of 3° to 40°. At an upper and a lower end, the brush product is in particular adjacent to the packaging base body. The end walls of the hood element are in particular not perpendicular but also at an angle. The angle of the end walls relative to a perpendicular of the main extension plane of the card element in particular amounts to 2° to 30°, preferably 3° to 40°. In particular, each opposite-situated pair of delimiting surfaces of the hood element is arranged at an angle. This allows creating additional stability. A suitable implementation of the brush product packaging device in particular allows dispensing with an inlay. Furthermore, an advantageously compact optimized packaging can be provided.

It is further proposed that the hood element and the card element respectively have at least one contact region, which is respectively configured for a defined contacting of the brush product, wherein the packaging base body is configured to accommodate the brush product in a clamping fashion between the at least one contact region of the hood element and the at least one contact region of the card element. The brush product may in particular be clamped by means of the brush product packaging device. In particular, the brush product is configured to be clamped sidewise and lengthwise in the hood element. Furthermore, the brush product is in particular configured to be clamped in a depth extent, in particular between the front and the rear, between the hood element and the card element. A suitable implementation of the brush product packaging device in particular allows dispensing with an inlay. Furthermore, an advantageously compact optimized packaging can be provided.

It is further proposed that the card element and the hood element are produced together from a one-piece precut. Preferably the precut remains in a one-part implementation also during production of the packaging base body. The hood element is therefore preferably combined with the card element. Preferably only one precut instead of two precuts is moved during production of the packaging base body. The card element may herein be realized in the precut above the hood element, i.e. in particular connected in the longitudinal direction, and may as well be realized side by side with the hood element, i.e. in particular connected in the transverse direction.

It is further proposed that the packaging base bodies which are produced from a precut form an at least substantially closed receiving region. Preferably the side parts may be sealed with respect to the card element or, for example like dust tabs, only bear against the card element. In particular, in the case of a dust tab-like implementation, the precut is adapted in such a way that the sealing edges which now form the dust tab are oriented against the receiving region and extend away therefrom.

Furthermore, it is conceivable that in the brush product there are precipitations from the soft material, in particular in the case of TPE. This in particular results in spots occurring on the paper material. Therefore the paper material is in particular at least section-wise provided with a layer of a varnish, in particular a sealing wax, or also of ink, such that the surface no longer absorbs or laminates such precipitations. Alternatively, there is also the possibility of holding respective product portions made of the soft material away from the outer paperboard, for example by a suitable implementation of the folding elements.

In addition, a method for producing the brush product packaging device would be conceivable. Herein, in particular depending on an implementation of the brush product packaging device, different methods are conceivable. For the brush product packaging device, in particular a precut of the card element and of the hood element is preferably produced in a first method step. Furthermore, in particular the hood element is formed from a precut. Herein in particular a trough is formed from the flat precut. Herein lateral elements of the precut are bent. As already described, the planar portion of the precut may optionally also be deformed by heat and/or by pressure and/or by supply of moisture. Herein the trough formed in this way may optionally be glued and/or sealed or may be held in shape temporarily without a fixed connection. When sealing the hood element, the precut is in particular sealed in a region of the dust tabs. In addition, it would be conceivable that an inlay, like in particular a folding element of the holding unit, is introduced. Furthermore, the formed trough is in particular filled with the brush product. Then in particular the card element is placed onto the filled trough. The card element is in particular sealed with the sealing edges of the hood element, in particular by hot sealing. The requirements for the sealing wax are herein in particular food-contact suitability. Furthermore, the sealing wax is applied onto the hood element and onto the card element. It is in particular theoretically conceivable that the sealing wax is applied only on one side. Furthermore, in particular a sealable cardboard type must be selected. Not all cardboard types are sealable, like for example grass cardboard, which cannot be sealed because of its porosity, since the sealing wax is absorbed and is thus not available on the surface. In order to enable a use of grass cardboard, it would be conceivable to treat the grass cardboard in such a way that a sealing wax does not enter into the material. The requirements regarding the sealing edges of the hood element are in particular that they should be situated in a plane. It would also be conceivable that the sealing edges are situated in different planes, which is however more complex in terms of production technology since several sealing plates are required. It would also be conceivable that the sealing edges which are sealed onto the card may be hidden by an optical design. Alternatively it would also be conceivable that the sealing edges of the hood element extend as far as an edge of the card element in order to reduce visibility of the sealing edges. Herein in particular a tolerance issue arises as the geometries must match. However, there is also the advantage that there is no edge on the surface and therefore no steps are formed between the card element and the sealing edges. Moreover, it would be conceivable that the packaging base body is punched after sealing, such that the outer contour is flush. The sealing edges extend around the entire raised contour of the hood element. However, it would also be conceivable that the sealing edges are partially interrupted and/or cut in order to create circumferential contours. The width of the sealing edges is in particular 3 mm to 7 mm, preferably 3.5 mm to 5.5 mm. The width of the sealing edges in particular depends on the shape of the edge, respectively of the entire sealing area, and depends on the weight of a product. Furthermore, the sealing edges depend on the substrate, i.e. paperboard and sealing wax. In principle, it would also be conceivable that the hood element and the card element are connected by welding, in particular by ultrasonic welding, and/or by gluing.

It is also possible to design a folding element-like element which is folded into the packaging base body. This element is designed similar to a sealing edge, but can then be folded over the folding edge into the packaging base body. Herein the element may or may not be fixed to the bottom of the hood element. The element may have recesses that can be used for a fixing of brush products. In general, such elements may also be formed such that they are situated opposite one another in the packaging base body, such that a brush product can be laid into both elements and/or their recesses. A corresponding design of the elements results in a disadvantage for the packaging, namely that the closure no longer has the same quality and/or tightness.

An alternative implementation of the brush product packaging device provides that only a portion of the brush product is arranged in the packaging base body. For example, the hood element is designed in such a way that the application head of the brush product can be stowed therein, and the brush product leaves the packaging base body through an end wall in the region between the application head and the handle. The handle of the brush product is thus not stowed in the packaging base body, but is arranged in an exposed manner. Accordingly, the brush product packaging device and/or the hood element and also the card element are realized in much smaller fashion. A suspension recess is realized at the brush product packaging device. In the packaging base body a holding unit, having one or several folding elements with recesses which fix the application head, may be realized. The structure of the brush product packaging device is preferably such that the opening in the end wall is minimized and, in the region of the passage through the end wall, the brush product bears both against the end wall and against the card element. The rear side of the application head bears against the card element. The presentation at the point of sale is preferably such that the hood element faces towards the purchaser and the handle is thus oriented frontwards.

A further alternative implementation of the brush product packaging device provides the use of two hood elements. In this case the hood elements are placed one above the other and connected. In particular, the additional hood element in such a case replaces a card element. By a suitable implementation the folding element can be designed in such a way that the folding element projects beyond the sealing area, i. e. the connecting surface of the two hood elements. In the finished packaging the folding element is preferably fixed and formed in one hood element and projects into the other hood element. In particular, the euroslot can be realized at the level of the sealing area. Preferably, in order to achieve sufficient stability, the tab in which the euroslot is realized may be formed on both hood elements. The tabs are connected and in particular a stably-shaped euroslot is formed. Advantageously the packaging hangs vertically when it is suspended by the euroslot.

Furthermore, in this context, the terms "upper side" or "front side" of the toothbrush are in particular to mean that side of the toothbrush on which the thumb is placed. The upper side or front side is normally also the side to which the bristle field, in particular of the brush head of the plug-on brush, is directed. The term "underside" or "rear side" of the toothbrush is in particular to mean the side which faces away from the bristle field of the brush head. Furthermore, the terms "lefthand side" and "righthand side" are respectively related to a viewing of the front side.

DRAWINGS

Further advantages will become apparent from the following description of the drawings. In the drawings thirty-six exemplary embodiments of the invention are shown. The drawings, the description and the claims contain a plurality of features in combination. The person skilled in the art will purposefully also consider the features individually and will find further expedient combinations.

Figure 1B:
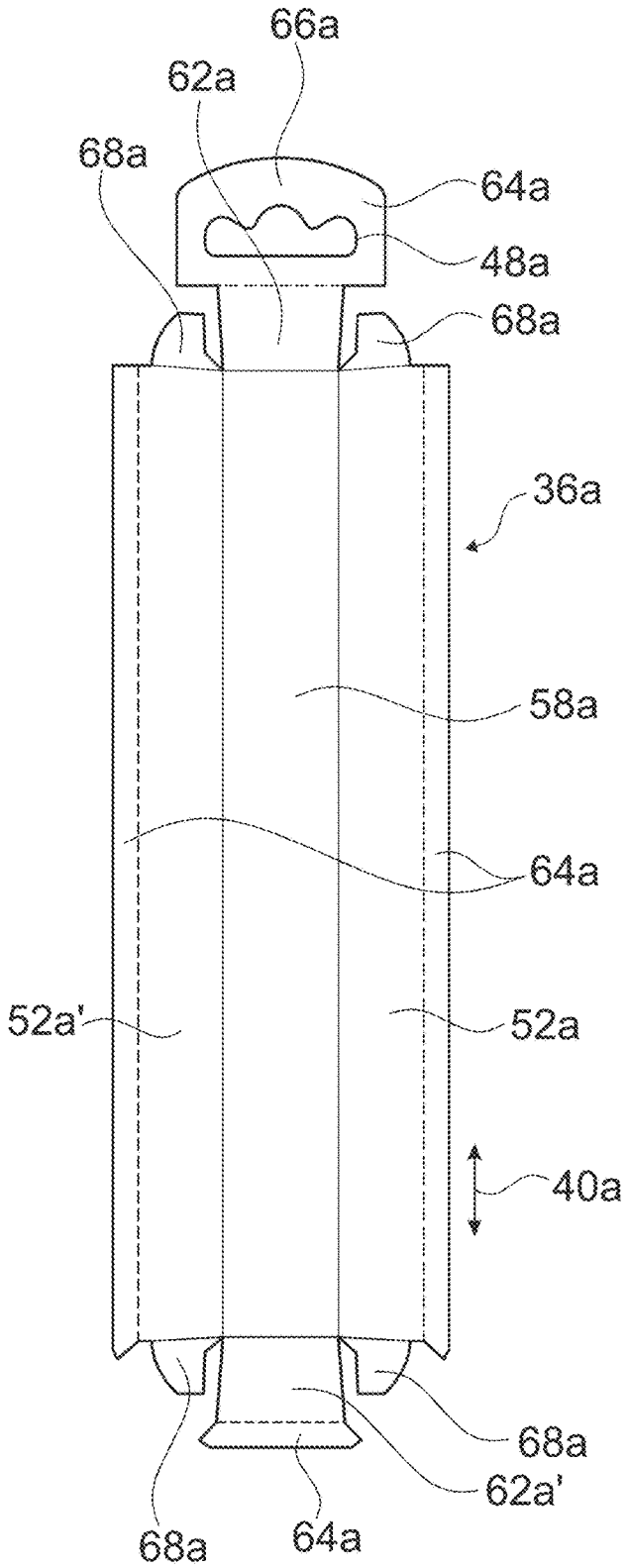
Figure 1C:
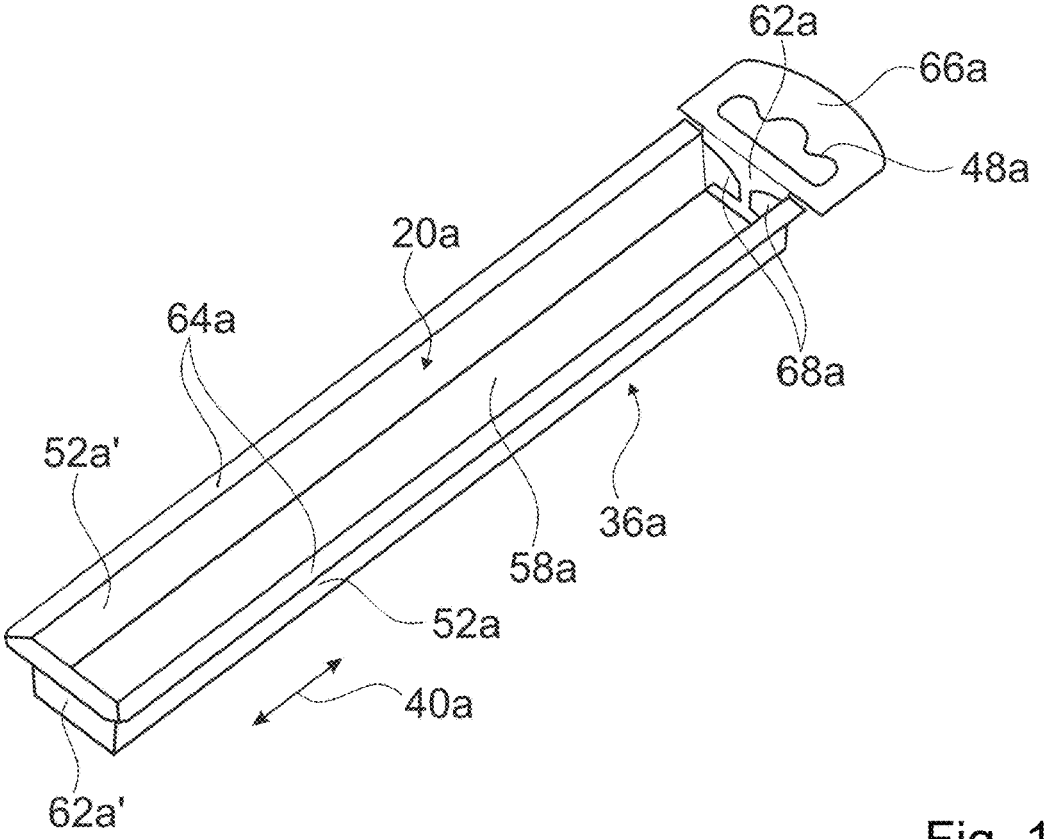
Figure 1D:
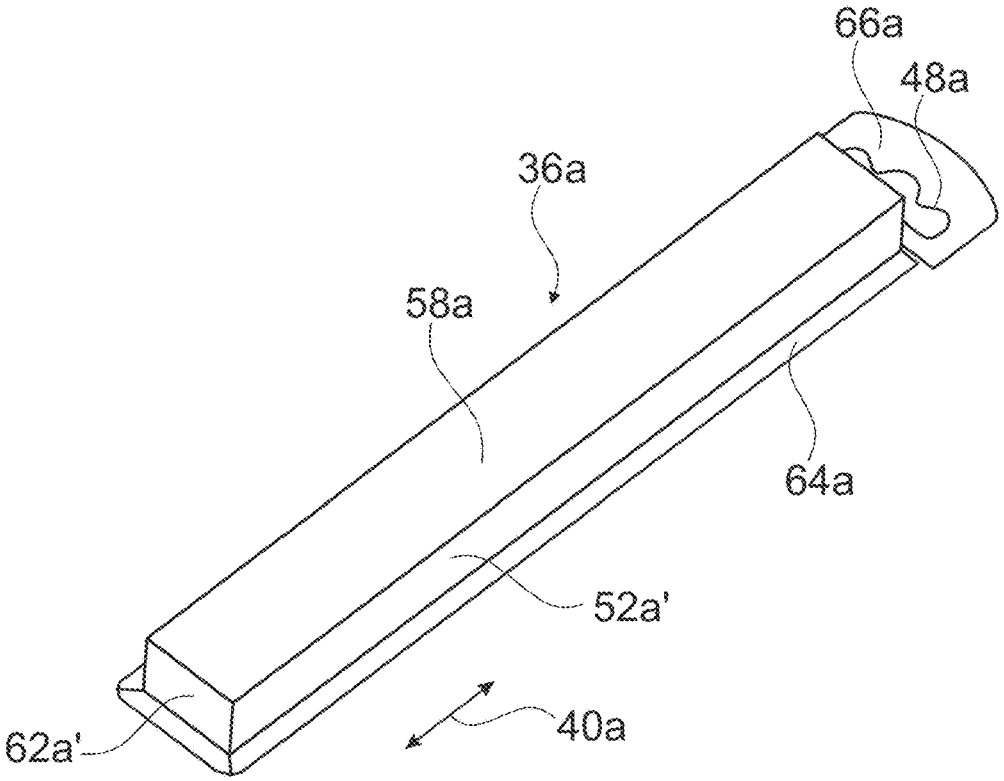
Figure 1E:
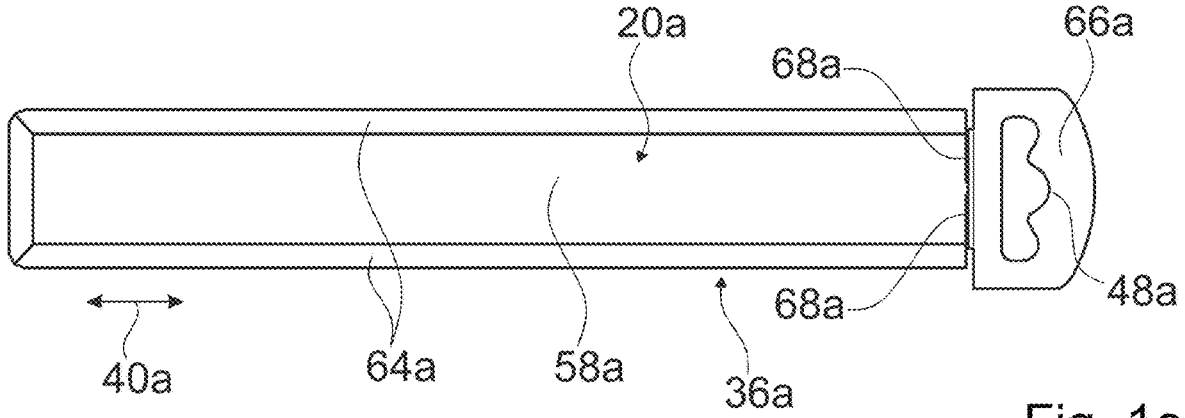
Figure 1F:
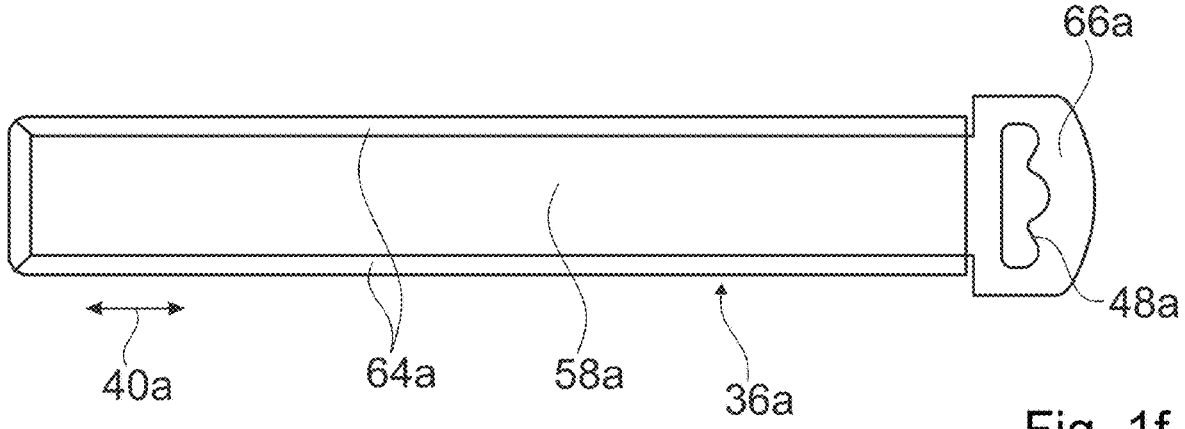
Figure 1G:
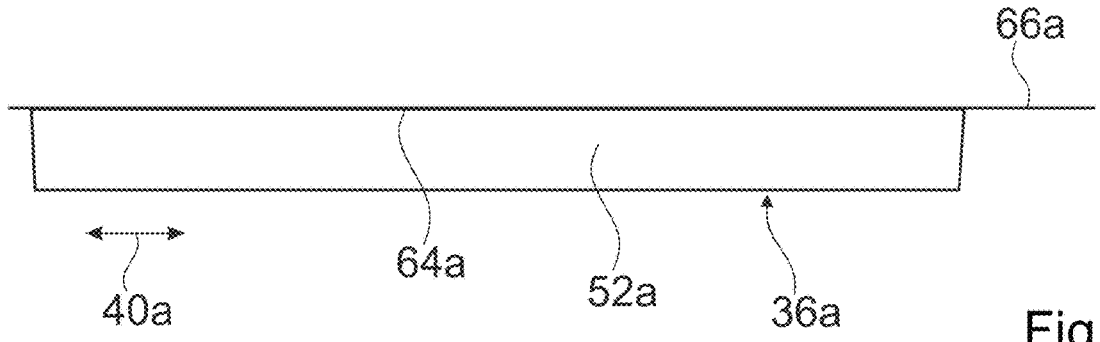
Figure 1H:
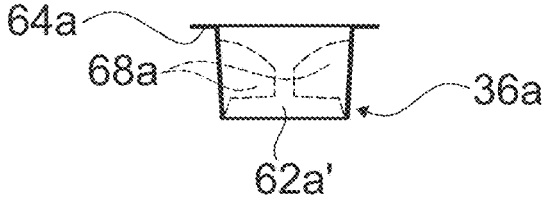
Figure 1I:
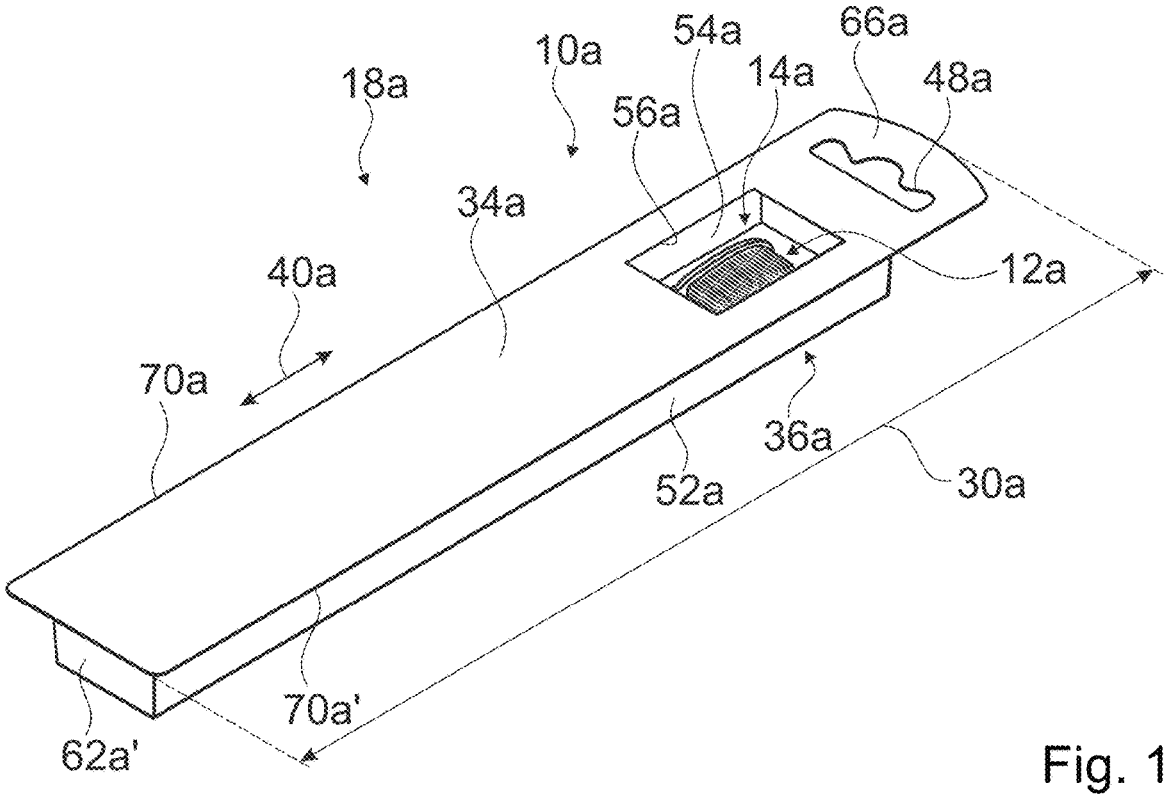
Figure 1J:
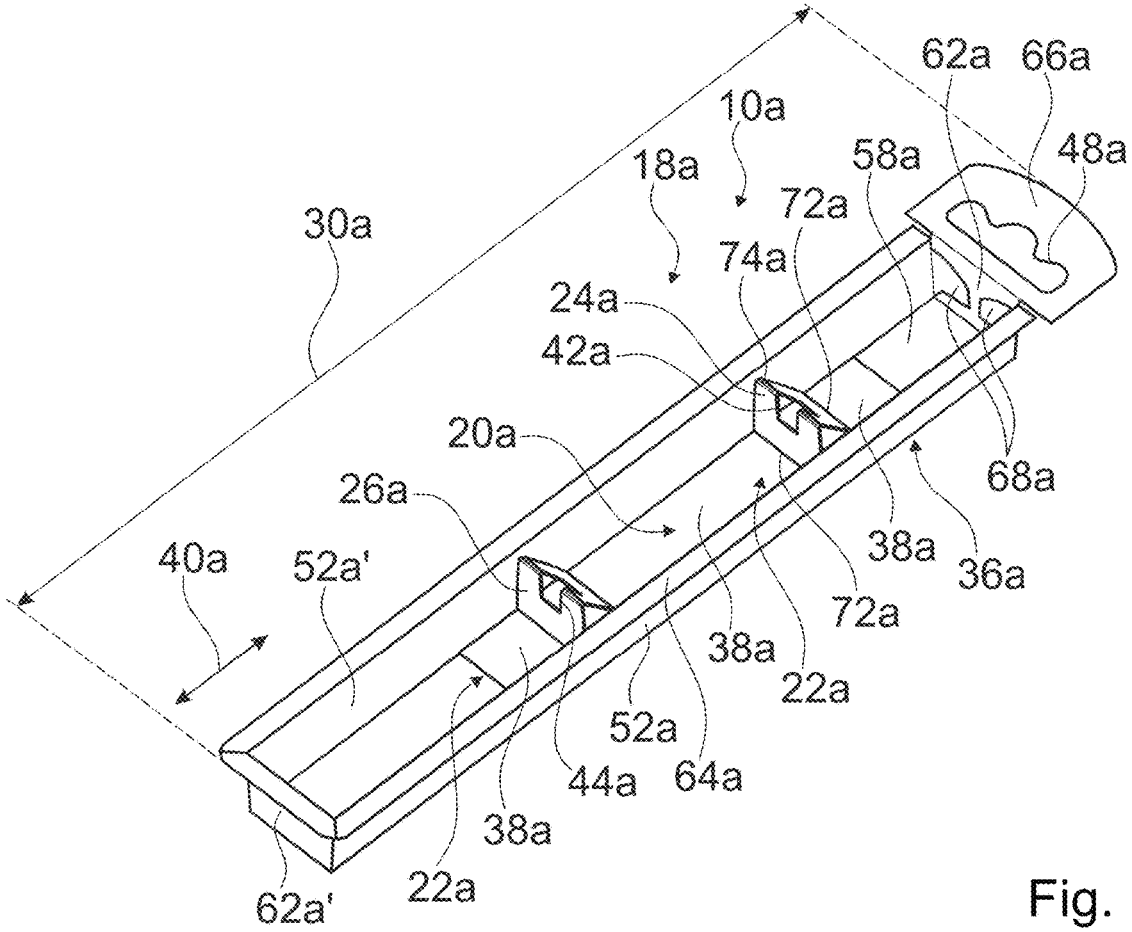
Figure 1K:
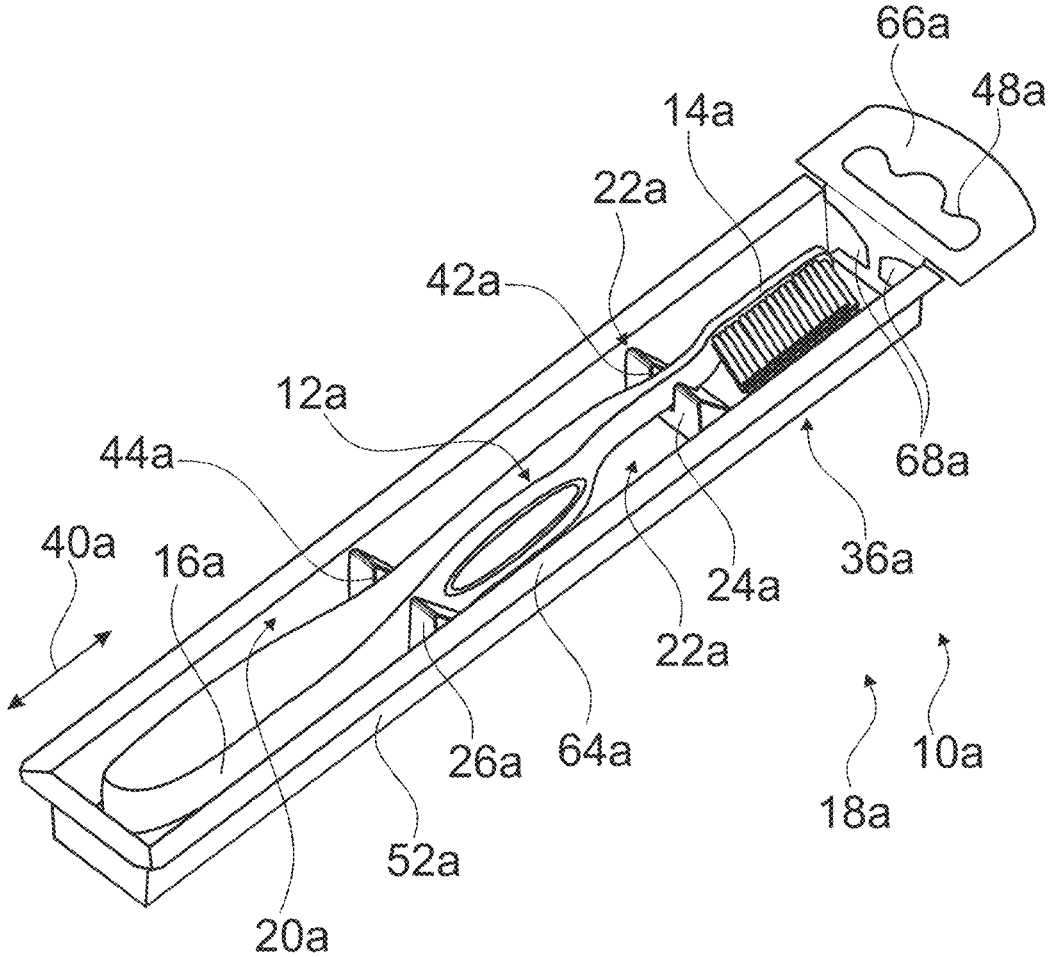
Figure 2A:
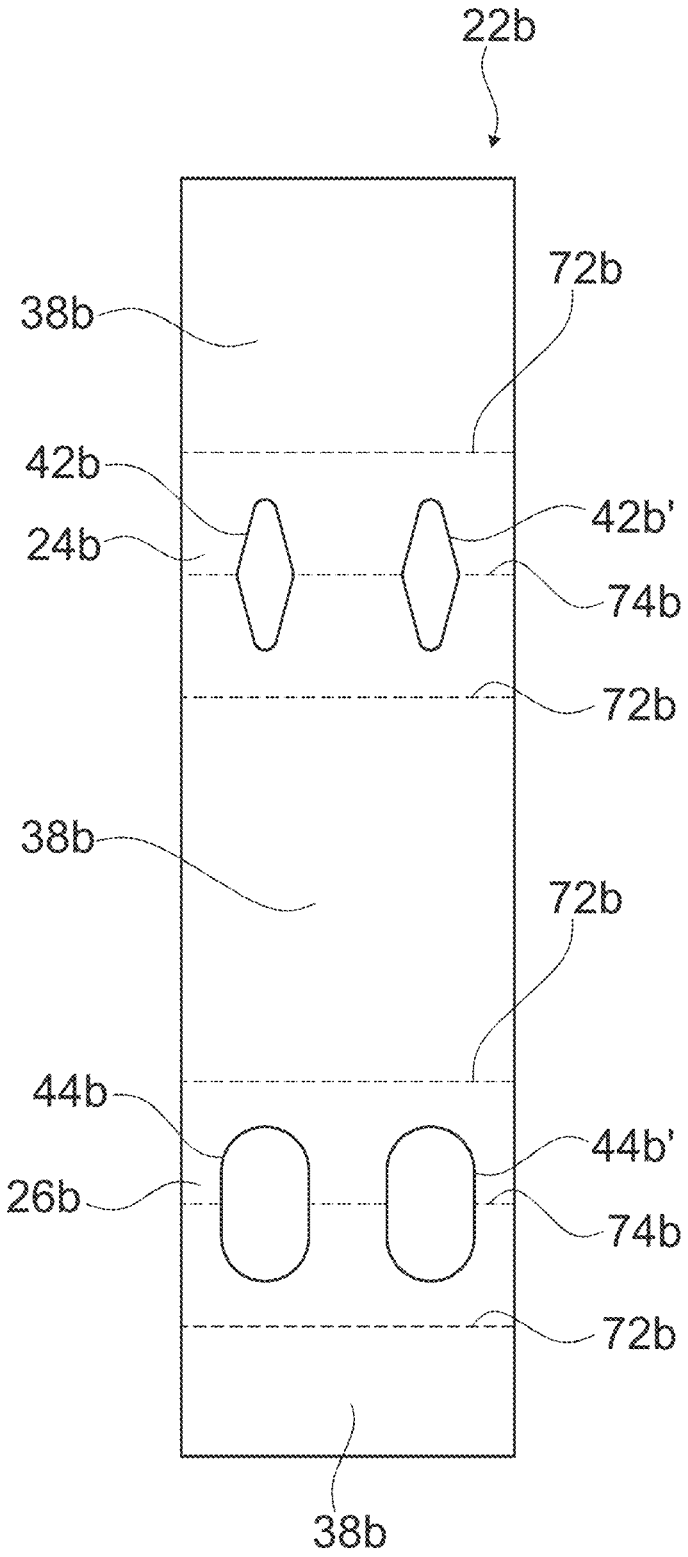
Figure 2B:
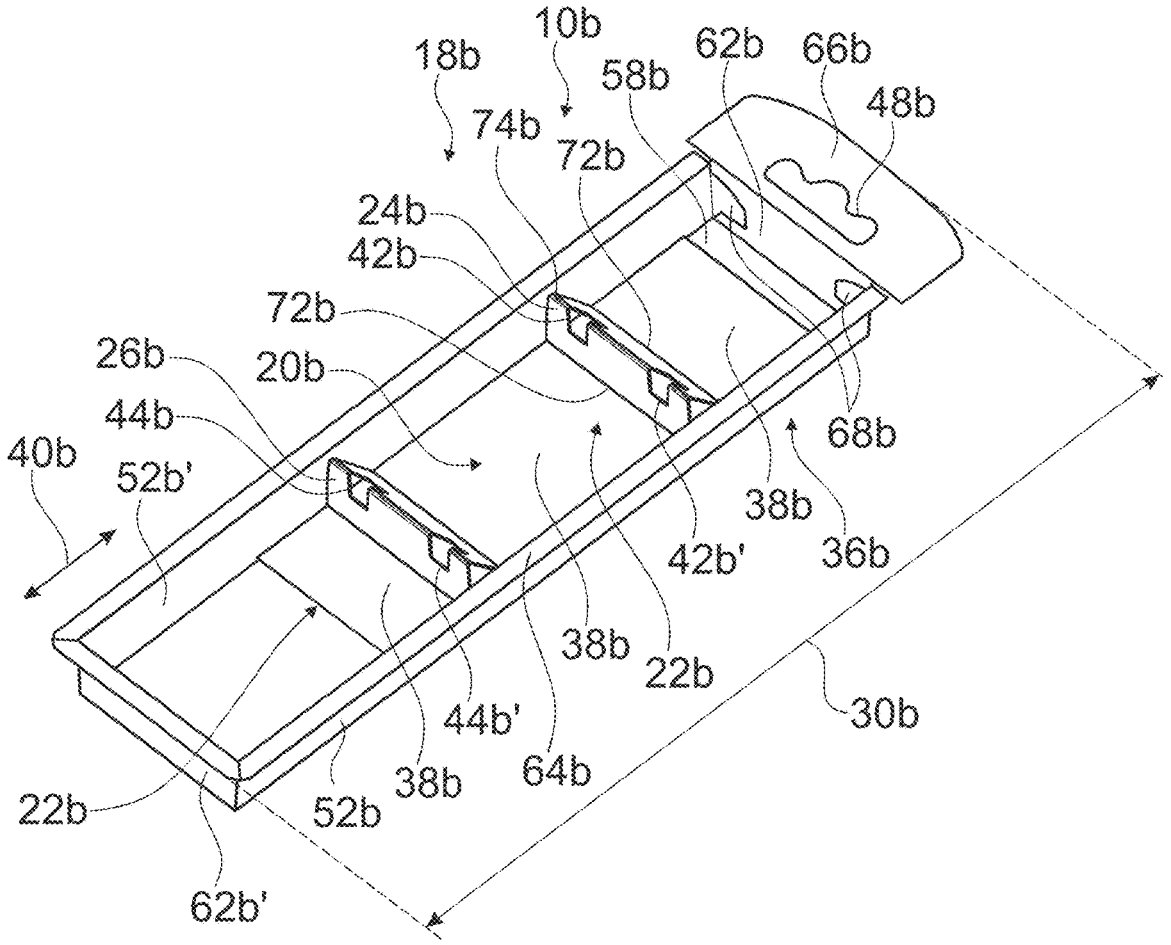
Figure 2C:
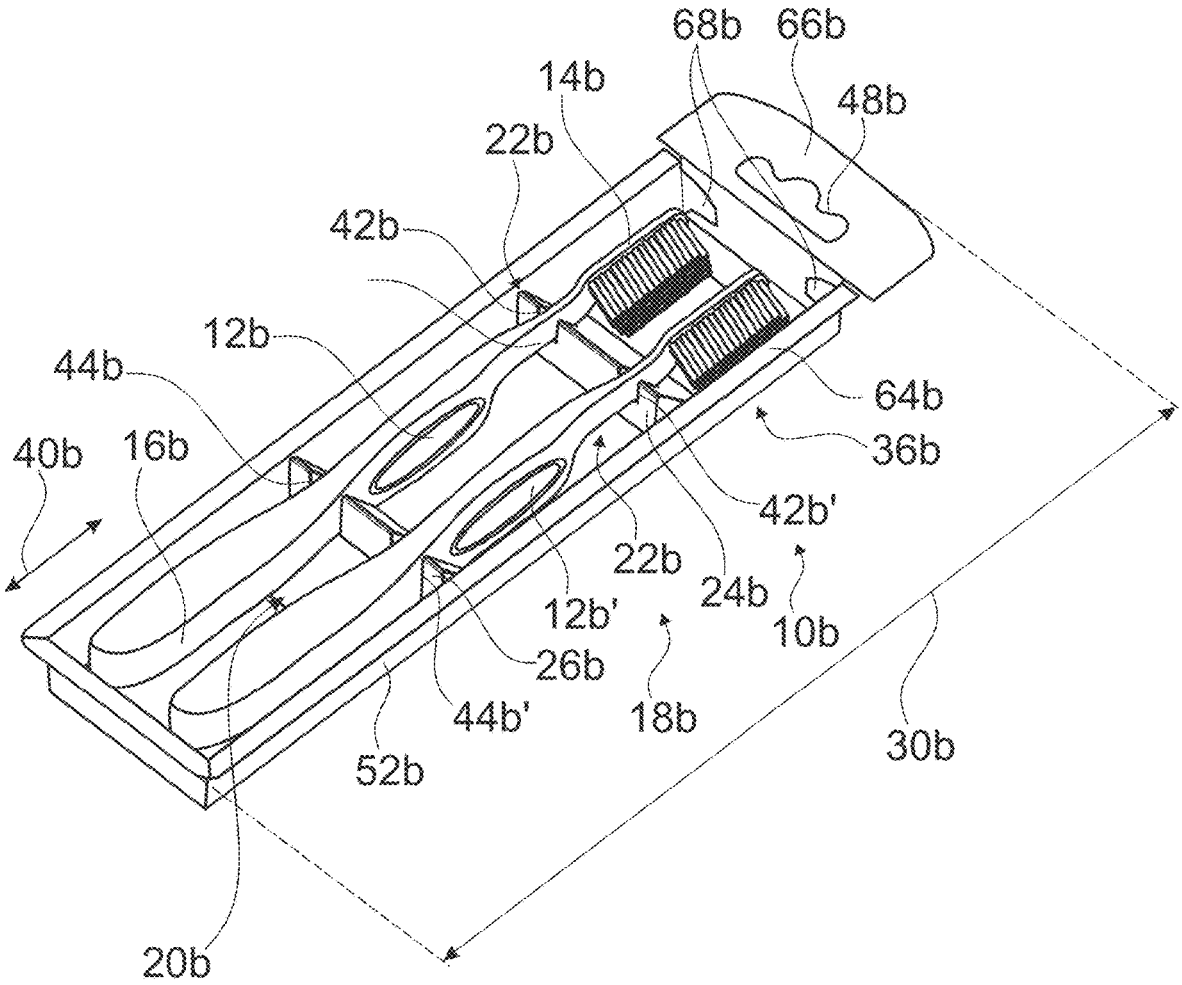
Figure 3A:
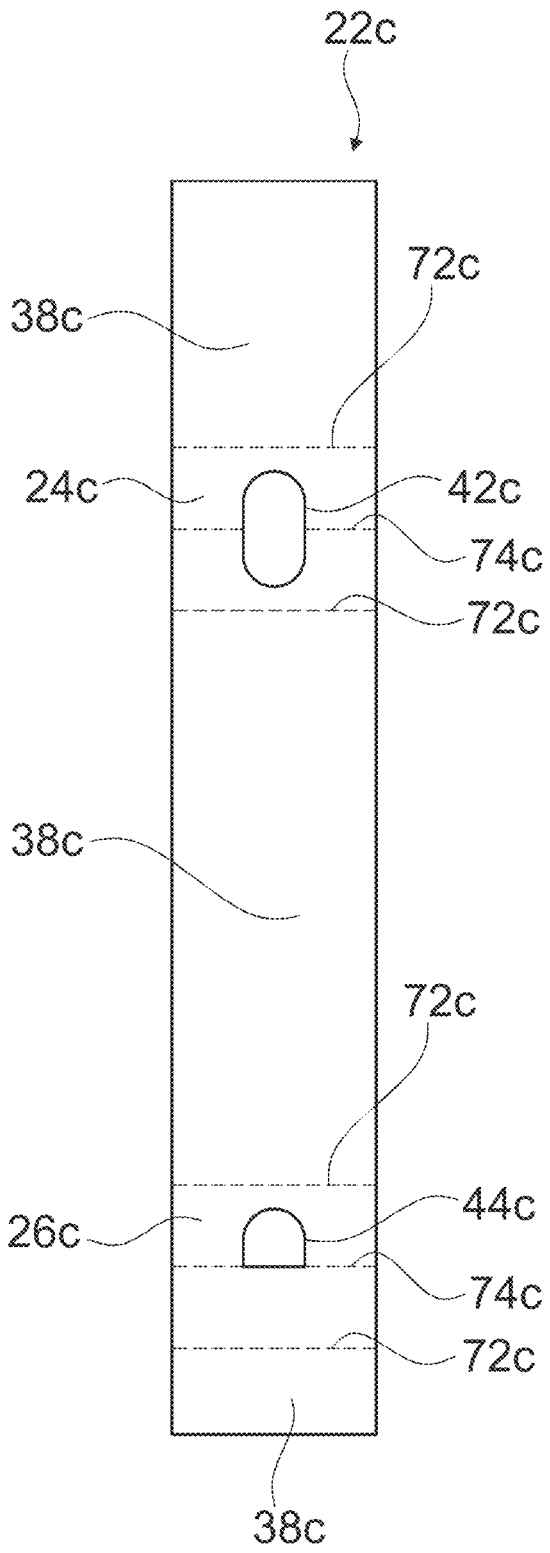
Figure 3B:
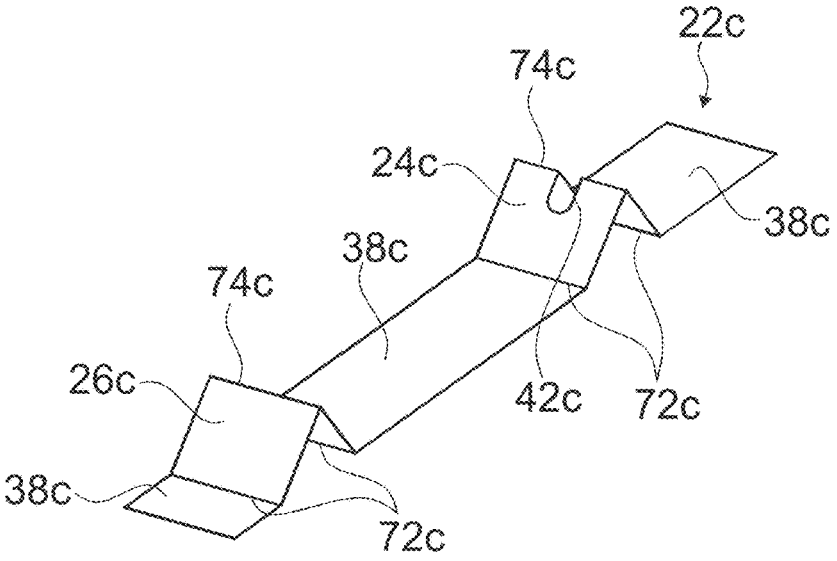
Figure 3C:
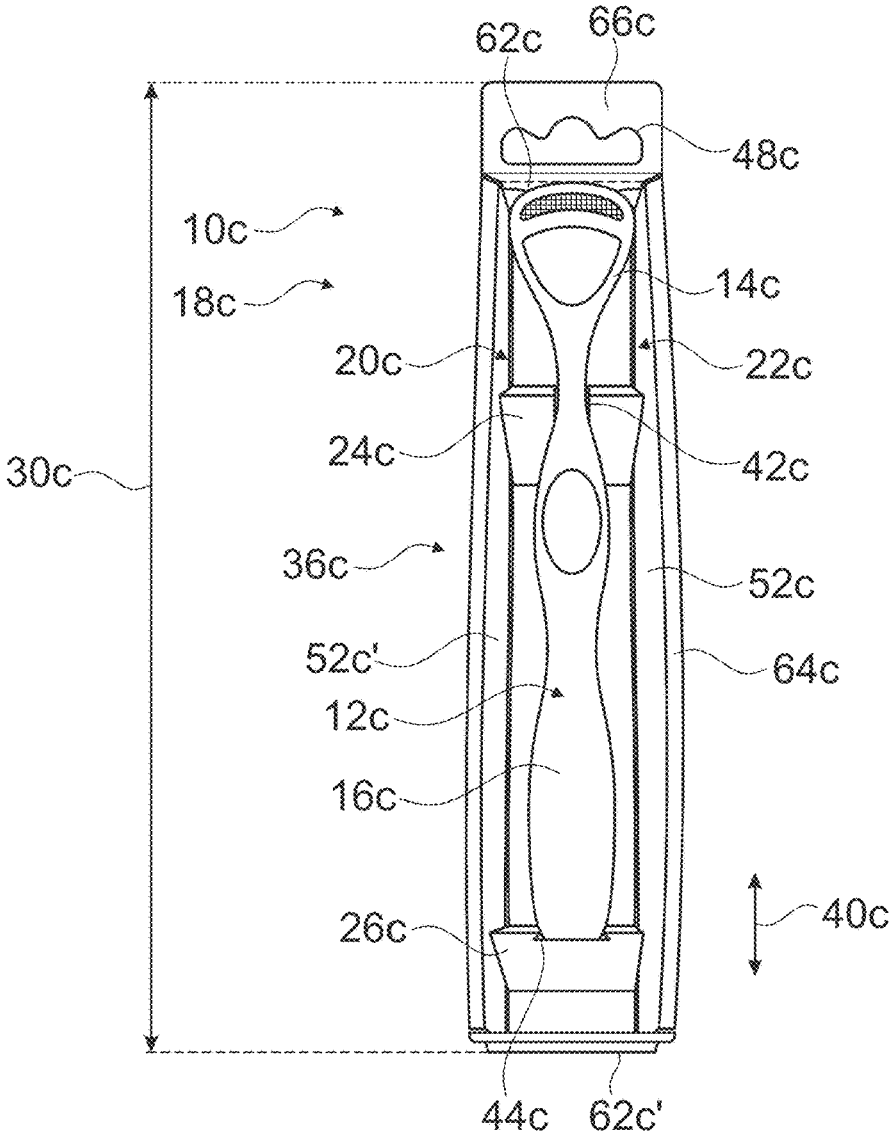
Figure 4A:
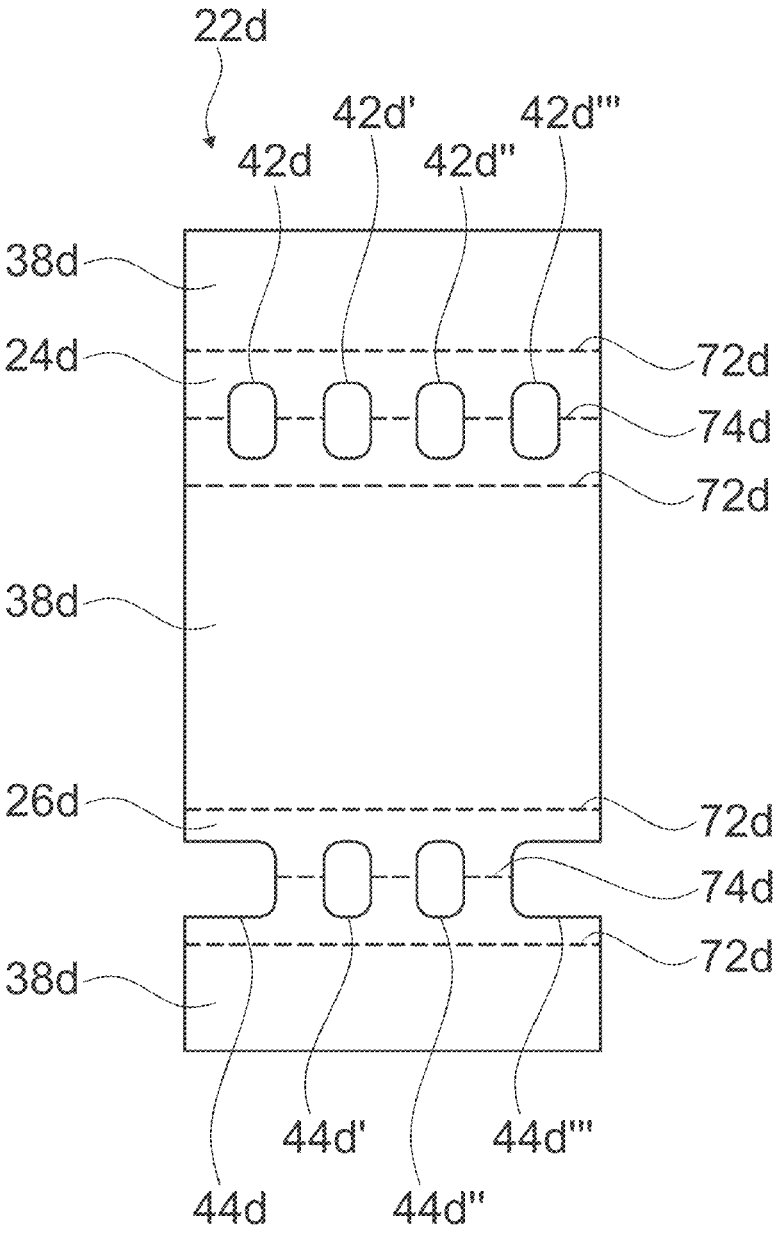
Figure 4B:
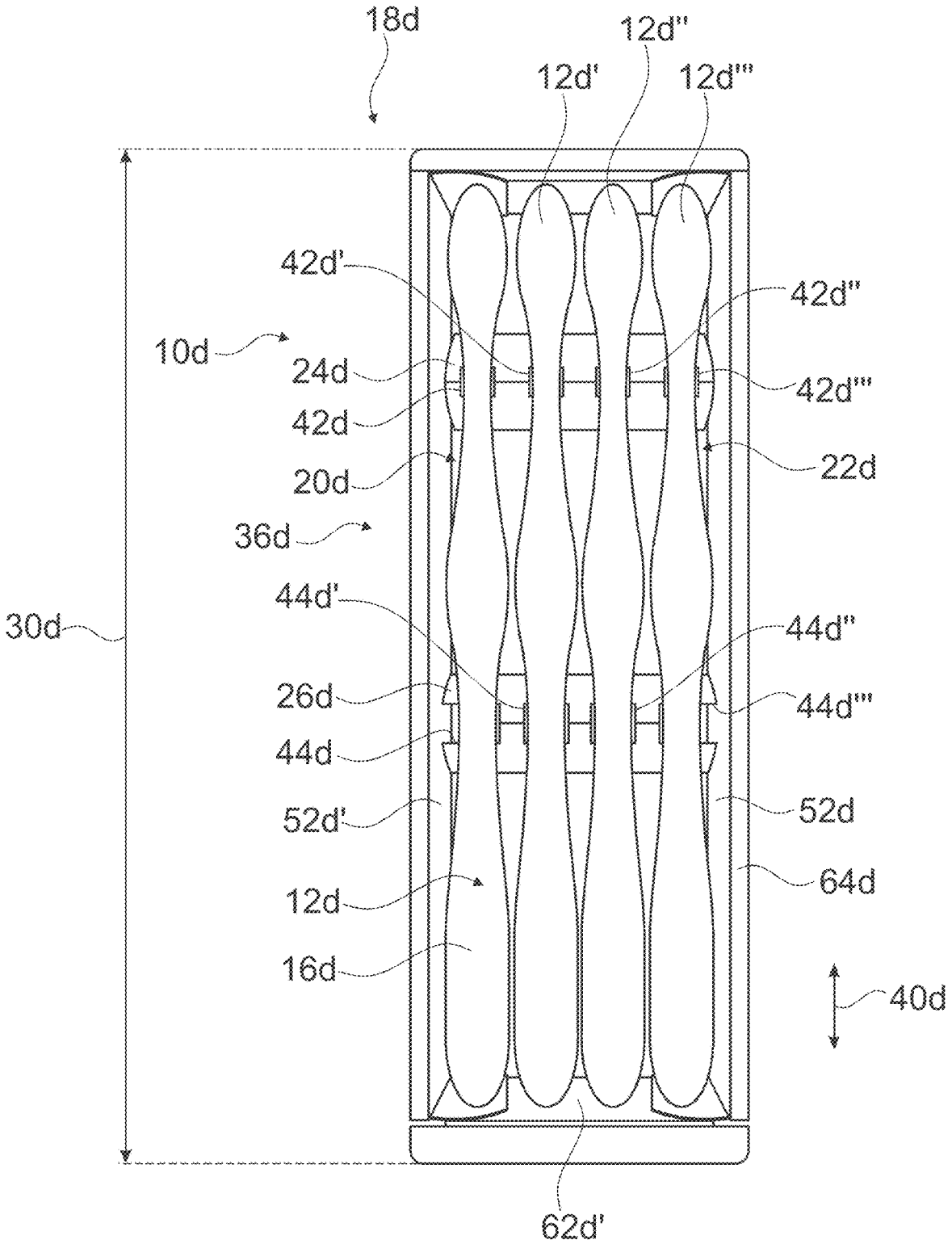
Figure 5A:
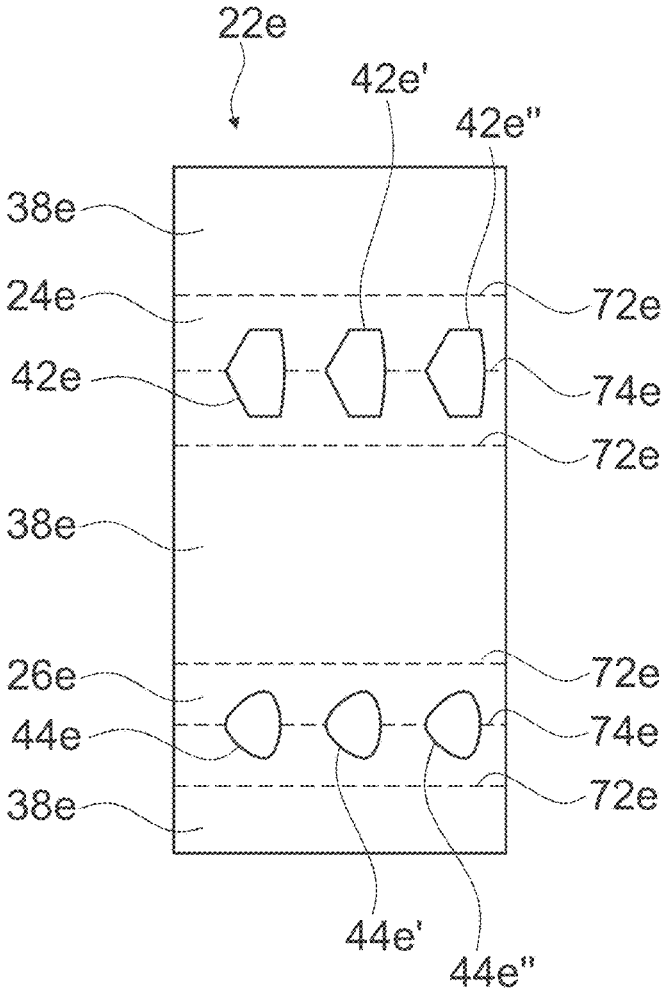
Figure 5B:
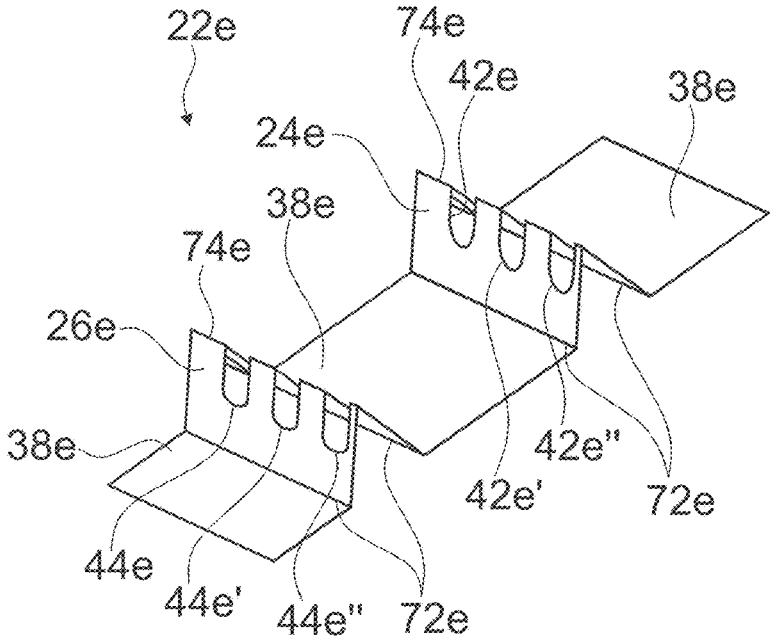
Figure 5C:
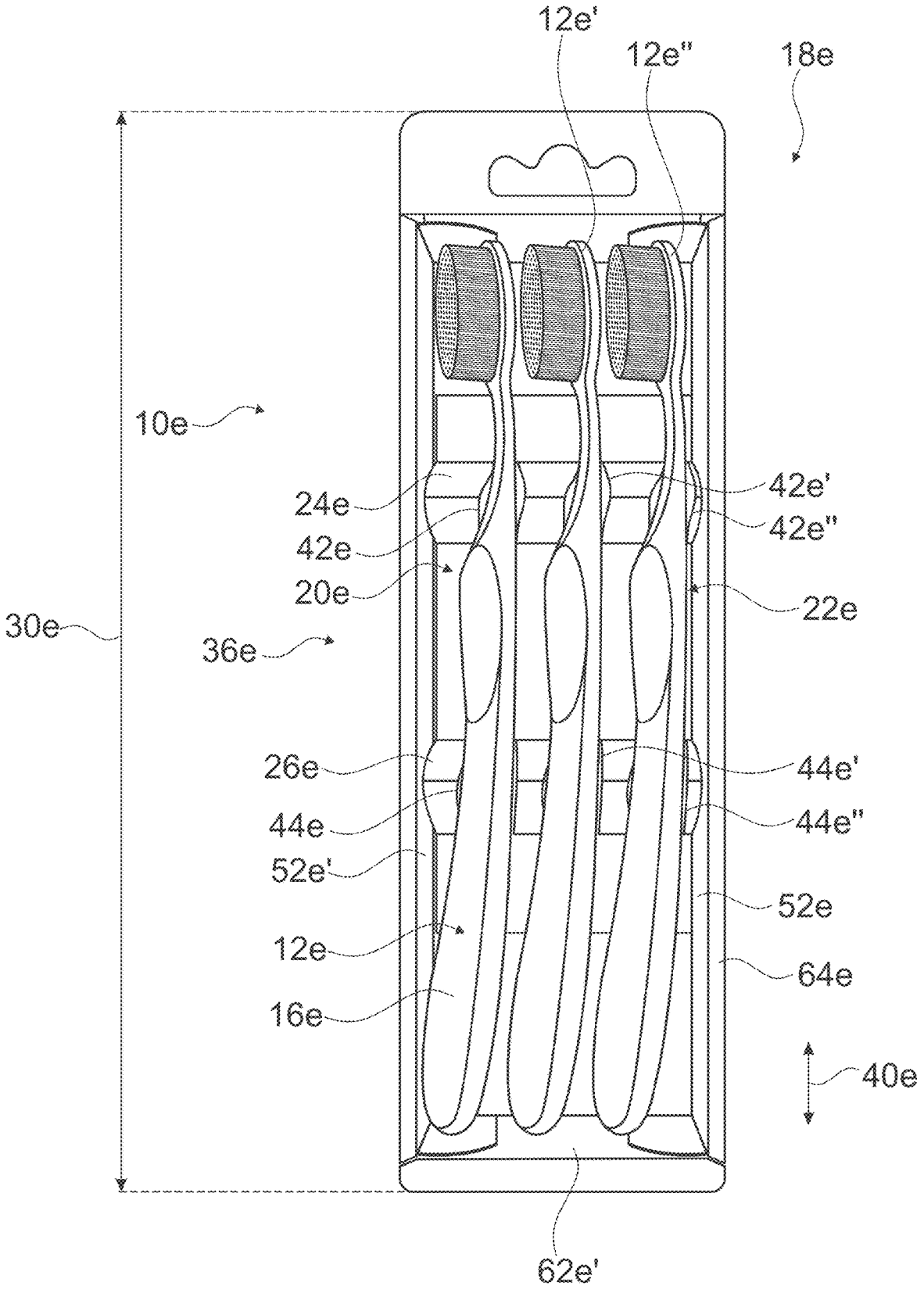
Figure 6A:
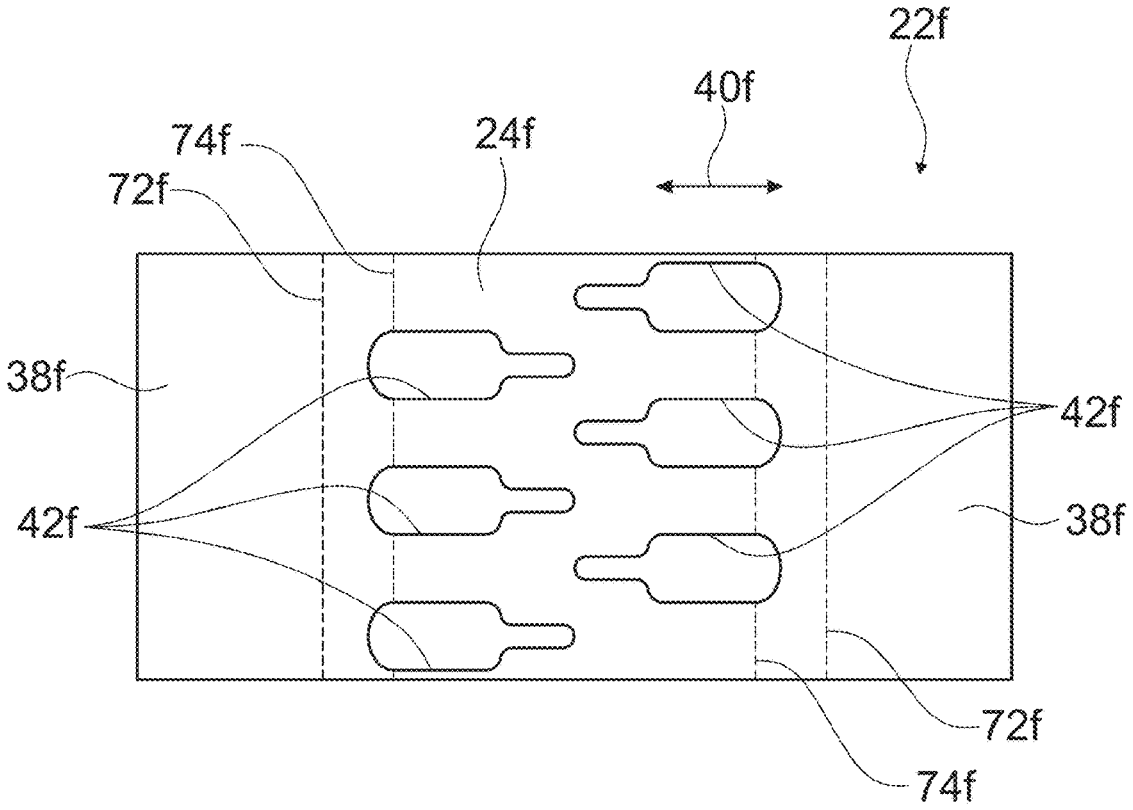
Figure 6B:
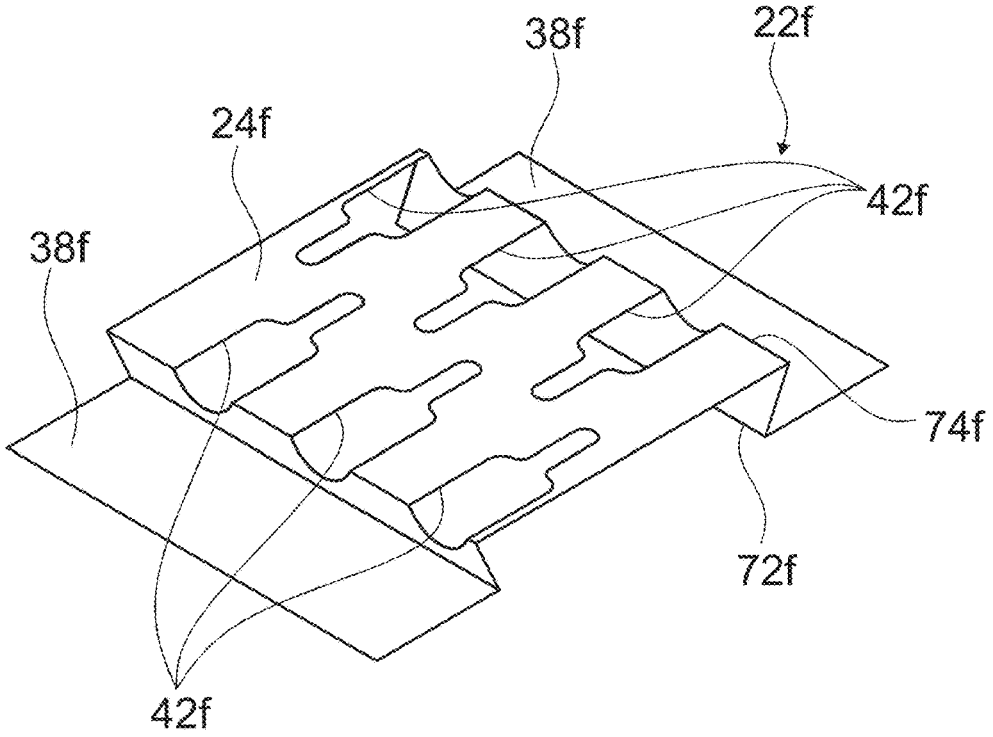
Figure 6C:
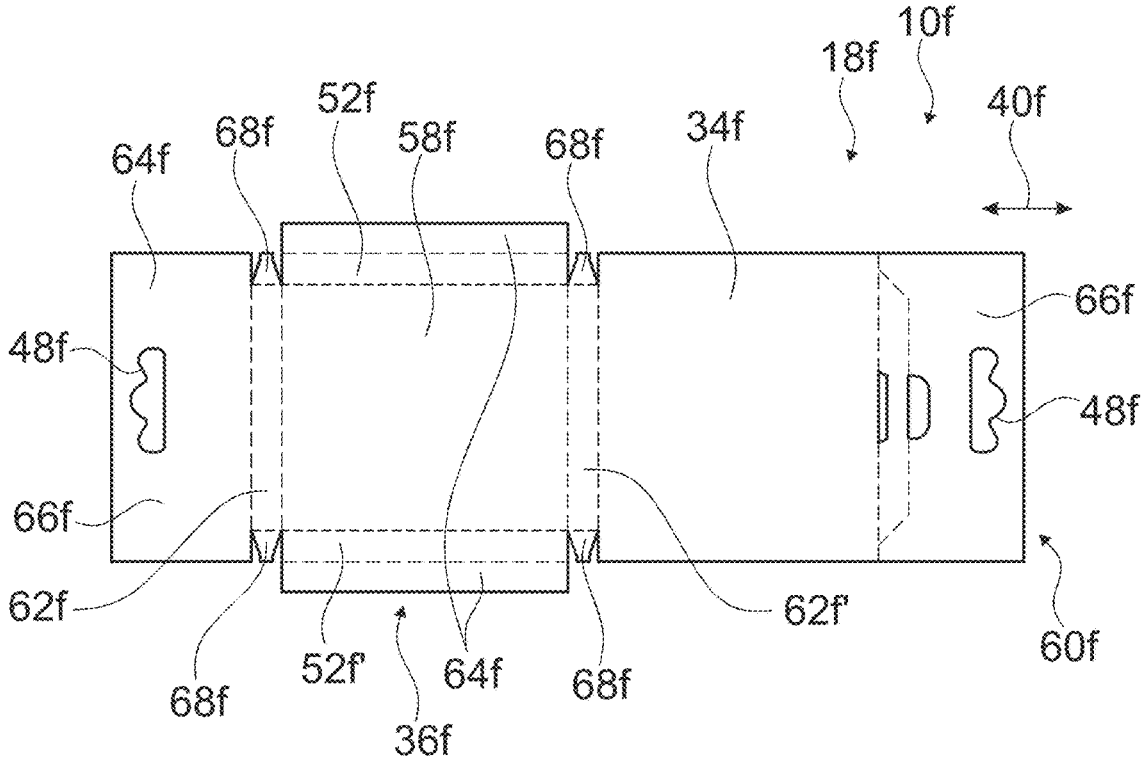
Figure 7:
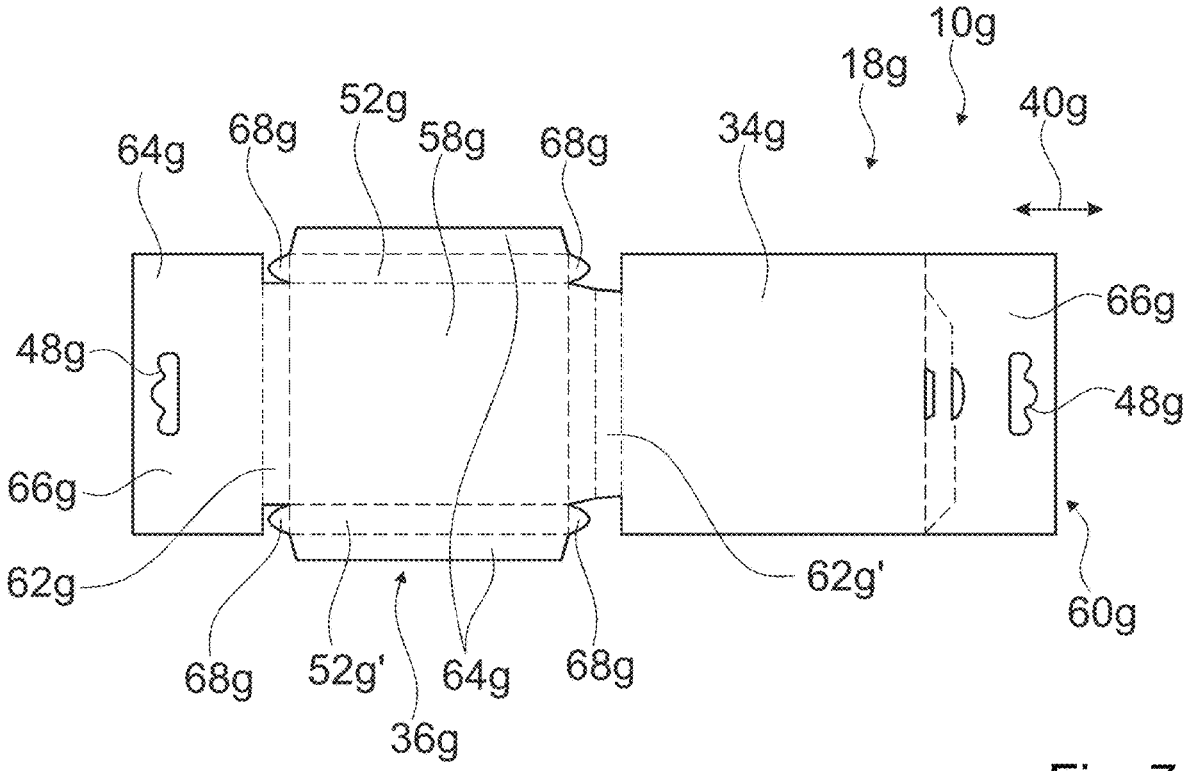
Figure 8:
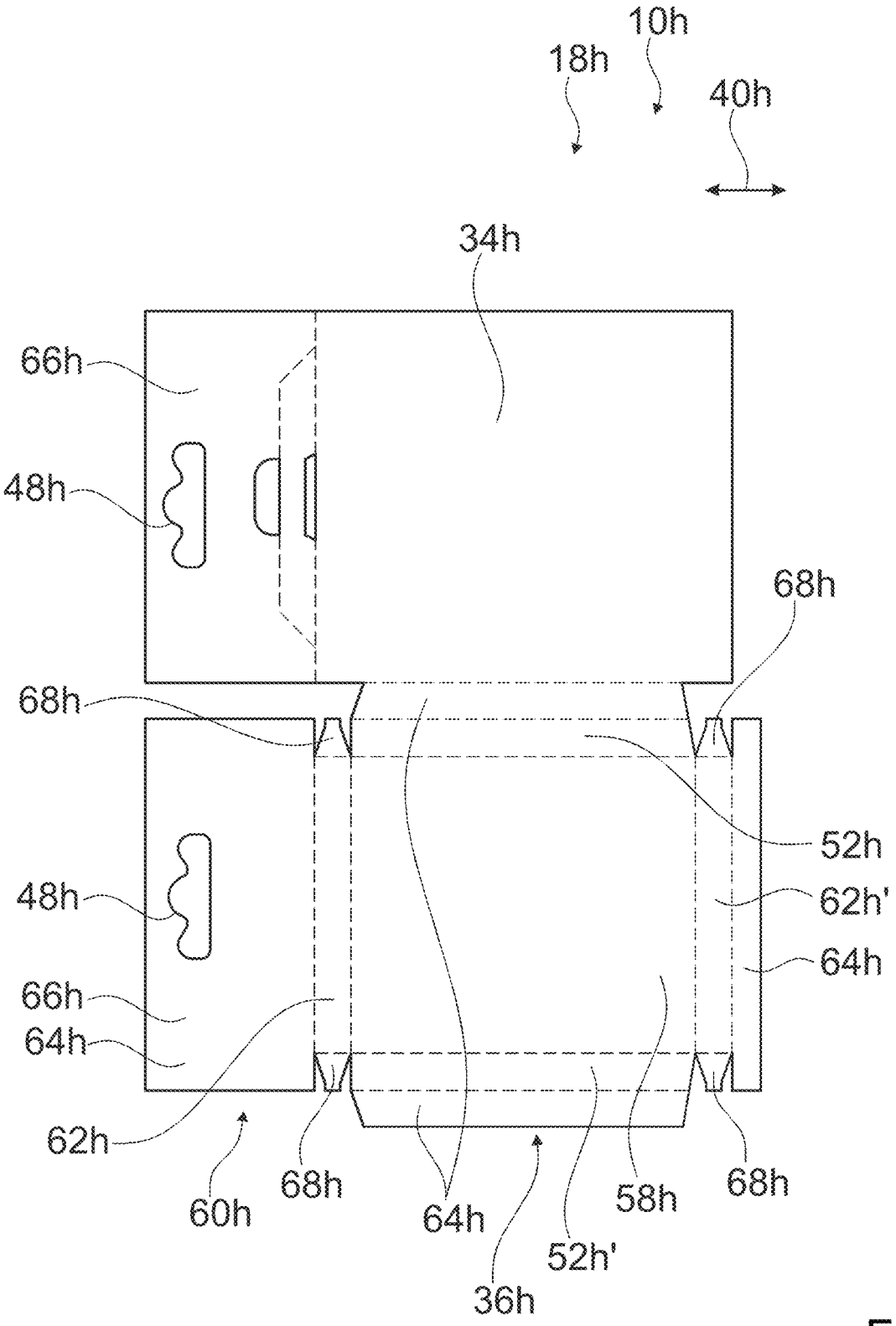
Figure 9:
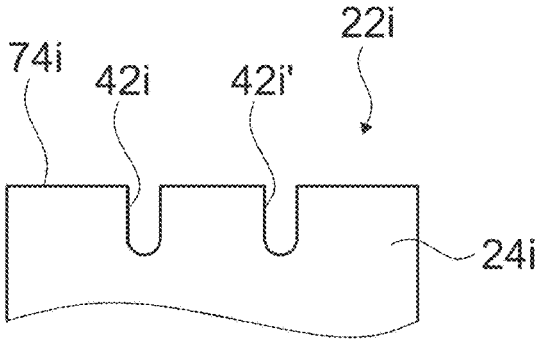
Figure 10:
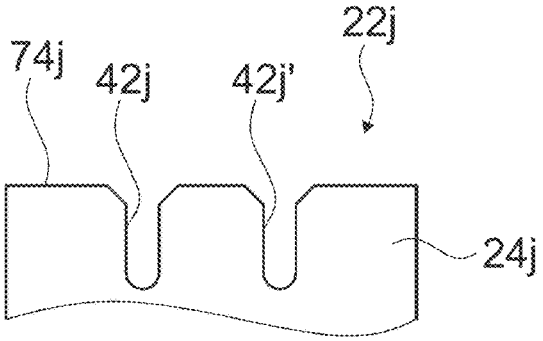
Figure 11A:
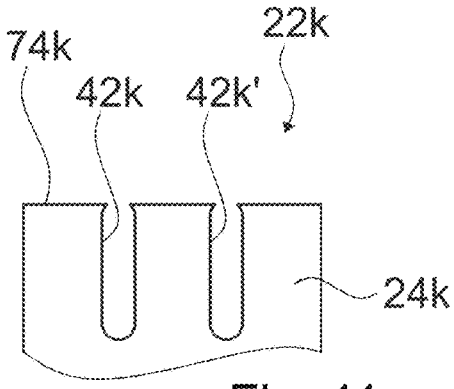
Figure 11B:
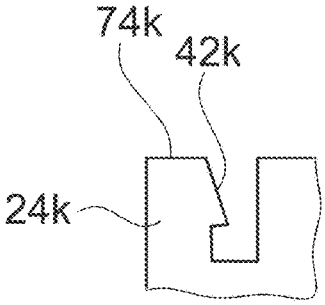
Figure 11C:
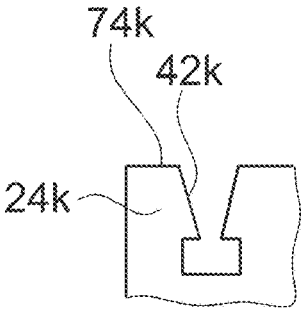
Figure 11D:
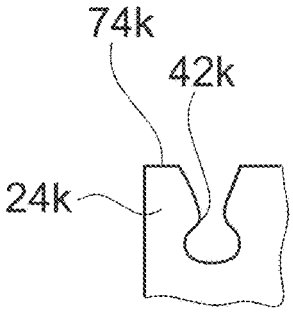
Figure 12:
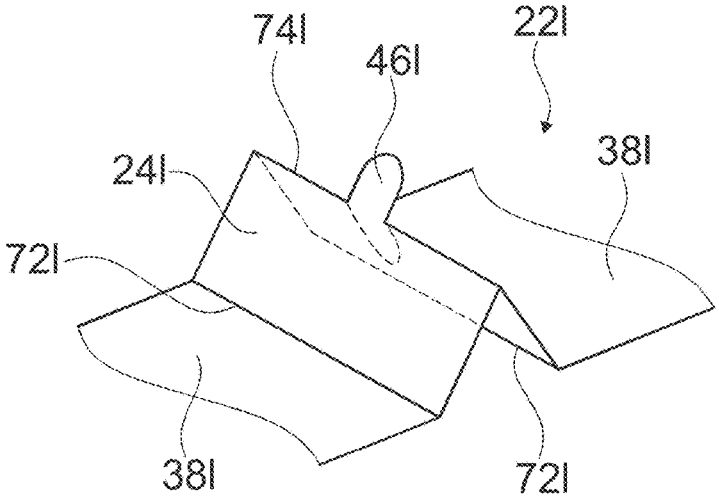
Figure 13A:
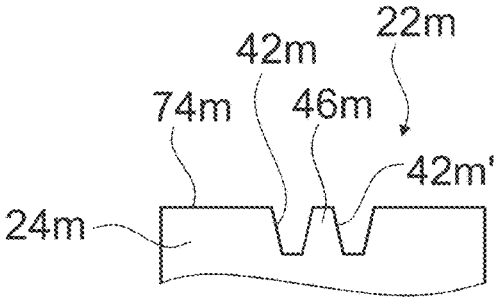
Figure 13B:
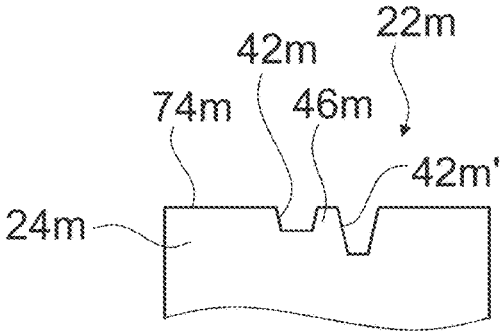
Figure 14:
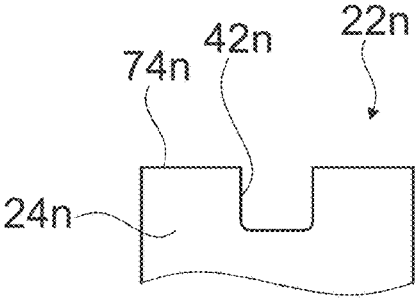
Figure 15:
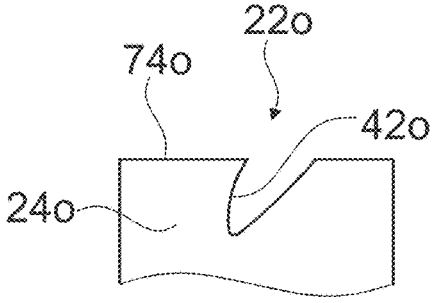
Figure 16:
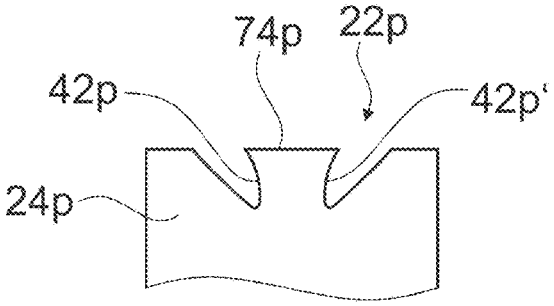
Figure 17A:
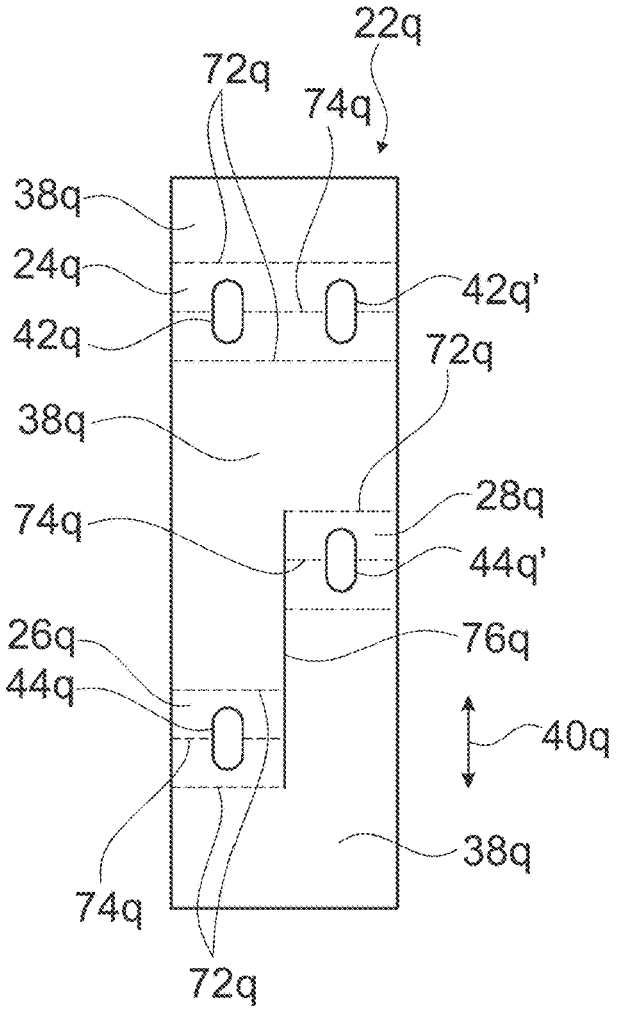
Figure 17B:
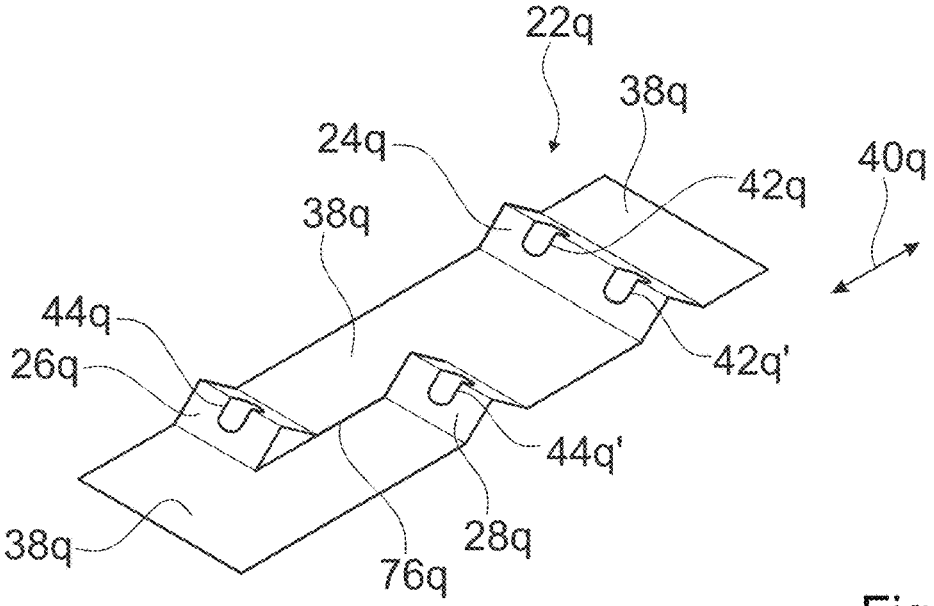
Figure 17C:
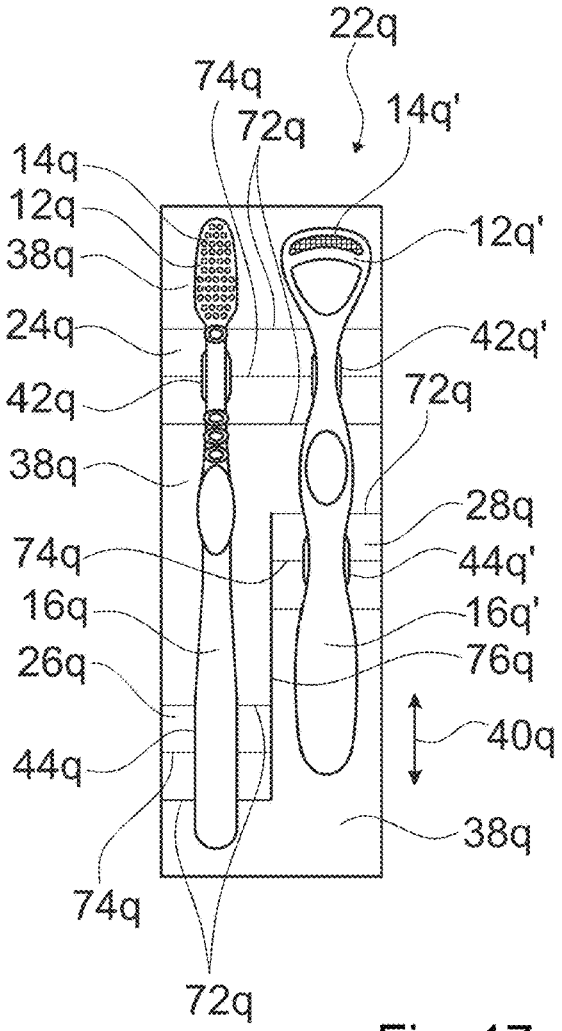
Figure 18:
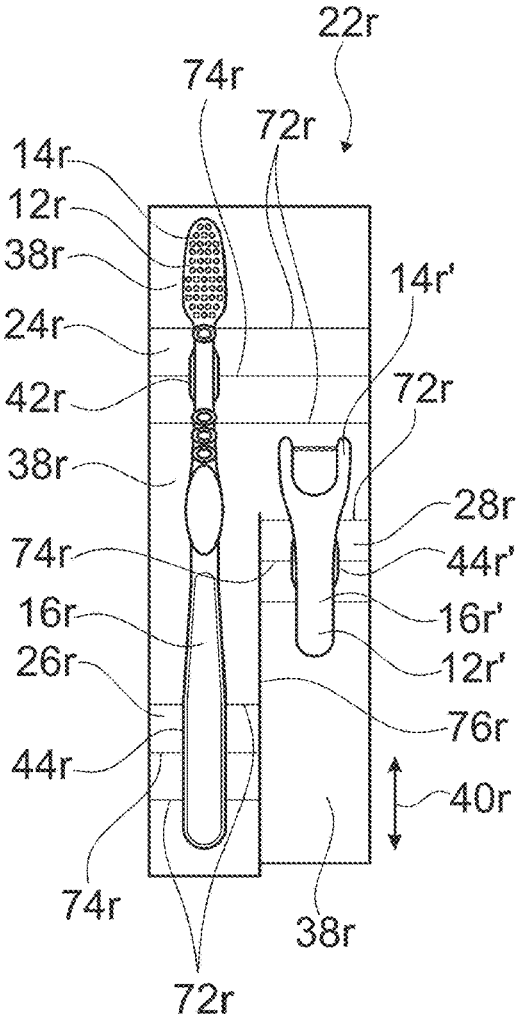
Figure 19:
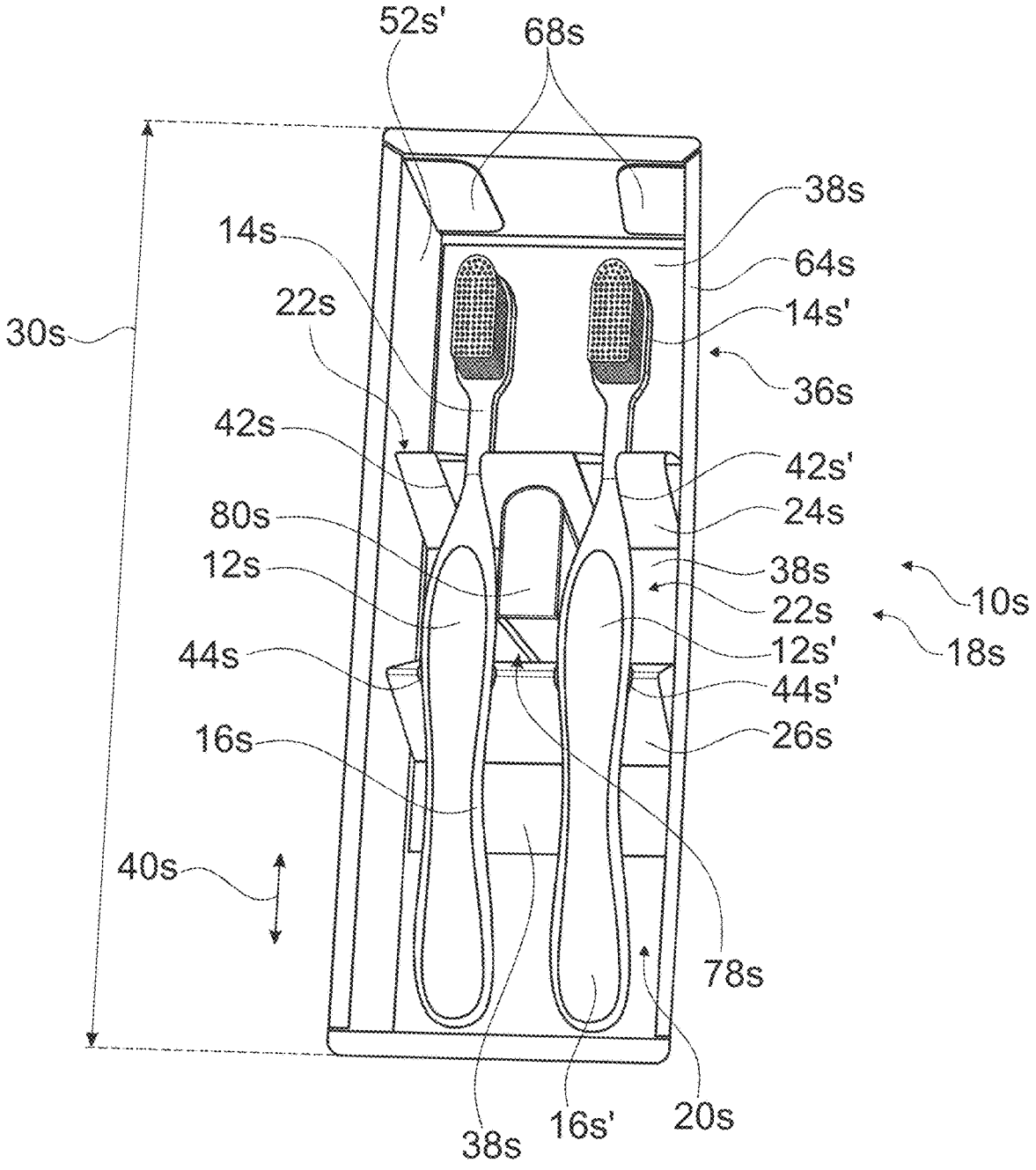
Figure 20A:
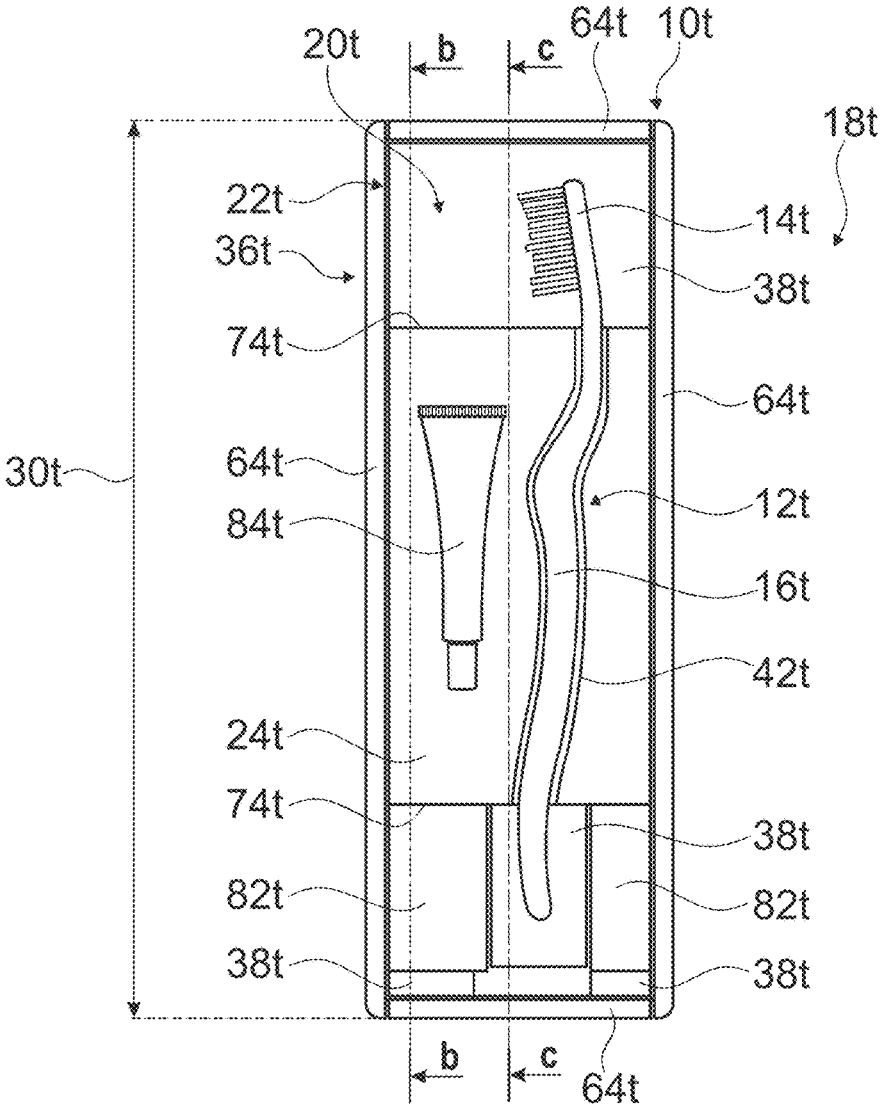
Figure 20B:
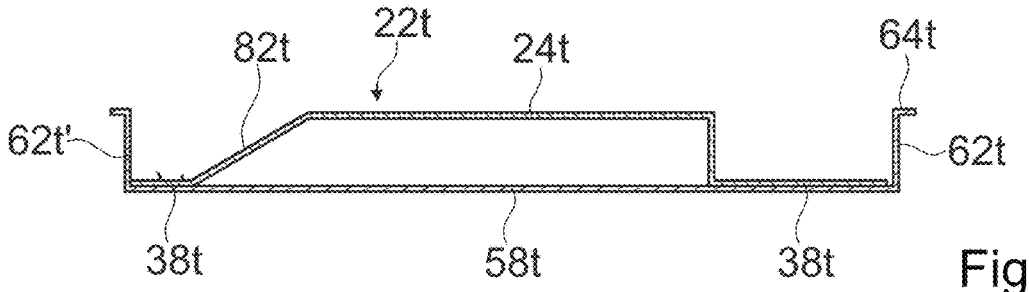
Figure 20C:
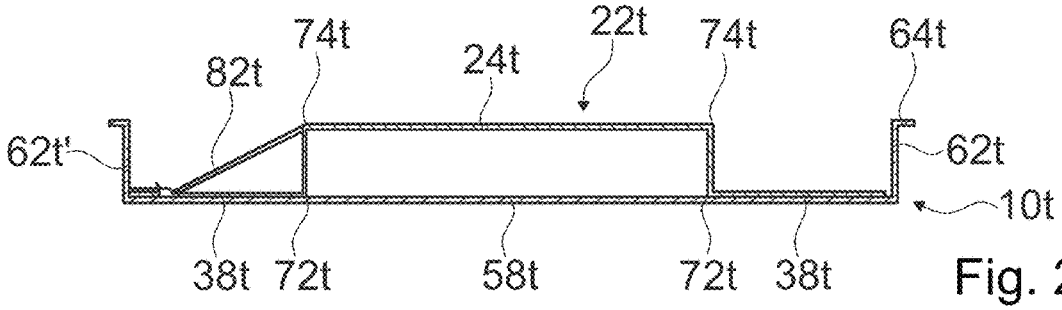
Figure 21:
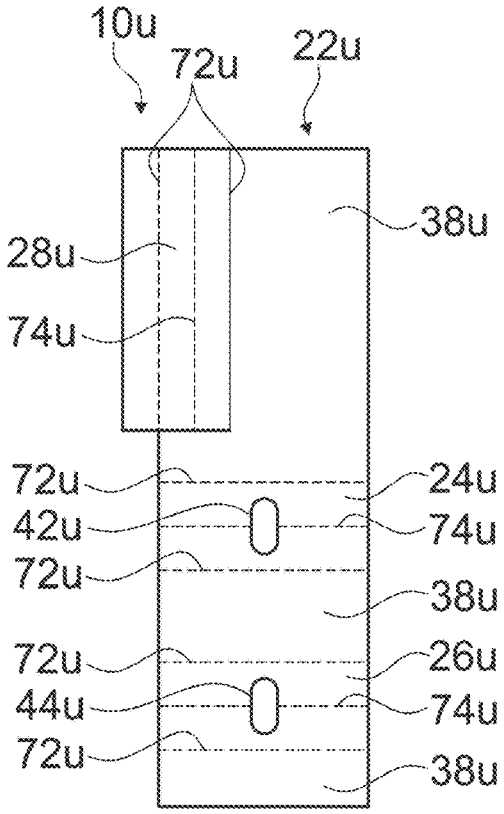
Figure 22:
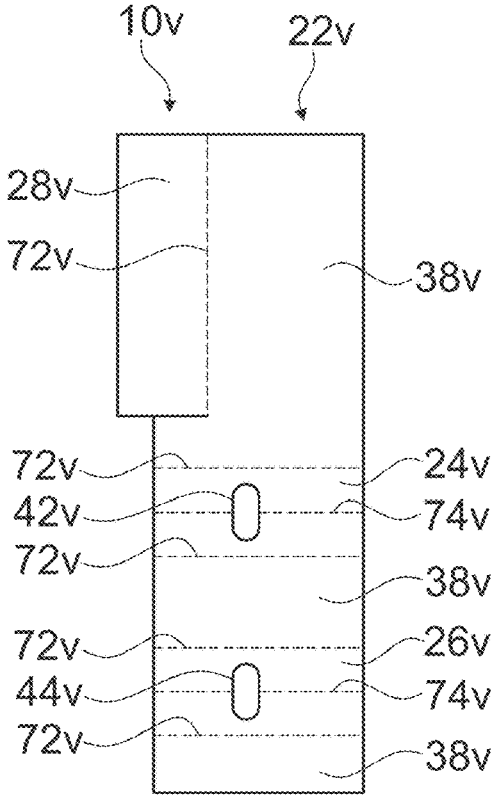
Figure 23:
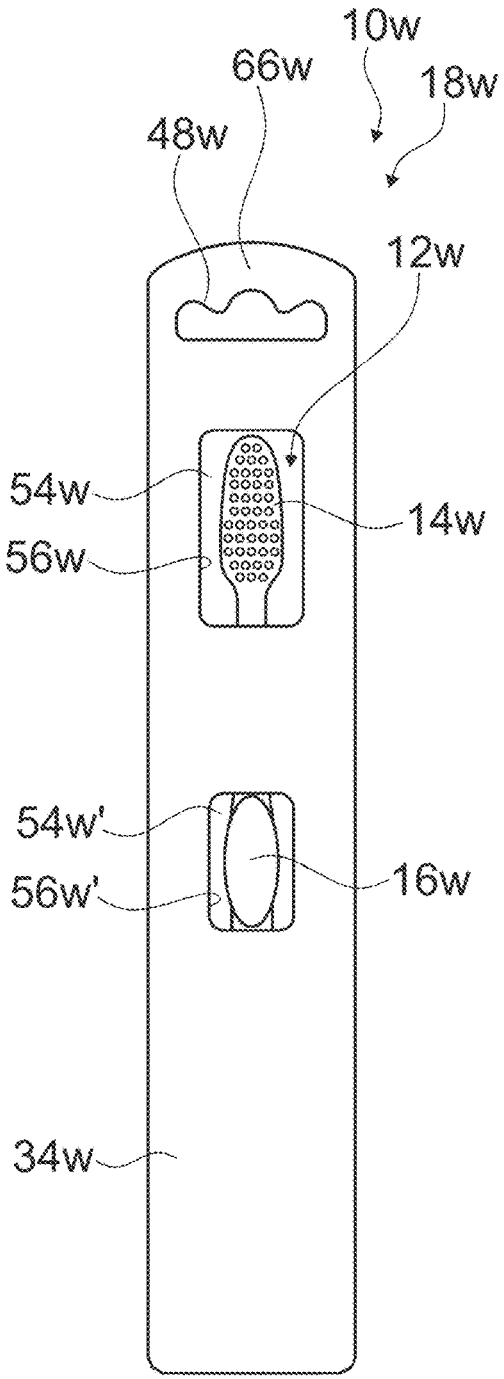
Figure 24:
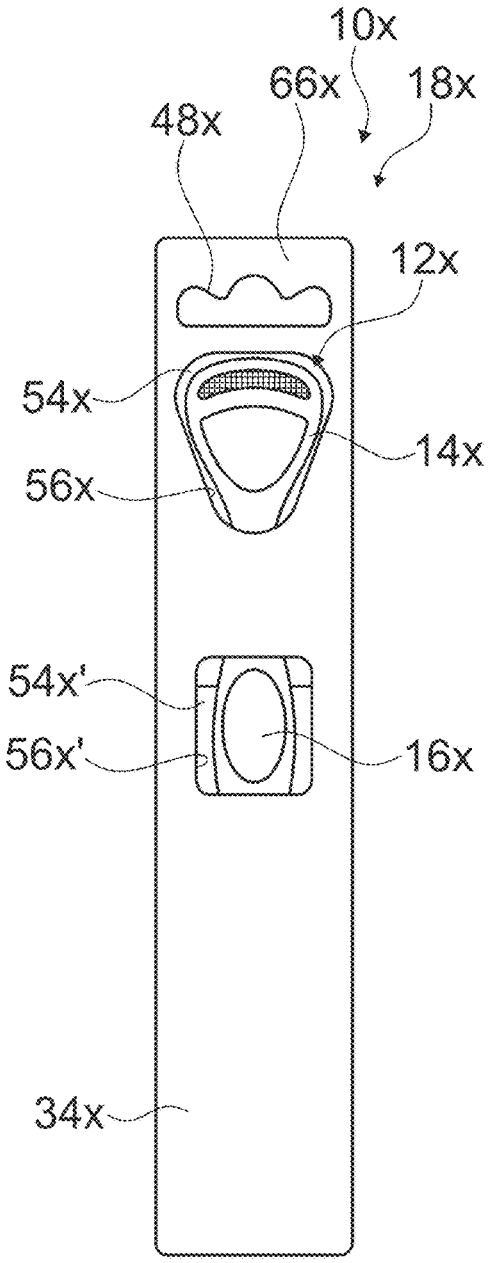
Figure 25:
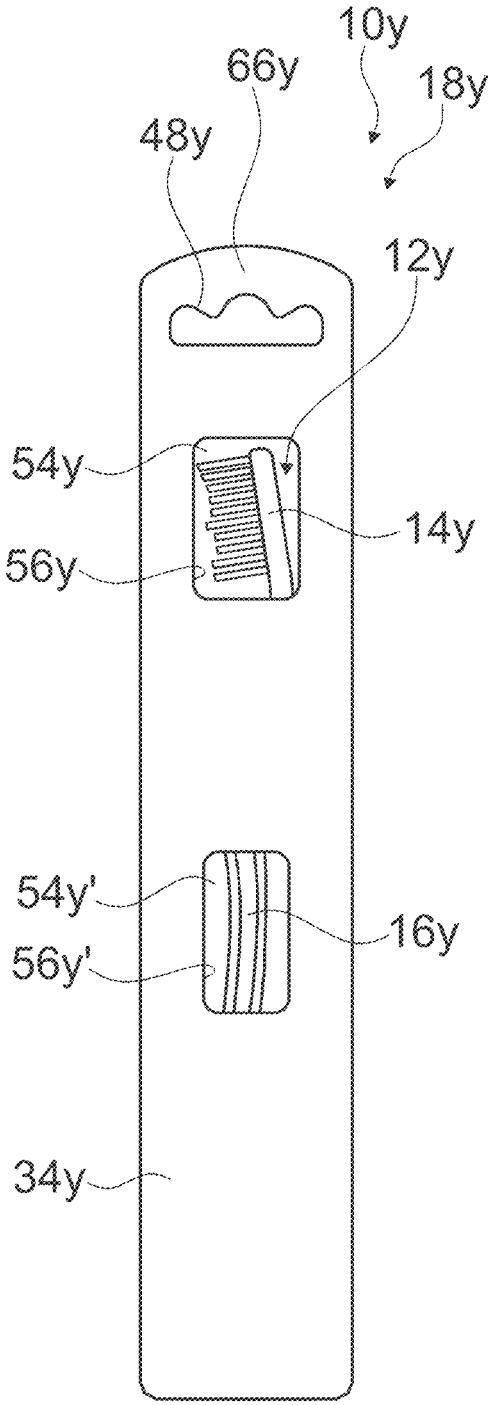
Figure 26:
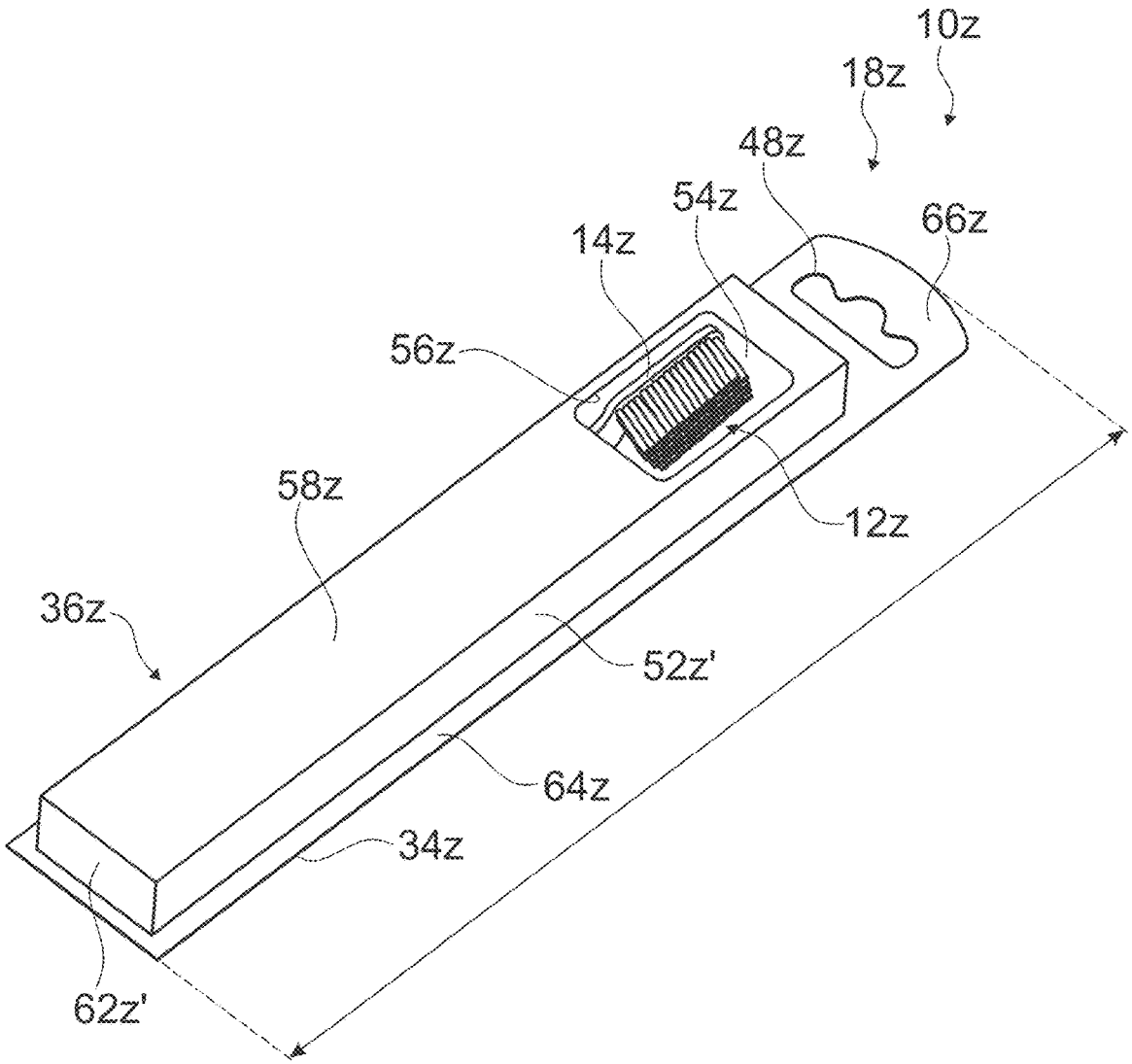
Figure 27A:
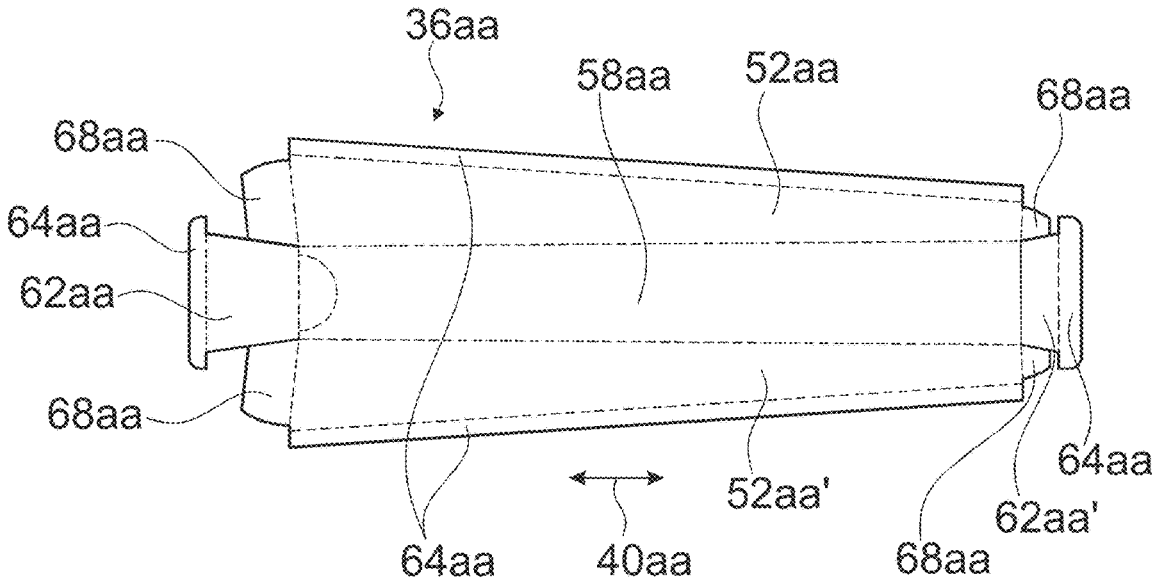
Figure 27B:
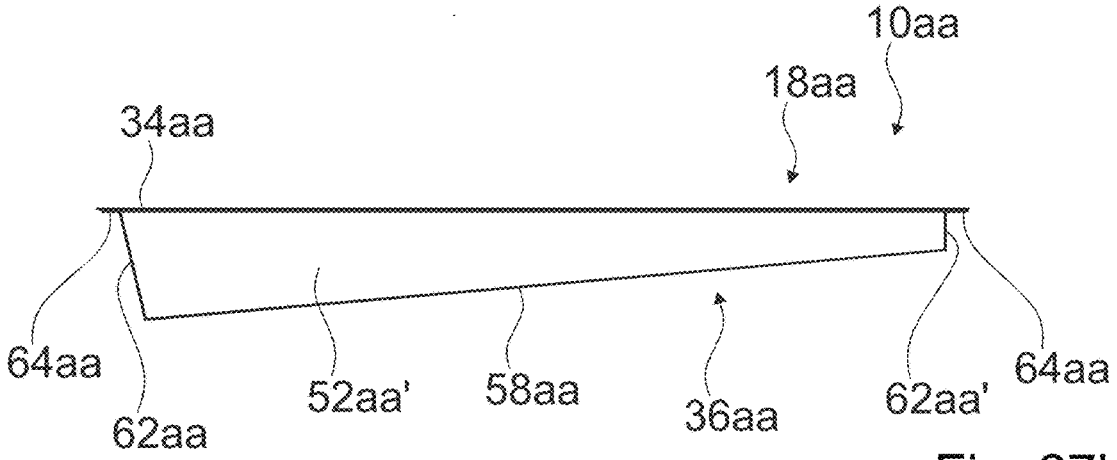
Figure 27C:
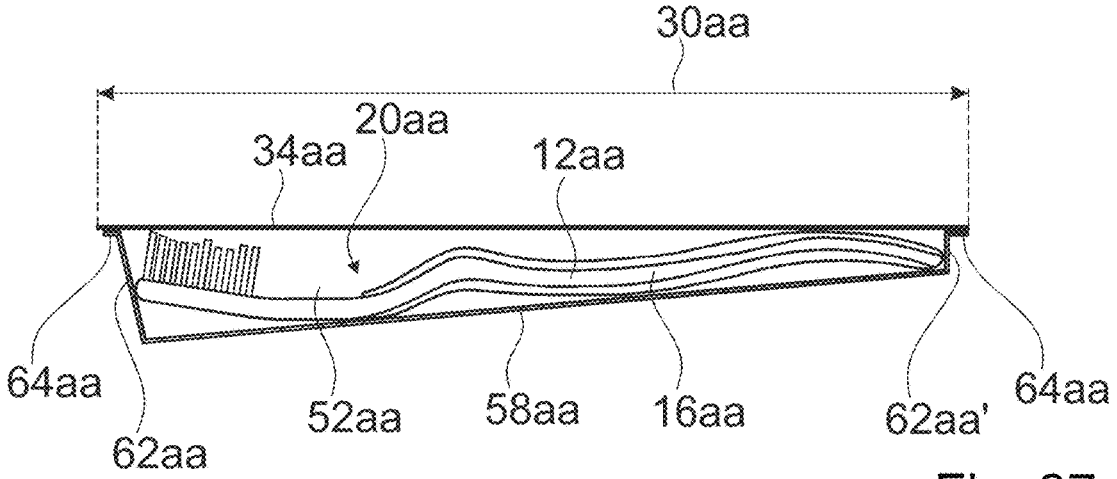
Figure 27D:
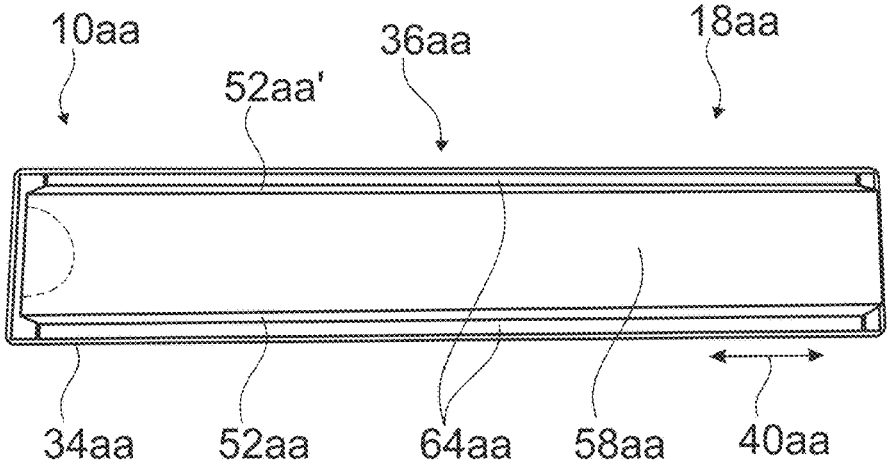
Figure 27E:
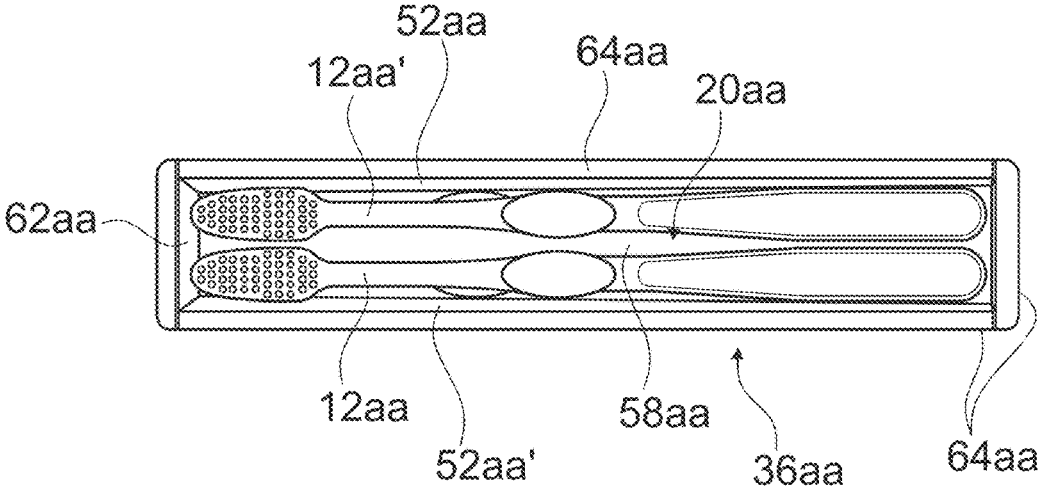
Figure 27F:
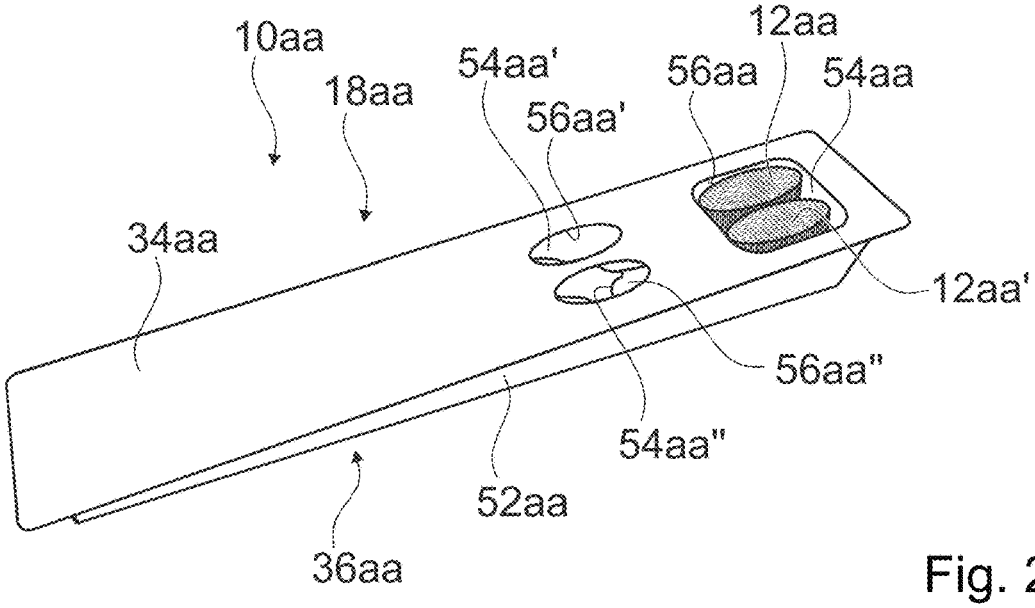
Figure 28A:
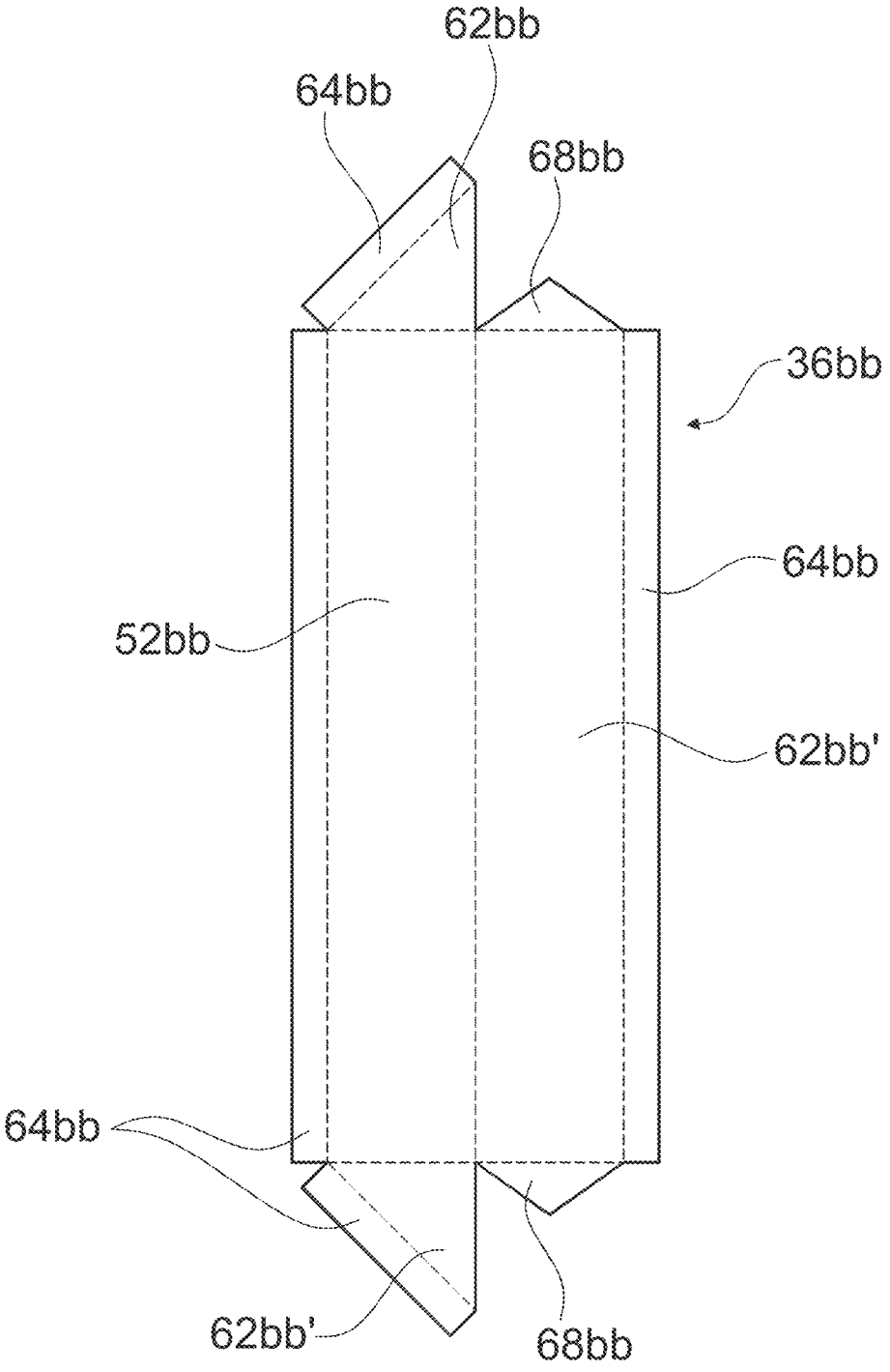
Figure 28B:
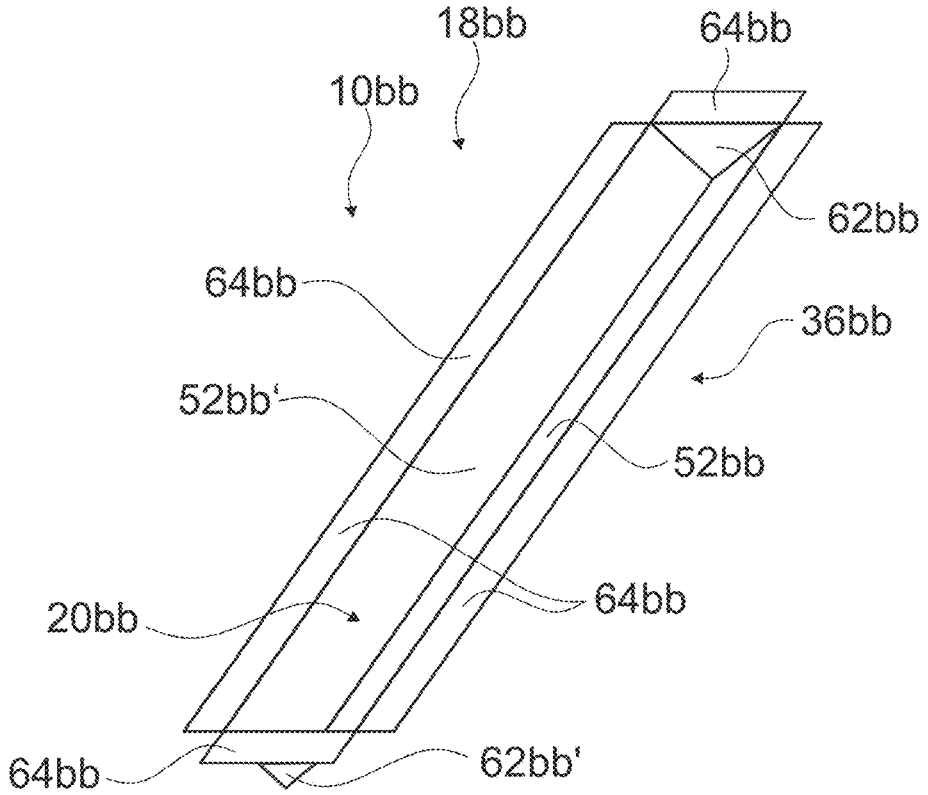
Figure 28C:
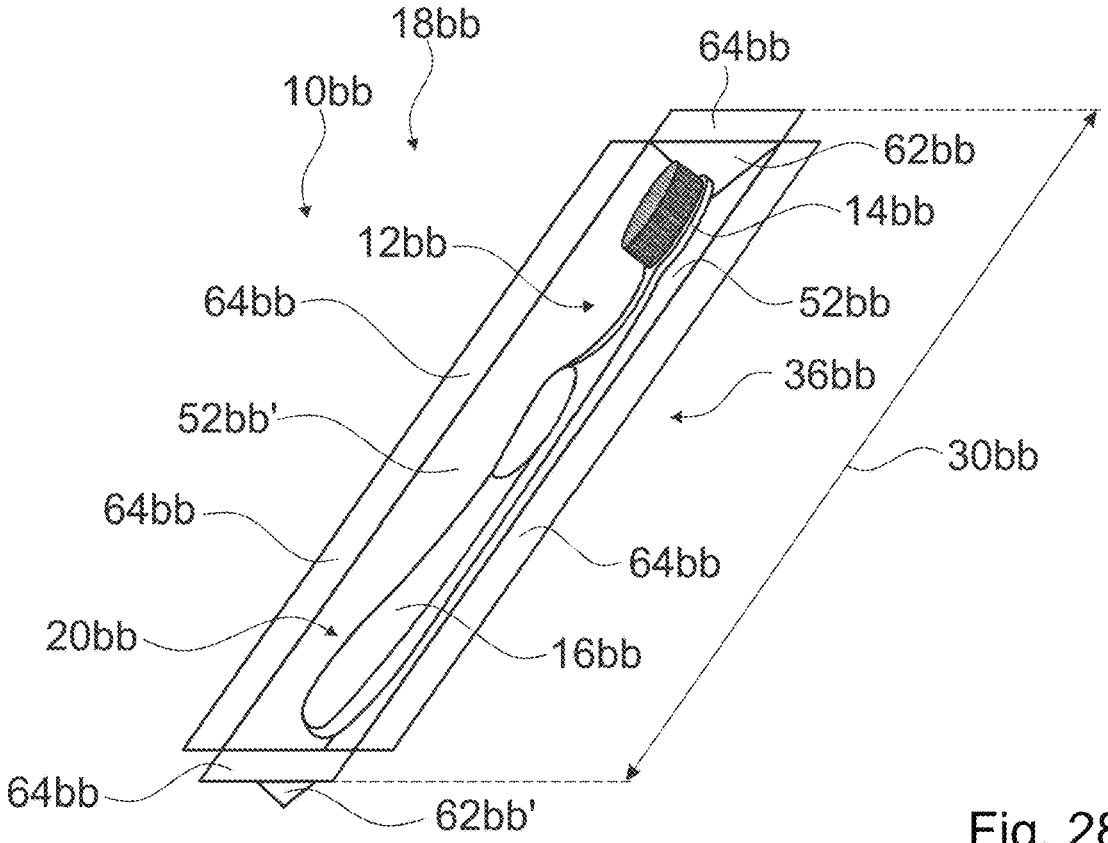
Figure 29A:
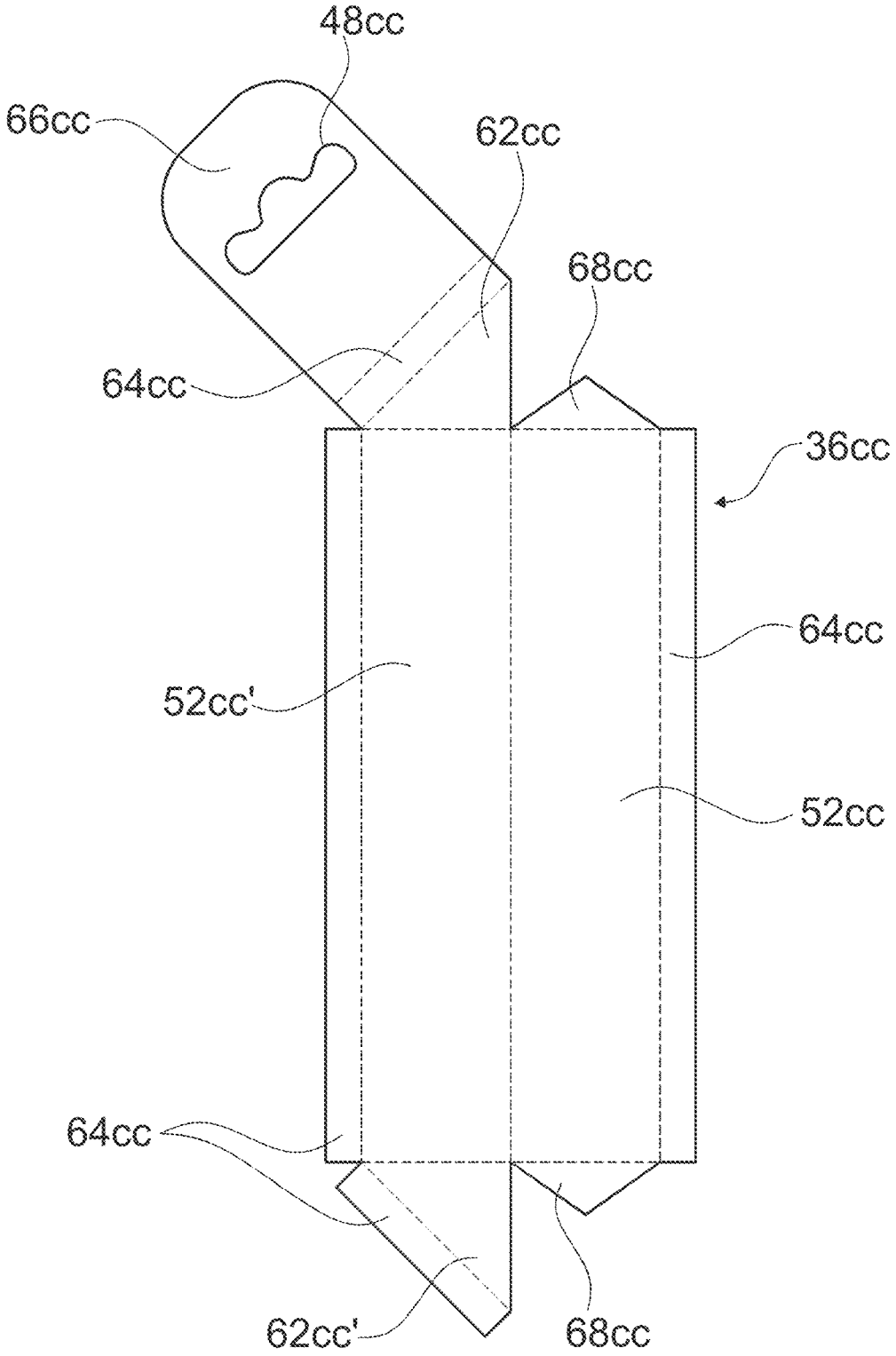
Figure 29B:
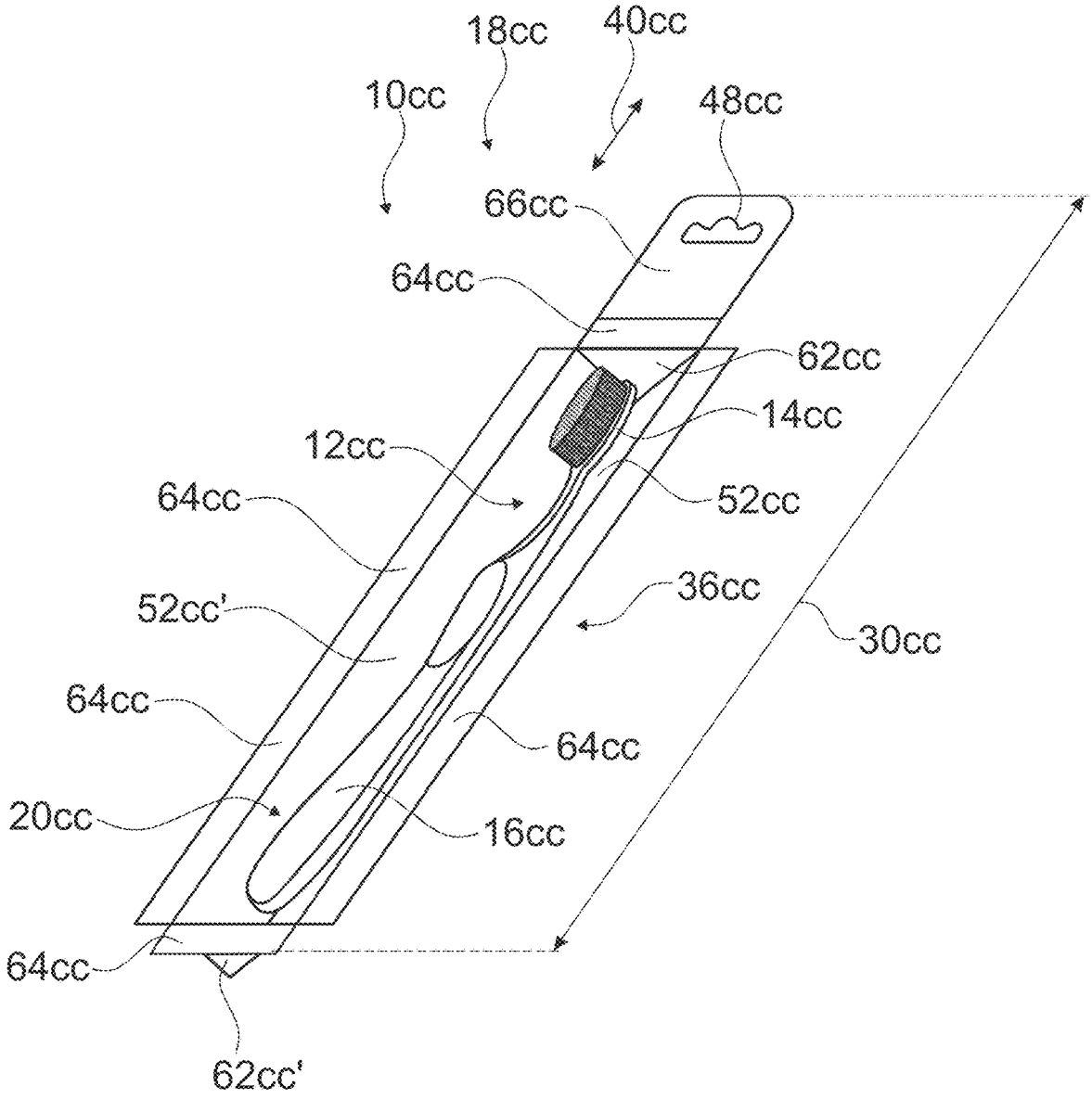
Figure 30A:
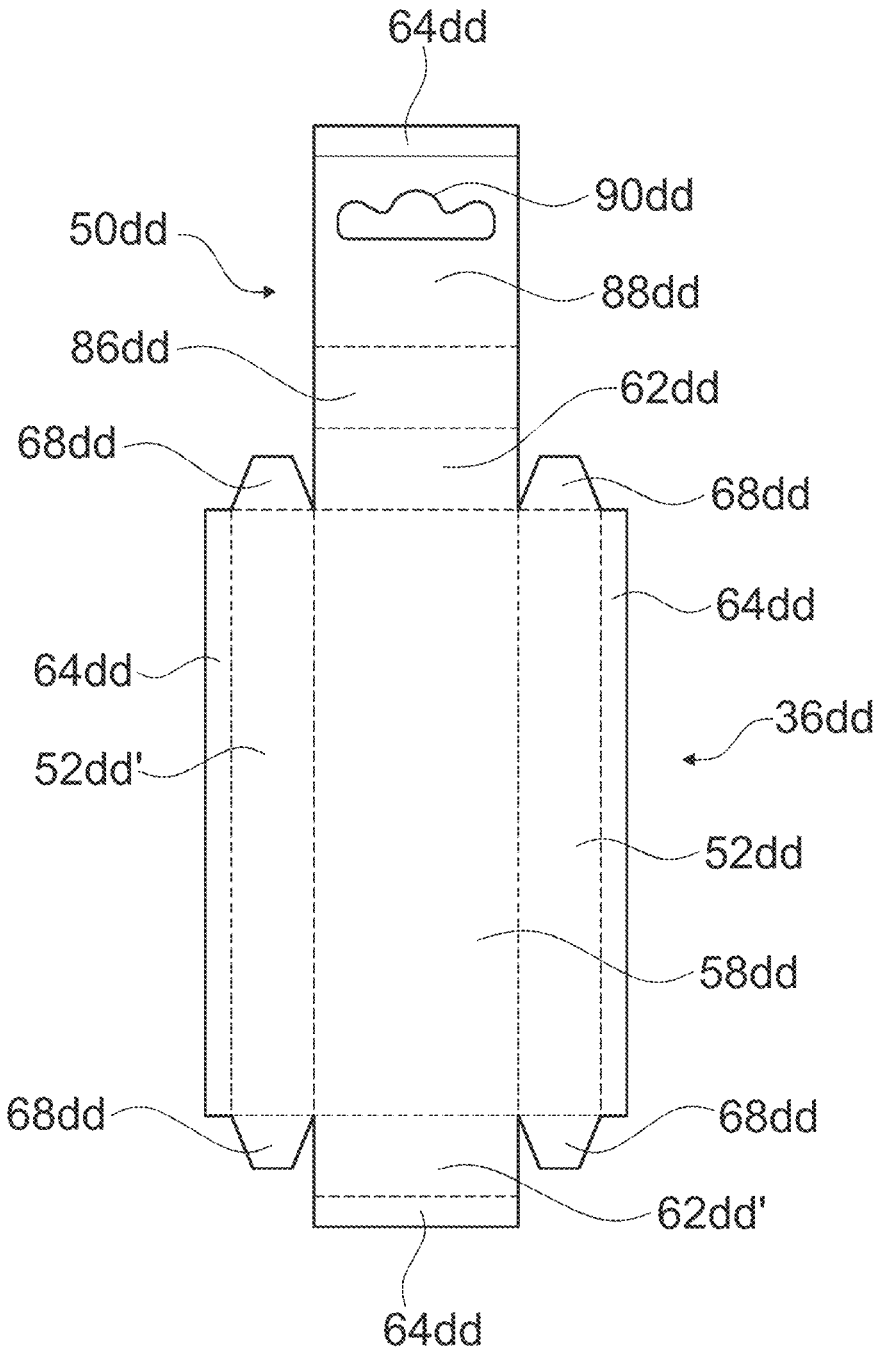
Figure 30B:
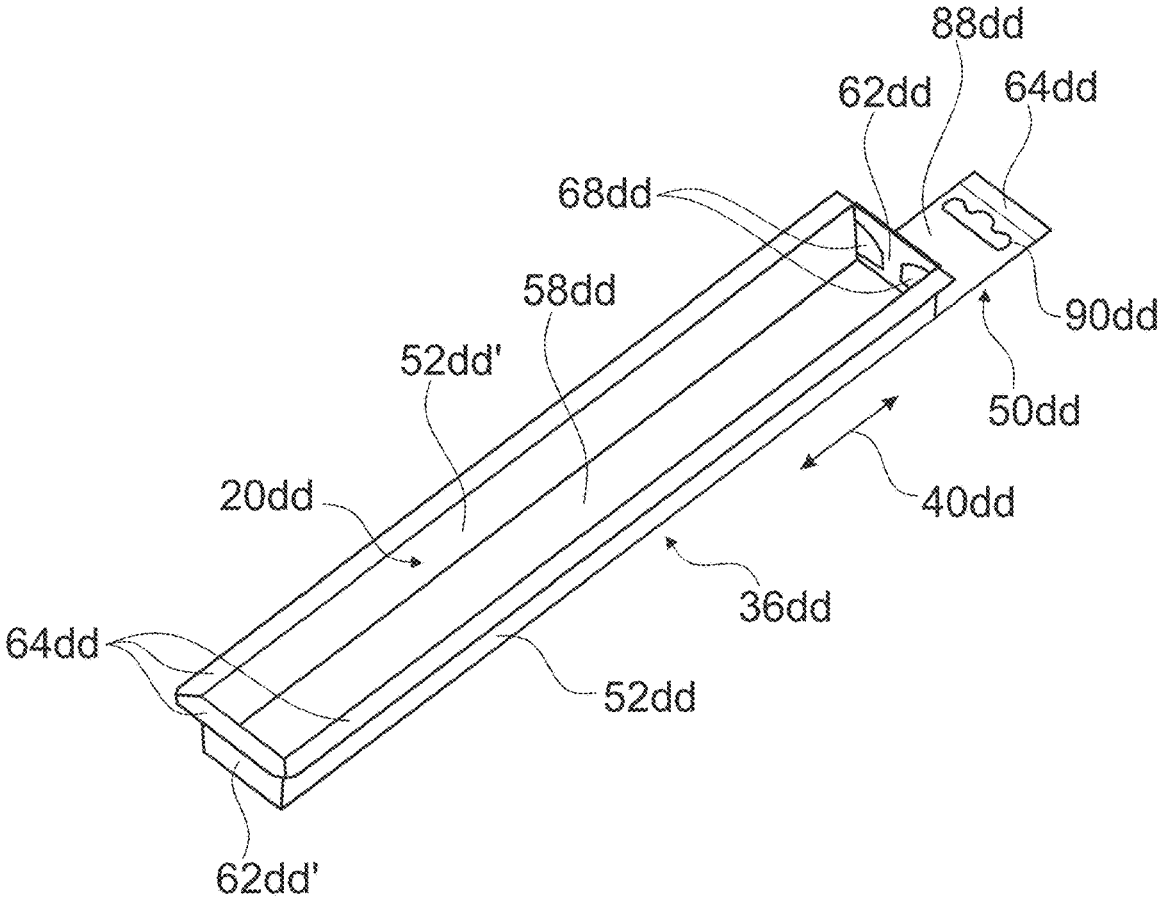
Figure 30C:
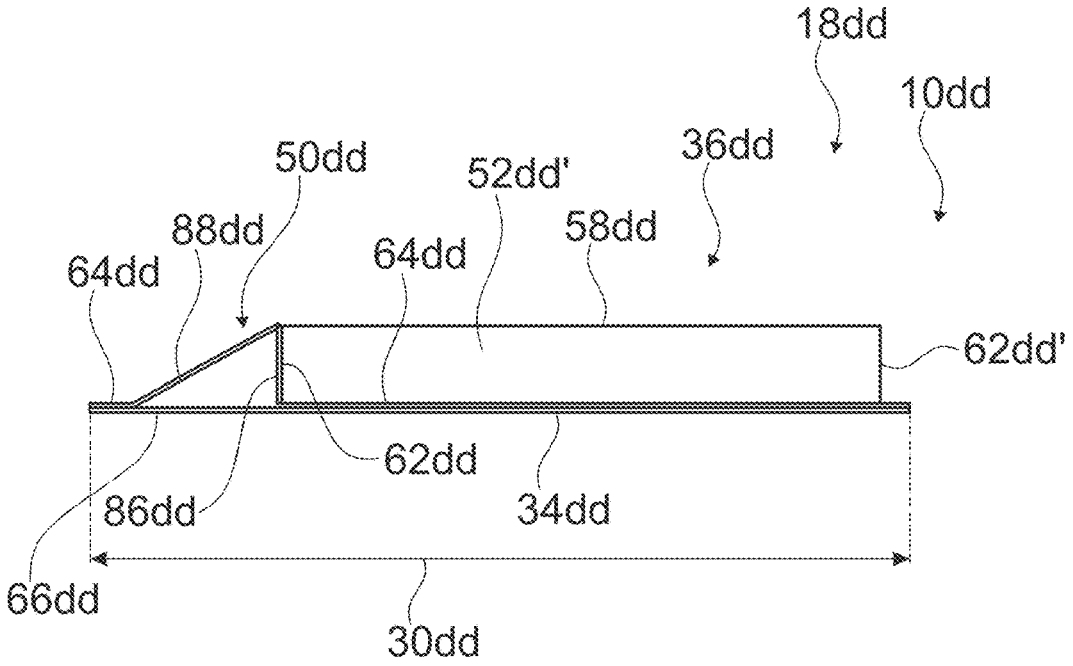
Figure 31A:
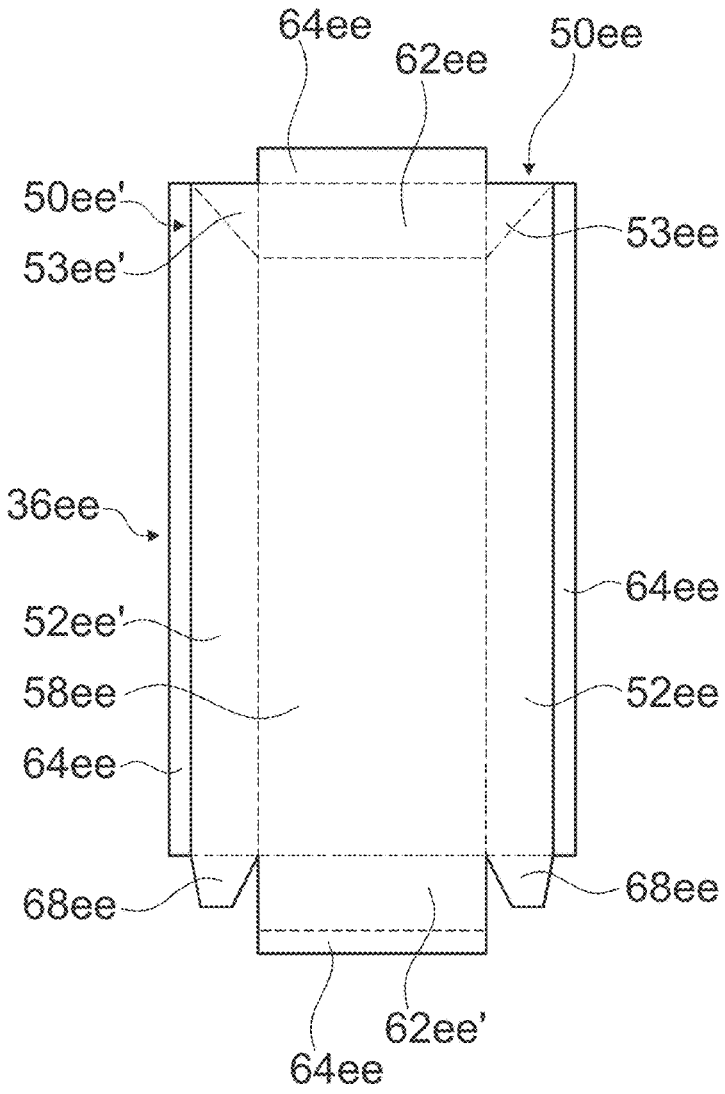
Figure 31B:
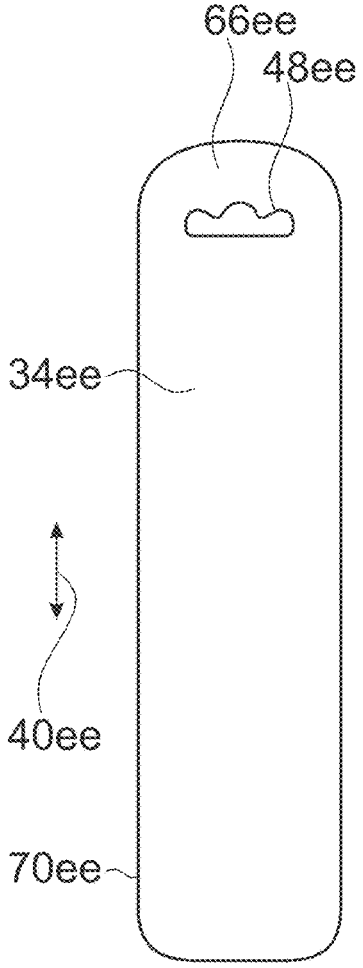
Figure 31C:
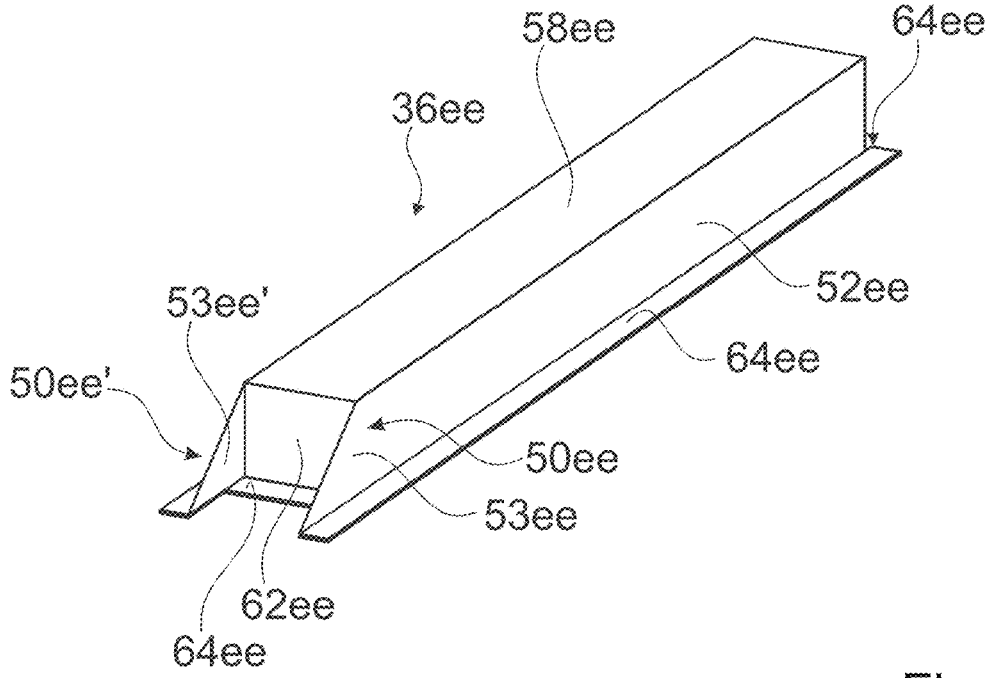
Figure 31D:
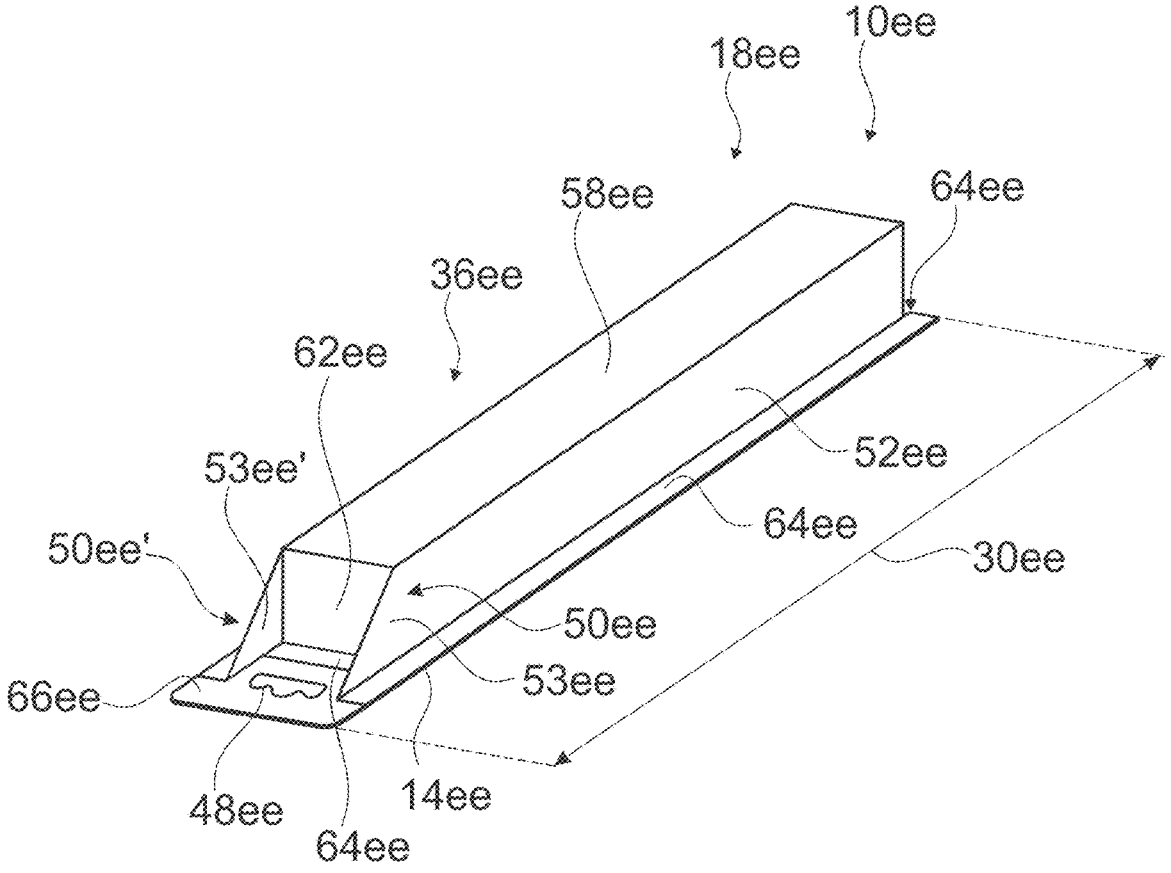
Figure 32:
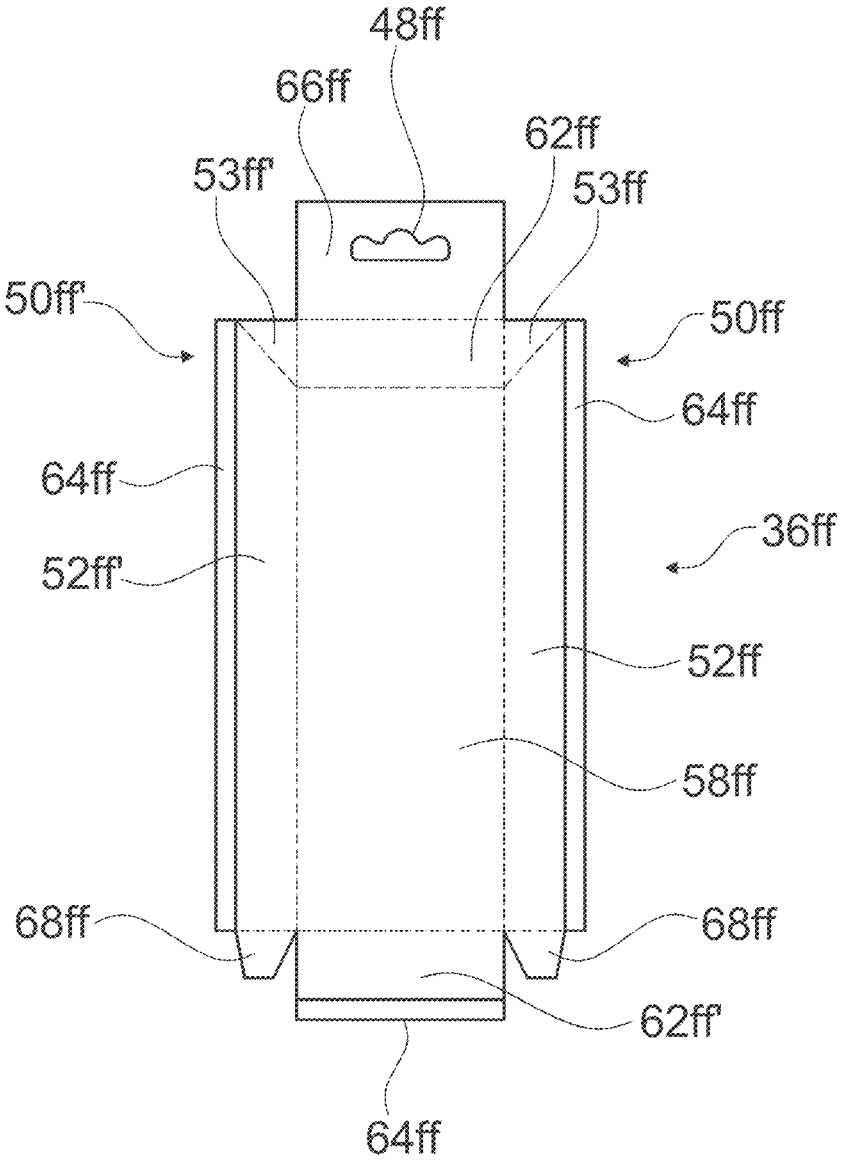
Figure 33A:
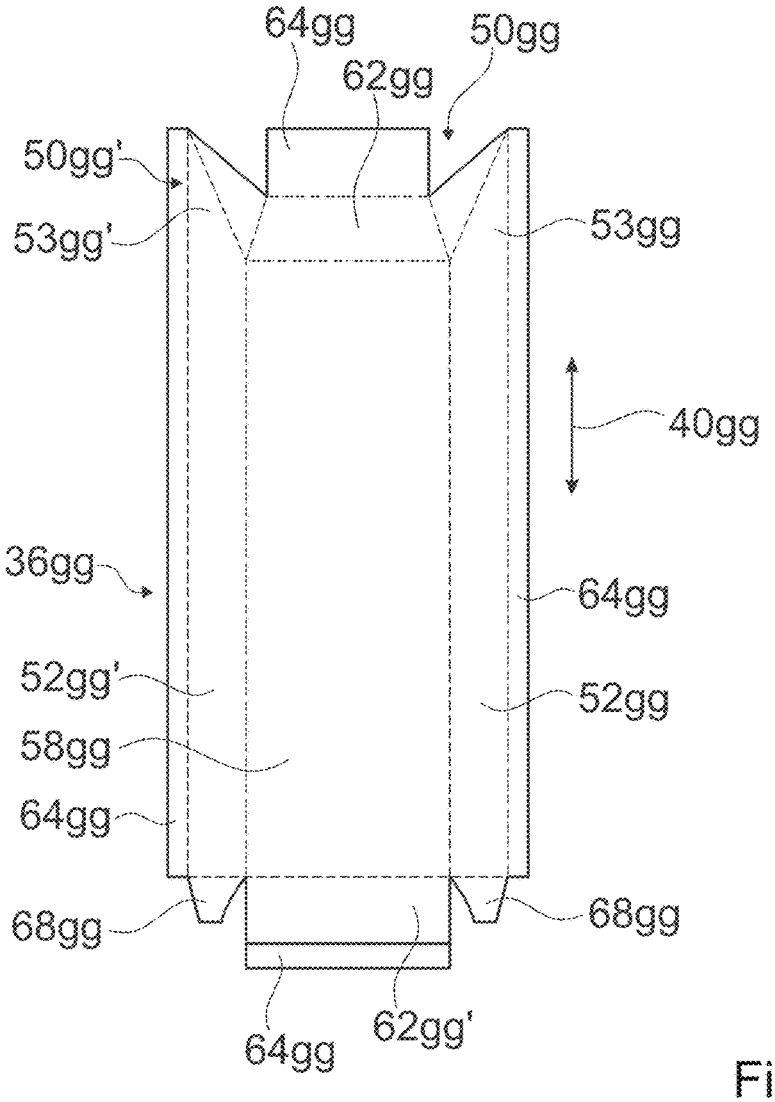
Figure 33B:
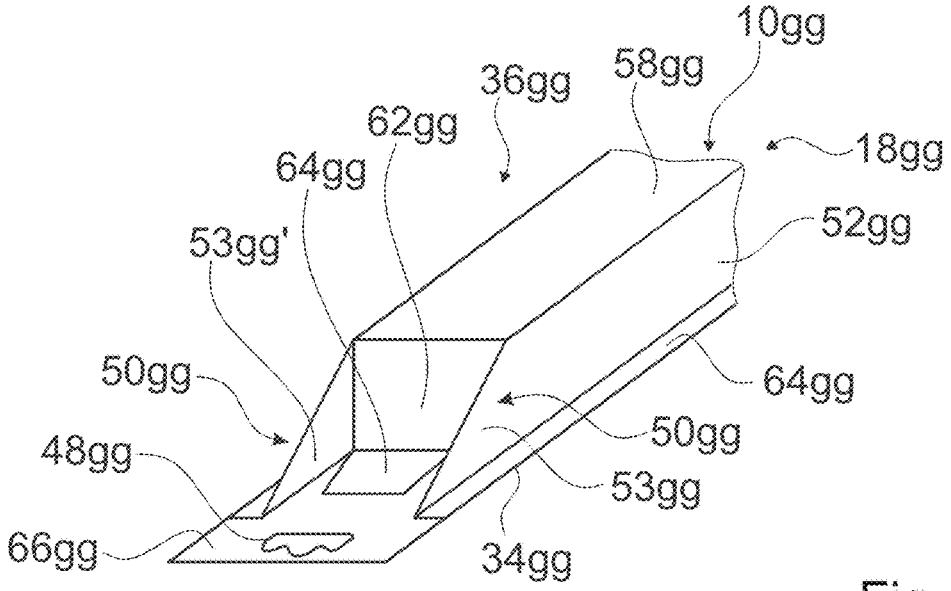
Figure 34A:
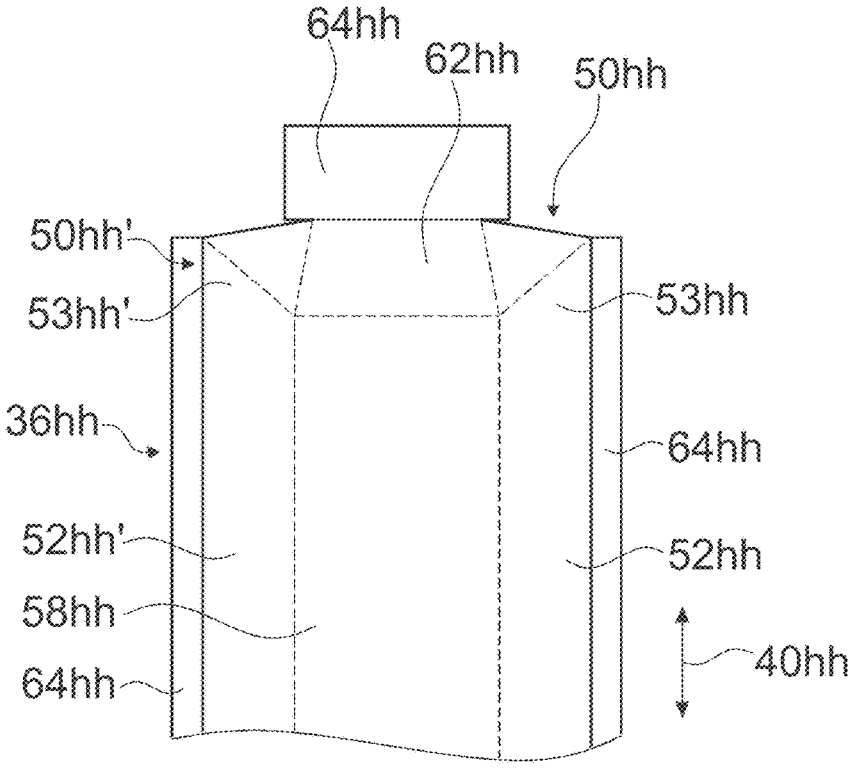
Figure 34B:
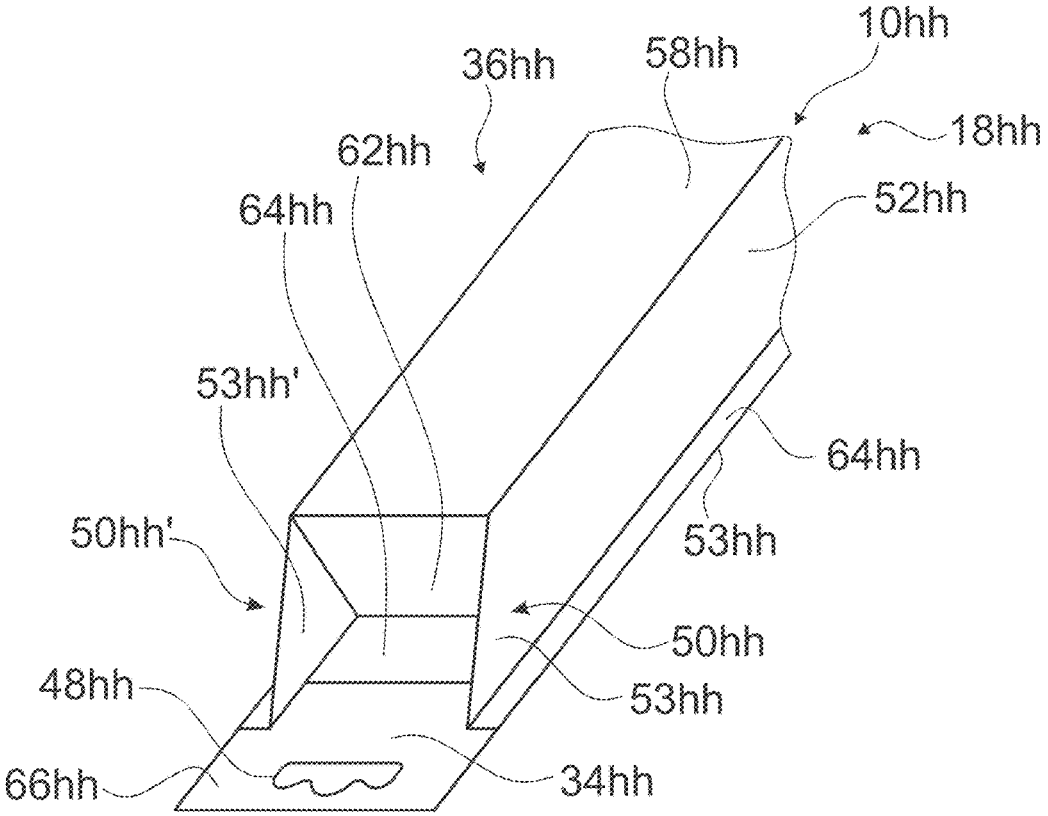
Figure 35A:
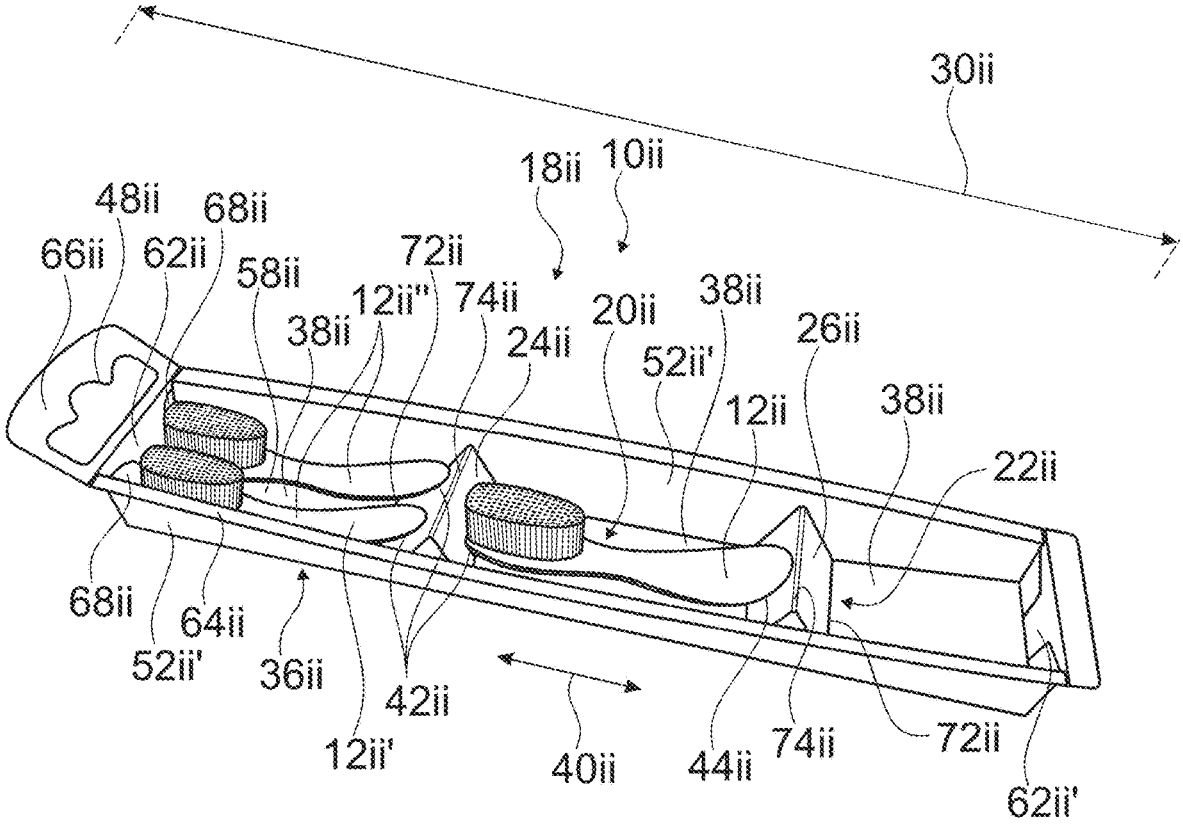
Figure 35B:
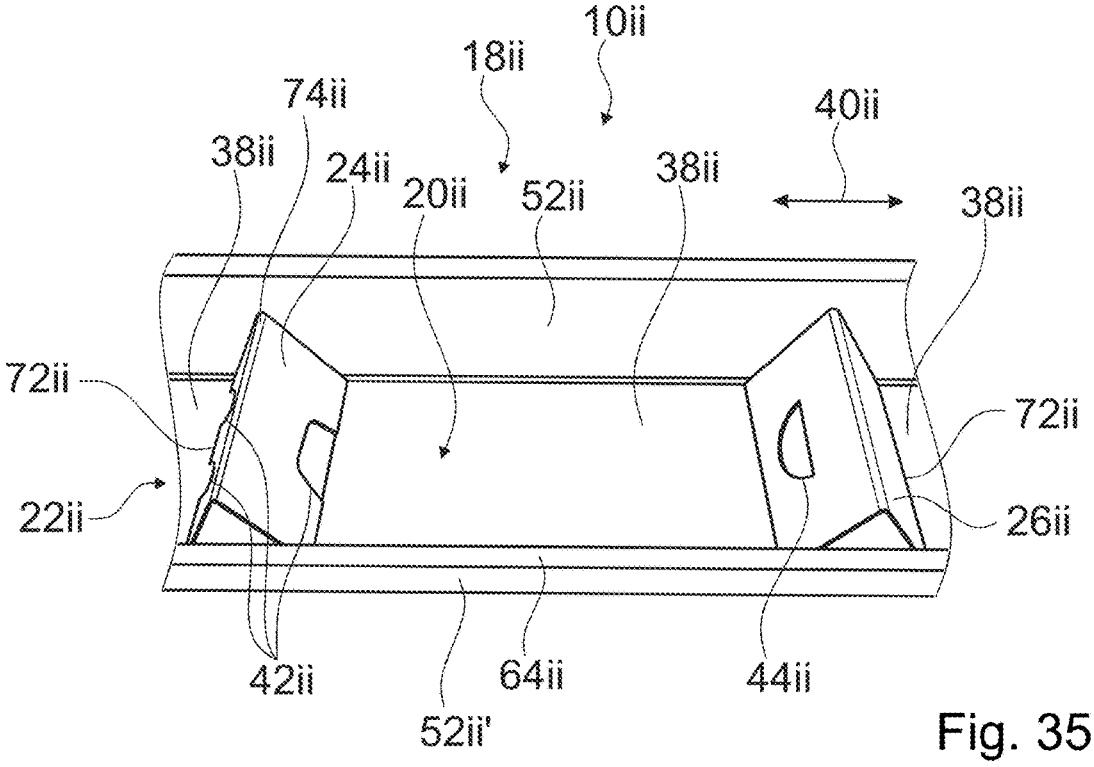
Figure 36A:
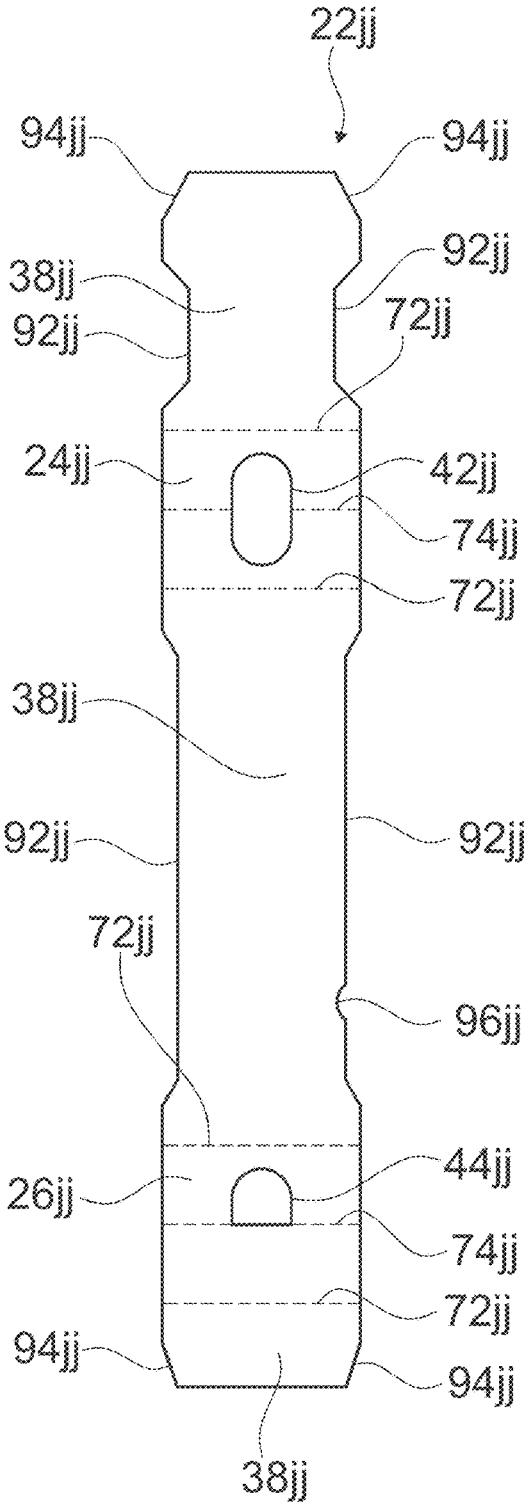
Figure 36B:
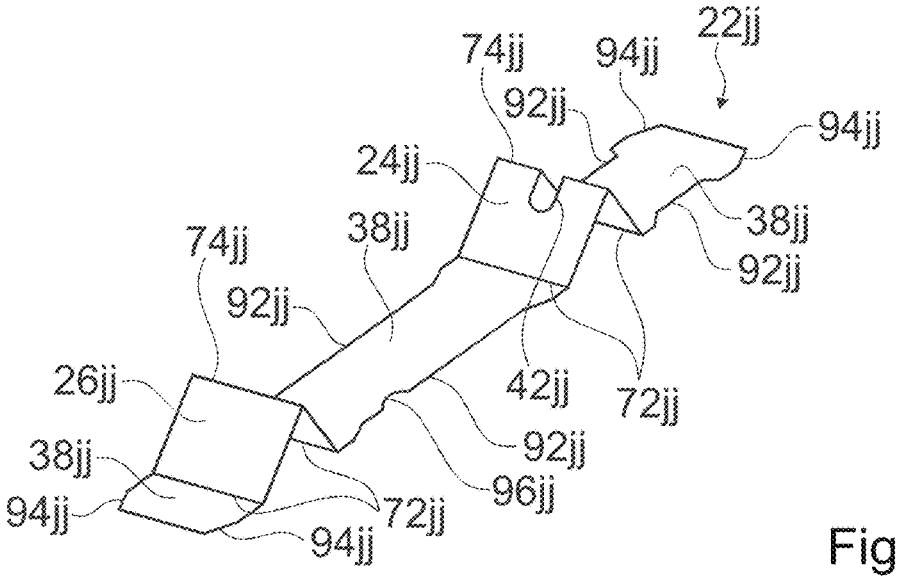
Figure 36C:
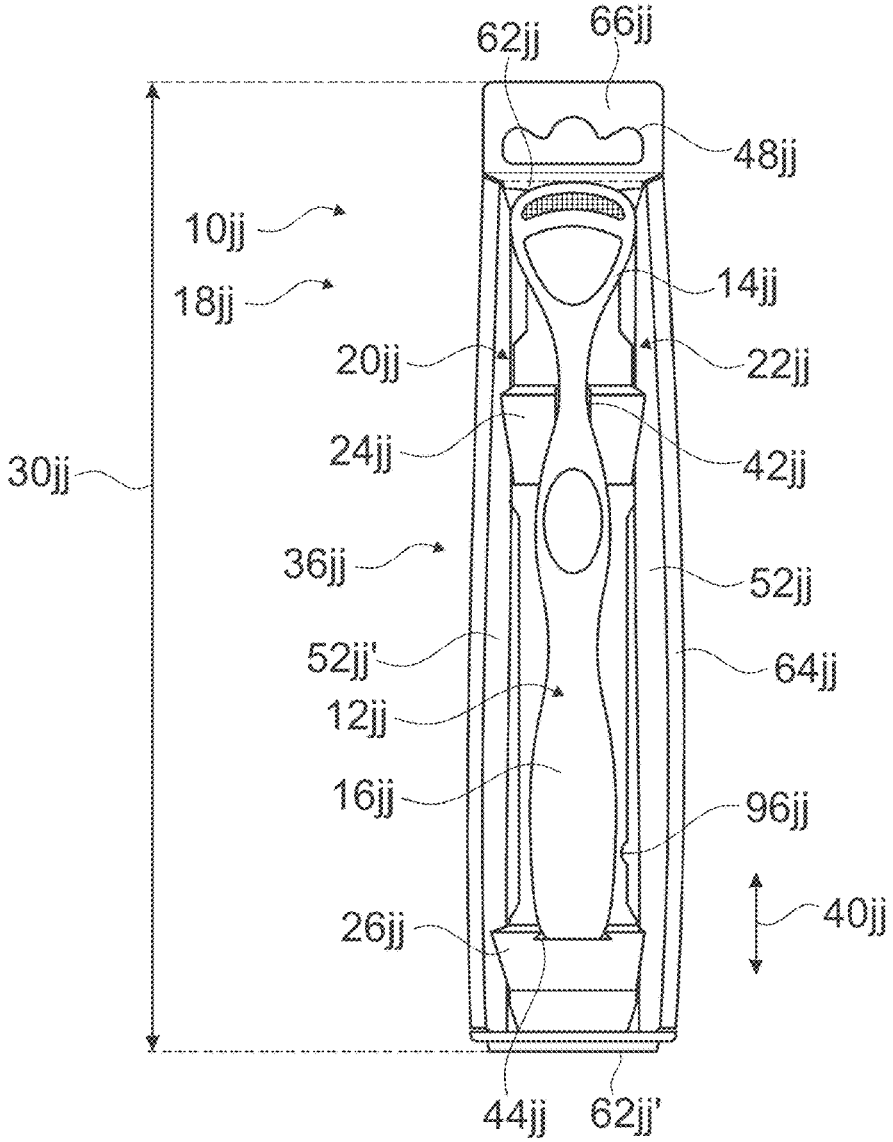

In the drawings:

FIG. 1*a* shows a precut of a card element of a packaging base body of a brush product packaging device according to the invention, in a plan view, FIG. 1*b* shows a precut of a hood element of the packaging base body of the brush product packaging device according to the invention, in a plan view, FIG. 1*c* shows the hood element of the packaging base body of the brush product packaging device according to the invention in a folded state, in a 3D view from the front, FIG. 1*d* shows the hood element of the packaging base body of the brush product packaging device according to the invention in a folded state, in a 3D view from the rear, FIG. 1*e* shows the hood element of the packaging base body of the brush product packaging device according to the invention in a folded state, in a plan view, FIG. 1*f* shows the hood element of the packaging base body of the brush product packaging device according to the invention in a folded state, in a view from below, FIG. 1*g* shows the hood element of the packaging base body of the brush product packaging device according to the invention in a folded state, in a side view onto a long side, FIG. 1*h* shows the hood element of the packaging base body of the brush product packaging device according to the invention in a folded state, in a side view onto a short side from below, FIG. 1*i* shows the brush product packaging device according to the invention in a 3D view from the front, FIG. 1*j* shows the brush product packaging device according to the invention with the packaging base body and with a holding unit, in a 3D view from the front, with a hidden card element and without a brush product, FIG. 1*k* shows the brush product packaging device according to the invention with the packaging base body and with the holding unit, in a 3D view from the front, with a hidden card element and with an accommodated brush product, FIG. 2*a* shows a precut of a holding unit of an alternative brush product packaging device according to the invention, in a plan view, FIG. 2*b* shows the alternative brush product packaging device according to the invention with a packaging base body and with the holding unit, in a 3D view from the front, with a hidden card element, FIG. 2*c* shows the alternative brush product packaging device according to the invention with the packaging base body and with the holding unit, in a 3D view from the front, with the hidden card element and with two accommodated brush products, FIG. 3*a* shows a precut of a holding unit of a further alternative brush product packaging device according to the invention, in a plan view, FIG. 3*b* shows the holding unit of the further alternative brush product packaging device according to the invention, in a 3D view from the front, FIG. 3*c* shows the further alternative brush product packaging device according to the invention with a packaging base body and with the holding unit, in a 3D view from the front, with a hidden card element and with an accommodated brush product, FIG. 4*a* shows a precut of a holding unit of a further alternative brush product packaging device according to the invention, in a plan view, FIG. 4*b* shows the further alternative brush product packaging device according to the invention with a packaging base body and with the holding unit, in a 3D view from the front, with a hidden card element and with accommodated brush products, FIG. 5*a* shows a precut of a holding unit of a further alternative brush product packaging device according to the invention, in a plan view, FIG. 5*b* shows the holding unit of the further alternative brush product packaging device according to the invention, in a 3D view from the front, FIG. 5*c* shows the further alternative brush product packaging device according to the invention with a packaging base body and with the holding unit, in a 3D view from the front, with a hidden card element and with accommodated brush products, FIG. 6*a* shows a precut of a holding unit of a further alternative brush product packaging device according to the invention, in a plan view, FIG. 6*b* shows the holding unit of the further alternative brush product packaging device according to the invention, in a 3D view from the front, FIG. 6*c* shows a precut of a packaging base body of the further alternative brush product packaging device according to the invention, in a plan view, FIG. 7 shows a precut of a packaging base body of a further alternative brush product packaging device according to the invention, in a plan view, FIG. 8 shows a precut of a packaging base body of a further alternative brush product packaging device according to the invention, in a plan view, FIG. 9 shows a folding element of a holding unit of a further alternative brush product packaging device according to the invention with two recesses, in a schematic side view, FIG. 10 shows a folding element of a holding unit of a further alternative brush product packaging device according to the invention with two recesses, in a schematic side view, FIG. 11*a* shows a folding element of a holding unit of a further alternative brush product packaging device according to the invention with two recesses, in a schematic side view, FIG. 11*b* shows an alternative folding element of the holding unit of the further alternative brush product packaging device according to the invention with a recess, in a cutout of a schematic side view, FIG. 11*c* shows an alternative folding element of the holding unit of the further alternative brush product packaging device according to the invention with a recess, in a cutout of a schematic side view, FIG. 11*d* shows an alternative folding element of the holding unit of the further alternative brush product packaging device according to the invention with a recess, in a cutout of a schematic side view, FIG. 12 shows a folding element of a holding unit of a further alternative brush product packaging device according to the invention with a projection, in a 3D view from the front, FIG. 13*a* shows a folding element of a holding unit of a further alternative brush product packaging device according to the invention with a projection and two recesses, in a schematic side view, FIG. 13*b* shows an alternative folding element of the holding unit of the further alternative brush product packaging device according to the invention with a projection and two recesses, in a schematic side view, FIG. 14 shows a folding element of a holding unit of a further alternative brush product packaging device according to the invention with a recess, in a schematic side view, FIG. 15 shows a folding element of a holding unit of a further alternative brush product packaging device according to the invention with a recess, in a schematic side view, FIG. 16 shows a folding element of a holding unit of a further alternative brush product packaging device according to the invention with two recesses, in a schematic side view, FIG. 17*a* shows a precut of a holding unit of a further alternative brush product packaging device according to the invention, in a plan view, FIG. 17*b* shows the holding unit of the further alternative brush product packaging device according to the invention, in a 3D view from the front, FIG. 17*c* shows the holding unit of the further alternative brush product packaging device according to the invention, in a plan view from the front, with accommodated brush products, FIG. 18 shows a holding unit of a further alternative brush product packaging device according to the invention, in a plan view from the front, with accommodated brush products, FIG. 19 shows a further alternative brush product packaging device according to the invention with a packaging base body and with a holding unit, in a 3D view from the front, with a hidden card element, with an accommodated brush product and with an accommodated additional product, FIG. 20*a* shows a further alternative brush product packaging device according to the invention with a packaging base body and with a holding unit, in a plan view from the front, with a hidden card element, with an accommodated brush product and with an accommodated additional product, FIG. 20*b* shows the further alternative brush product packaging device according to the invention with a packaging base body and with a holding unit, in a sectional illustration along the section line b-b, with a hidden card element, FIG. 20*c* shows the further alternative brush product packaging device according to the invention with a packaging base body and with a holding unit, in a sectional illustration along the section line c-c, with a hidden card element, FIG. 21 shows a precut of a packaging base body of a further alternative brush product packaging device according to the invention, in a plan view, FIG. 22 shows a precut of a packaging base body of a further alternative brush product packaging device according to the invention, in a plan view, FIG. 23 shows a further alternative brush product packaging device according to the invention, in a plan view from the front, with an accommodated brush product, FIG. 24 shows a further alternative brush product packaging device according to the invention, in a plan view from the front, with an accommodated brush product, FIG. 25 shows a further alternative brush product packaging device according to the invention, in a plan view from the front, with an accommodated brush product, FIG. 26 shows the further alternative brush product packaging device according to the invention, in a 3D view from the front, with an accommodated brush product, FIG. 27*a* shows a precut of a hood element of a packaging base body of a further alternative brush product packaging device according to the invention, in a plan view, FIG. 27*b* shows the further alternative brush product packaging device according to the invention, in a side view onto a long side, FIG. 27*c* shows the further alternative brush product packaging device according to the invention, in a schematic sectional illustration parallel to a long side, with accommodated brush products, FIG. 27*d* shows the further alternative brush product packaging device according to the invention, in a 3D view from the rear, FIG. 27*e* shows the further alternative brush product packaging device according to the invention, in a 3D view from the front, with a hidden card element and with accommodated brush products, FIG. 27*f* shows the further alternative brush product packaging device according to the invention, in a 3D view from the front, with accommodated brush products, FIG. 28*a* shows a precut of a hood element of a packaging base body of a further alternative brush product packaging device according to the invention, in a plan view, FIG. 28*b* shows the further alternative brush product packaging device according to the invention, in a 3D view from the front, with a hidden card element, FIG. 28*c* shows the further alternative brush product packaging device according to the invention, in a 3D view from the front, with a hidden card element and with accommodated brush products, FIG. 29*a* shows a precut of a hood element of a packaging base body of a further alternative brush product packaging device according to the invention, in a plan view, FIG. 29*b* shows the further alternative brush product packaging device according to the invention, in a 3D view from the front, with a hidden card element and with accommodated brush products, FIG. 30*a* shows a precut of a hood element of a packaging base body of a further alternative brush product packaging device according to the invention, in a plan view, FIG. 30*b* shows the hood element of the packaging base body of the further alternative brush product packaging device according to the invention, in a folded state, in a 3D view from the front, FIG. 30*c* shows the further alternative brush product packaging device according to the invention, in a side view onto the long side, FIG. 31*a* shows a precut of a hood element of a packaging base body of a further alternative brush product packaging device according to the invention, in a plan view, FIG. 31*b* shows a precut of a card element of a packaging base body of the further brush product packaging device according to the invention, in a plan view, FIG. 31*c* shows the hood element of the packaging base body of the further alternative brush product packaging device according to the invention, in a folded state, in a 3D view from the rear, FIG. 31*d* shows the further alternative brush product packaging device according to the invention, in a 3D view from the rear, FIG. 32 shows a precut of a hood element of a packaging base body of a further alternative brush product packaging device according to the invention, in a plan view, FIG. 33*a* shows a precut of a hood element of a packaging base body of a further alternative brush product packaging device according to the invention, in a plan view, FIG. 33*b* shows a partial cutout of the further alternative brush product packaging device according to the invention, in a 3D view from the rear, FIG. 34*a* shows a precut of a hood element of a packaging base body of a further alternative brush product packaging device according to the invention, in a plan view, FIG. 34*b* shows a partial cutout of the further alternative brush product packaging device according to the invention, in a 3D view from the rear, FIG. 35*a* shows a further alternative brush product packaging device according to the invention with a packaging base body and with a holding unit, in a 3D view from the front, with a hidden card element and with accommodated brush products, FIG. 35*b* shows a partial cutout of the further alternative brush product packaging device according to the invention with the packaging base body and with the holding unit, in a 3D view from the front, with a hidden card element and with accommodated brush products, FIG. 36*a* shows a precut of a holding unit of a further alternative brush product packaging device according to the invention, in a plan view, FIG. 36*b* shows the holding unit of the further alternative brush product packaging device according to the invention, in a 3D view from the front, and FIG. 36*c* shows the further alternative brush product packaging device according to the invention with a packaging base body and with the holding unit, in a 3D view from the front, with the hidden card element and with an accommodated brush product.

DESCRIPTION OF THE EXEMPLARY EMBODIMENTS

FIGS. 1*a* to 1*k* show a brush product packaging device 10*a* for accommodating a brush product 12*a* in a sidewise position. The brush product 12*a* comprises an application head 14*a* and a handle 16*a*. The application head 14*a* comprises a bristle field. Furthermore, the brush product 12*a* has a neck which connects the handle 16*a* to the application head 14*a*. The brush product 12*a* is realized as a toothbrush, in particular a manual toothbrush. The brush product packaging device 10*a* is exemplarily configured to accommodate a toothbrush. The brush product packaging device 10*a* forms a primary packaging for the brush product 12*a*. The brush product packaging device 10*a* is realized as a sales packaging. The brush product packaging device 10*a* comprises a receiving region 20*a* for accommodating the brush product 12*a*. The receiving region 20*a* is approximately rectangular-cuboid-shaped. The accommodation region 20*a* is realized so as to be substantially closed. In particular, the accommodation region 20*a* is in particular realized such that it is not completely tight.

The brush product packaging device 10*a* and the brush product 12*a* accommodated in the brush product packaging device 10*a* form a system, in particular a sales system.

The brush product packaging device 10*a* comprises a packaging base body 18*a*. The packaging base body 18*a* forms a base body of the brush product packaging device 10*a*. The packaging base body 18*a* is configured to form the substantially closed receiving region 20*a* for the brush product 12*a*. The packaging base body 18*a* materially delimits the receiving region 20*a*. Furthermore, the packaging base body 18*a* consists largely of a paper material. The packaging base body 18*a* consists of solid paperboard.

The packaging base body 18*a* comprises a folded hood element 36*a* and a card element 34*a* that is applied onto the hood element 36*a*. The card element 34*a* is exemplarily realized in a planar fashion. The card element 34*a* and the hood element 36*a* consist largely of a paper material. The card element 34*a* and the hood element 36*a* are made of solid paperboard. The card element 34*a* and the hood element 36*a* have the same material thickness. In an assembled state the hood element 36*a* is fixedly connected to the card element 34*a*. Furthermore, an extent of the hood element 36*a* along a main extension direction 40*a* of the brush product packaging device 10*a* is substantially equivalent to an extent of the card element 34*a* along the main extension direction 40*a* of the brush product packaging device 10*a*. The card element 34*a* is arranged on a front side of the brush product packaging device 10*a*. The card element 34*a* is realized essentially rectangular. The card element 34*a* has a length of 50 mm to 300 mm, preferably of 100 mm to 260 mm. The card element 34*a* furthermore has a width of 20 mm to 150 mm, preferably of 35 mm to 135 mm. The grammage of the card element 34*a* is from 200 g/m$^2$ to 500 g/m$^2$, preferably from 250 g/m$^2$ to 450 g/m$^2$. The hood element 36*a* is arranged on a rear side of the brush product packaging device 10*a*. The hood element 36*a* has delimiting surfaces which delimit the receiving region 20*a*. The hood element 36*a* has a bottom 58*a*. The hood element 36*a* furthermore comprises two side parts 52*a*, 52*a*' which adjoin the bottom 58*a* and are configured to form in each case one side wall of the packaging base body 18*a*. The hood element 36*a* further comprises two end walls 62*a*, 62*a*' which adjoin the bottom 58*a*. The hood element 36*a* moreover has sealing edges 64*a*, which are connected to the end walls 62*a*, 62*a*' and to the side parts 52*a*, 52*a*' and are configured for a connection to the card element 34*a*. The sealing edges 64*a* are connected to the end walls 62*a*, 62*a*' and to the side parts 52*a*, 52*a*' of the hood element 36*a* via perforations and creasings. The hood element 36*a* is produced from a precut (FIG. 1*b*). The precut of the hood element 36*a* has the rectangular bottom 58*a* and trapezoid-shaped end walls 62*a*, 62*a*' and side parts 52*a*, 52*a*'. At the end walls 62*a*, 62*a*' and the side parts 52*a*, 52*a*' respectively one sealing edge 64*a* is arranged, wherein the sealing edge 64*a* comprises a tab 66*a* in the region of the upper end wall 62*a*. Furthermore, respectively one dust tab 68*a* is arranged in each case on the two long trapezoid-shaped side parts 52*a*, 52*a*' at the two free edges. In a flat state, the hood element 36*a* has a length of 70 mm to 320 mm, preferably of 110 mm to 280 mm. The hood element 36*a* furthermore has in a flat state a width of 40 mm to 150 mm, preferably of 50 mm to 120 mm. In a formed state of the hood element 36*a*, the inner dimensions of the trough that forms the receiving region 20*a* have on a side facing towards the card element 34*a* a length of 50 mm to 250 mm, preferably of 100 mm to 200 mm, and a width of 15 mm to 60 mm, preferably of 20 mm to 40 mm. The hood element 36*a* presents a conicity from a side facing the card element 34*a* towards a bottom 58*a*, wherein the conicity is identical on opposite-situated sides, in particular on all four sides. An angle of the conicity is 2° to 20°, preferably 2° to 10°. Furthermore, the height of the hood element 36*a* is in a formed state 10 mm to 25 mm, preferably 14 mm to 20 mm. The total height of the packaging base body 18*a* is 12 mm to 35 mm, preferably 14 mm to 25 mm. The front side and the rear side of the packaging base body 18*a* are substantially parallel.

The packaging base body 18*a* comprises the dust tabs 68*a*. The hood element 36*a* comprises the dust tabs 68*a*. The dust tabs 68*a* are configured to prevent or reduce the entry of dust. The dust tabs 68*a* are fixed, like in particular by sealing, folded and laid on in order to form the hood element 36*a*, but they can also be arranged in unfixed or non-fixed fashion, just lying on. During production, the dust tabs 68*a* are sealed in particular with the end walls 62*a*, 62*a*' of the hood element 36*a*.

Furthermore, the packaging base body 18*a* has a suspension recess 48*a* at an upper end. The suspension recess 48*a* is realized as a euroslot recess. The suspension recess 48*a* is introduced into an upwardly protruding tab 66*a*. The tab 66*a* has a double cardboard guide. The tab 66*a* for the suspension recess 48*a* is realized in two layers, wherein one layer of the tab 66*a* is formed by the card element 34*a* and one layer of the tab 66*a* is formed by the hood element 36*a*. The hood element 36*a* and the card element 34*a* are sealed in the region of the tab 66*a*. The tab 66*a* is realized partly integrally with the hood element 36*a* and partly integrally with the card element 34*a*. The card element 34*a* has a smaller suspension recess 48*a* in the region of the tab 66*a* than the hood element 36*a* has in the region of the tab 66*a*, in order to compensate the tolerances occurring in the assembly of the elements relative to each other, such that the suspension recess of the card element 34*a* is not overlapped by the suspension recess of the hood element 36*a*. In the hood element 36*a* a larger suspension recess 48*a* is provided. The suspension recesses 48*a* have a size difference of approximately 0.5 mm. The suspension recess 48*a* is closed and not laterally open in order to ensure stability. In principle, the Euroslot recess may also be omitted if the packaging base body 18*a* is not suspended, thus saving material and volume.

Furthermore, the packaging base body 18*a* comprises respectively one guide section 70*a*, 70*a*' with a reduced depth extent on each of two opposite-situated edges which extend parallel to the main extension direction 40*a* of the brush product packaging device 10*a*. The guide sections 70*a*, 70*a*' in each case have a reduced depth extent as compared to the overall depth extent. The packaging base body 18*a* has straight, parallel outer edges in the guide sections 70*a*, 70*a*'. In the guide sections 70*a*, 70*a*', the packaging base body 18*a* is respectively realized at least partially in a multi-layer implementation. In the guide sections 70*a*, 70*a*', the card element 34*a* and the hood element 36*a* are arranged in a respectively overlapping manner. In the guide sections 70*a*, 70*a*', the card element 34*a* is respectively sealed with the hood element 36*a* via the sealing edges 64*a*, wherein the sealing edges 64*a* and the card element 34*a* are sealed surface-wise in the guide sections 70*a*, 70*a*'. The guide sections 70*a*, 70*a*' respectively form an insertion plane of the brush product packaging device 10*a*. The guide sections 70*a*, 70*a*' serve for receiving the brush product packaging device 10*a* in a tray packaging. For sales purposes, the brush product packaging device 10*a* is inserted into guidings of the tray packaging. A maximum thickness of the packaging base body 18*a* is in the guide sections 70*a*, 70*a*' respectively 0.2 mm to 2.5 mm, preferably 0.3 mm to 1 mm.

Furthermore, the packaging base body 18*a* comprises a viewing window 54*a*. The card element 34*a* of the packaging base body 18*a* delimits a recess 56*a* that forms the viewing window 54*a*. The viewing window 54*a* serves for making products, a number of products, colors and the like visible. In the present example, the bristle field of the brush product 12*a* is visible through the viewing window 54*a*. The recess 56*a* is closed by a fastened film, such that the viewing window 54*a* is closed. In this way entry of dirt can be prevented. The viewing window 54*a* has a rectangular basic shape. The viewing window 54*a* has a main extension area that is equivalent to 5% to 40%, preferably 8% to 20%, of a main extension area of the card element 34*a*.

The brush product packaging device 10*a* further comprises a holding unit 22*a*. The holding unit 22*a* projects into the receiving region 20*a* and is configured for holding the brush product 12*a* in position relative to the receiving region 20*a*. The holding unit 22*a* is configured for holding the brush product 12*a* at the handle 16*a* and/or at the neck in position relative to the receiving region 20*a* and/or for reducing a movement of the brush product 12*a*. The holding unit 22*a* is configured for reducing a movement play of the brush product 12*a*. The holding unit 22*a* consists largely of a paper material. The holding unit 22*a* is realized separately from the packaging base body 18*a*.

Furthermore, the holding unit 22*a* comprises two folding elements 24*a*, 26*a*, which project at least partially into the receiving region 20*a* in different regions. The folding elements 24*a*, 26*a* are made of solid paperboard. The folding elements 24*a*, 26*a* form part of the holding unit 22*a*. The folding elements 24*a*, 26*a* are connected to each other. The holding unit 22*a* comprises several base side elements 38*a*, via which the folding elements 24*a*, 26*a* are connected to each other. The folding elements 24*a*, 26*a* are connected to each other integrally via the base side elements 38*a*. Furthermore, the folding elements 24*a*, 26*a* are connected to the hood element 36*a* via the base side elements 38*a*. The holding unit 22*a* is realized in a one-part implementation. The holding unit 22*a* is produced from a flat precut in which the folding options for the folding elements 24*a*, 26*a* are already integrated in the form of creases and/or perforations. The holding unit 22*a* is realized as an inlay part for the packaging base body 18*a*. The holding unit 22*a* consists of a rectangular precut. The holding unit 22*a* consists of a first base side element 38*a*, of a first folding element 24*a* which is connected thereto and has a triangular cross-section, of a second base side element 38*a* connected to the first folding element 24*a*, of a second folding element 26*a* which is connected to the second base side element 38*a* and has a triangular cross-section, and of a third base side element 38*a* connected to the second folding element 26*a*. The folding elements 24*a*, 26*a* are respectively connected to the base side elements 38*a* via folding edges 72*a*. Furthermore, the folding elements 24*a*, 26*a* in each case have, on a free upper side, a further folding edge 74*a*, which in each case forms a ridge of the folding elements 24*a*, 26*a*. The folding elements 24*a*, 26*a* each form an elevation. The folding elements 24*a*, 26*a* each form a saddle-roof-shaped elevation. Depending on a folding angle of the folding elements 24*a*, 26*a*, different heights of the folding elements 24*a*, 26*a* can be realized. The position for a fixing of the brush product 12*a* is variable. In particular, the position depends on a geometry of the receiving region 20*a* and on a geometry of the brush product 12*a*. The brush product 12*a* is exemplarily fixed in a neck region and in a region of the handle 16*a* of the brush product 12*a*.

The holding unit 22*a* is realized so as to be, for example, sealed or glued into the packaging base body 18*a*. The holding unit 22*a* is, in a region of the base side elements 38*a*, connected to the packaging base body 18*a* in a planar manner. The holding unit 22*a* is connected on an inner face of the packaging base body 18*a*, on a base side of the hood element 36*a*. In a state when arranged in the packaging base body 18*a*, the holding unit 22*a* is realized so as to be mounted and folded. The holding unit 22*a* extends widthwise over the entire width of the bottom 58*a* of the hood element 36*a*. Furthermore, the holding unit 22*a* extends at least over a large portion of a main extent 30*a* of the packaging base body 18*a*. The main extent 30*a* of the packaging base body 18*a* is herein realized as an extent of the packaging base body 18*a* along the main extension direction 40*a*.

The folding elements 24*a*, 26*a* each have a height of 8 mm to 35 mm, preferably of 10 mm to 25 mm. The folding elements 24*a*, 26*a* extend from the bottom 58*a* of the hood element 36*a* upwards as far as the card element 34*a*. The height of the folding elements 24*a*, 26*a*, of recesses 42*a*, 44*a* and of the receiving region 20*a* are adapted to one another such that the accommodated brush product 12*a* is pressed against the card element 34*a*. The folding elements 24*a*, 26*a* in each case have a width that corresponds to a width of the receiving region 20*a*. In particular, a width of the folding elements 24*a*, 26*a* corresponds to a width of the holding unit 22*a*.

The folding elements 24*a*, 26*a* each delimit a recess 42*a*, 44*a* for receiving at least one subregion of the brush product 12*a*. The recesses 42*a*, 44*a* are respectively formed by groove-shaped recesses 42*a*, 44*a*. The recesses 42*a*, 44*a* are in each case introduced into two surfaces of the respective folding element 24*a*, 26*a*. In order to form the groove-shaped recesses 42*a*, 44*a*, two surfaces of the respective folding element 24*a*, 26*a* each have a sub-recess, wherein the sub-recesses are connected to one another on at least one side. The sub-recesses are connected at an upper edge of the folding elements 24*a*, 26*a*. The sub-recesses are herein approximately rectangular. The recesses 42*a*, 44*a* taper conically from a free end, which brings about better clamping. The recesses 42*a*, 44*a* are trapezoid-shaped. The resulting grooves each have in a lower region a width of 3 mm to 10 mm, preferably of 3 mm to 6 mm. The grooves furthermore have, at a free open end, a width of 4 mm to 15 mm, preferably of 5 mm to 10 mm. The depth of the grooves is in particular 3 mm to 12 mm, preferably 5 mm to 10 mm, measured on the surface of the respective folding element 24*a*, 26*a*.

A first recess 42*a* of a first folding element 24*a* of the folding elements 24*a*, 26*a* is substantially different from a second recess 44*a* of a second folding element 26*a* and is configured for receiving a different subregion of the brush product 12*a*.

A distance of the first folding element 24*a* of the folding elements 24*a*, 26*a* from a second folding element 26*a* of the folding elements 24*a*, 26*a* is equivalent to 20% to 60% of a total extent of the receiving region 20*a* along the main extension direction 40*a*. A distance of the first folding element 24*a* from the second folding element 26*a* along the main extension direction 40*a* is 20% to 60%, preferably 25% to 40%, of a total extent of the receiving region 20*a* along the main extension direction 40*a*. The distance is here viewed from tip to tip of the respective folding elements 24*a*, 26*a* with respect to the total length of the receiving region 20*a* of the hood element 36*a*. Measured from the upper end of the receiving region 20*a* of the hood element 36*a* to a tip of the respective folding element 24*a*, the first folding element 24*a* is arranged after 15% to 40%, preferably 20% to 35%, of the length of the receiving region 20*a* viewed along the main extension direction 40*a*. Measured from the upper end of the receiving region 20*a* of the hood element 36*a* to a tip of the respective folding element 26*a*, the second folding element 26*a* is arranged after 50% to 75%, preferably 55% to 65%, of the length.

In a production of the brush product packaging device 10*a*, precuts of the card element 34*a* and of the hood element

36*a* are produced in a first method step. Then the hood element 36*a* is formed. Herein a trough is formed from the flat precut of the hood element 36*a*. The formed trough may optionally be glued and/or sealed. Furthermore, the holding unit 22*a* is introduced into the hood element 36*a* and is connected, for example, by sealing or gluing. After this, the formed trough is filled with the brush product 12*a*, which is fixed in or with the folding element 26*a*. Then the card element 34*a* is placed onto the filled trough of the hood element 36*a*. The card element 34*a* is sealed with the sealing edges 64*a* of the hood element 36*a* by hot sealing.

In FIGS. 2*a* to 35*b* thirty-four further exemplary embodiments of the invention are shown. The following descriptions are essentially limited to the differences between the exemplary embodiments wherein, with regard to components, features and functions that remain the same, reference may be made to the description of the other exemplary embodiments, in particular of FIGS. 1*a* to 1*k*. To distinguish the exemplary embodiments, the letter a in the reference numerals of the exemplary embodiment of FIGS. 1*a* to 1*k* has been replaced by the letters b to z and by the endings aa to ii in the reference numerals of the exemplary embodiments of FIGS. 2*a* to 35*b*. With regard to components having the same denomination, in particular with regard to components having the same reference numerals, reference may in principle also be made to the drawings and/or the description of the other exemplary embodiments, in particular of FIGS. 1*a* to 1*k*.

FIGS. 2*a* to 2*c* show an alternative brush product packaging device 10*b* for accommodating two brush products 12*b*, 12*b*' in a sidewise position. The brush product packaging device 10*b* comprises a packaging base body 18*b*. The packaging base body 18*b* comprises a folded hood element 36*b* and a card element that is applied onto the hood element 36*b*. The card element and the hood element 36*b* consist largely of a paper material.

The brush product packaging device 10*b* further comprises a holding unit 22*b*. The holding unit 22*b* projects into a receiving region 20*b* of the packaging base body 18*b* and is configured for holding two brush products 12*b*, 12*b*' in position relative to the receiving region 20*b*. The holding unit 22*b* is configured for holding the brush products 12*b*, 12*b*' at a handle 16*b* and/or at a neck in position relative to the receiving region 20*b* and/or for reducing a movement of the brush products 12*b*, 12*b*'. The holding unit 22*b* is configured to reduce a movement play of the brush products 12*b*, 12*b*'. The holding unit 22*b* is largely made of a paper material. The holding unit 22*b* is realized separately from the packaging base body 18*b*.

Furthermore, the holding unit 22*b* comprises two folding elements 24*b*, 26*b*, which project at least partially into the receiving region 20*b* in different regions. The folding elements 24*b*, 26*b* are produced from solid paperboard. The folding elements 24*b*, 26*b* form part of the holding unit 22*b*. The folding elements 24*b*, 26*b* are connected to each other. The holding unit 22*b* comprises several base side elements 38*b*, via which the folding elements 24*b*, 26*b* are connected to each other.

The folding elements 24*b*, 26*b* each delimit two recesses 42*b*, 42*b*', 44*b*, 44*b*' for receiving at least one subregion of the brush products 12*b*, 12*b*'.

The first folding element 24*b* and the second folding element 26*b* of the folding elements 24*b*, 26*b* each delimit two recesses 42*b*, 42*b*', 44*b*, 44*b*', which are respectively configured for receiving different brush products 12*b*, 12*b*'.

The recesses 42*b*, 42*b*', 44*b*, 44*b*' are respectively realized as groove-shaped recesses 42*b*, 42*b*', 44*b*, 44*b*'. The recesses 42*b*, 42*b*', 44*b*, 44*b*' are respectively introduced into two surfaces of the respective folding element 24*b*, 26*b*. In order to realize the groove-shaped recesses 42*b*, 42*b*', 44*b*, 44*b*', two surfaces of the respective folding element 24*b*, 26*b* each have a sub-recess, wherein the sub-recesses are connected to one another on at least one side. The sub-recesses are connected at an upper edge of the folding elements 24*b*, 26*b*. The sub-recesses are herein approximately rectangular. The recesses 42*b*, 42*b*', 44*b*, 44*b*' taper conically from a free end, which brings about better clamping. The recesses 42*b*, 42*b*', 44*b*, 44*b*' are partially trapezoid-shaped.

The first recesses 42*b*, 42*b*' of a first folding element 24*b* are arranged side by side and formed identically. The first recesses 42*b*, 42*b*' of the first folding element 24*b* have a narrow, downward-tapering shape for receiving a neck of the brush products 12*b*, 12*b*'. Furthermore, the second recesses 44*b*, 44*b*' of the second folding element 26*b* are arranged side by side and formed identically. The second recesses 44*b*, 44*b*' of the second folding element 26*b* have a broad, bulbous basic shape for receiving the handle 16*b* of the brush products 12*b*, 12*b*'. The first recesses 42*b*, 42*b*' of the first folding element 24*b* of the folding elements 24*b*, 26*b* are substantially different from the second recesses 44*b*, 44*b*' of the second folding element 26*b* and are configured for receiving a different subregion of the brush products 12*b*, 12*b*'.

FIGS. 3*a* to 3*c* show an alternative brush product packaging device 10*c* for accommodating a brush product 12*c*. In the present case, the brush product 12*c* is realized as a tongue cleaner. The brush product packaging device 10*c* comprises a packaging base body 18*c*. The packaging base body 18*c* comprises a folded hood element 36*c* and a card element that is applied onto the hood element 36*c*. The card element and the hood element 36*c* are largely made of a paper material.

The brush product packaging device 10*c* further comprises a holding unit 22*c*. The holding unit 22*c* projects into a receiving region 20*c* and is configured for holding the brush product 12*c* in position relative to the receiving region 20*c*. The holding unit 22*c* is configured for holding the brush product 12*c* at a handle 16*c* and/or at a neck in position relative to the receiving region 20*c*, and/or for reducing a movement of the brush product 12*c*. The holding unit 22*c* is configured for reducing a movement play of the brush product 12*c*. The holding unit 22*c* is largely made of a paper material. The holding unit 22*c* is realized separately from the packaging base body 18*c*.

Furthermore, the holding unit 22*c* comprises two folding elements 24*c*, 26*c*, which project at least partially into the receiving region 20*c* in different regions. The folding elements 24*c*, 26*c* are made of solid paperboard. The folding elements 24*c*, 26*c* form part of the holding unit 22*c*. The folding elements 24*c*, 26*c* are connected to each other. The holding unit 22*c* comprises several base side elements 38*c*, via which the folding elements 24*c*, 26*c* are connected to each other.

The folding elements 24*c*, 26*c* each delimit a recess 42*c*, 44*c* for receiving at least one subregion of the brush product 12*c*. A first recess 42*c* is realized as a groove-shaped recess 42*c*. The recess 42*c* is introduced into two surfaces of the first folding element 24*c*. In order to realize the groove-shaped recess 42*c*, two surfaces of the first folding element 24*c* each have a sub-recess, wherein the sub-recesses are connected to one another on a side. The sub-recesses are connected at an upper edge of the folding element 24*c*. The sub-recesses are herein approximately rectangular. The first recess 42*c* tapers conically from a free end, which brings about better clamping. A second recess 44*c* of the second folding element 26*c* comprises only a one-sided recess. The second recess 44*c* is introduced into only one surface of the second folding element 26*c*. The second recess 44*c* is introduced into the second folding element 26*c* on a side facing the first folding element 24*c*. The second recess 44*c* is in particular implemented in such a way that the brush product 12*c* extends only into the second folding element 26*c*, but not through the second folding element 26*c*. The second recess 44*c* serves as an end abutment for the brush product 12*c*. The second recess 44*c* is configured to accommodate an end of the handle 16*c* of the brush product 12*c*, which faces away from the application head 14*c*.

A first recess 42*c* of a first folding element 24*c* of the folding elements 24*c*, 26*c* is substantially different from a second recess 44*c* of a second folding element 26*c* and is configured for receiving a different subregion of the brush product 12*c*.

FIGS. 4*a* and 4*b* show an alternative brush product packaging device 10*d* for accommodating four brush products 12*d*, 12*d*', 12*d*", 12*d*"', which are embodied as toothbrushes, with the front side facing rearwards. The brush product packaging device 10*d* comprises a packaging base body 18*d*. The packaging base body 18*d* comprises a folded hood element 36*d* and a card element that is applied onto the hood element 36*d*. The card element and the hood element 36*d* are largely made of a paper material.

The brush product packaging device 10*d* further comprises a holding unit 22*d*. The holding unit 22*d* projects into the receiving region 20*d* and is configured for holding the four brush products 12*d*, 12*d*', 12*d*", 12*d*"' in position relative to the receiving region 20*d*. The holding unit 22*d* is configured for holding the brush products 12*d*, 12*d*', 12*d*", 12*d*"' at a handle 16*d* and/or at a neck in position relative to the receiving region 20*d* and/or for reducing a movement of the brush products 12*d*, 12*d*', 12*d*", 12*d*"'. For the sake of clarity, only the handle 16*d* of the brush product 12*d* is provided with a reference numeral in the figures. The holding unit 22*d* is configured to reduce a movement play of the brush products 12*d*, 12*d*', 12*d*", 12*d*"'. The holding unit 22*d* is largely made of a paper material. The holding unit 22*d* is realized separately from the packaging base body 18*d*.

The holding unit 22*d* further comprises two folding elements 24*d*, 26*d*, which project at least partially into the receiving region 20*d* in different regions. The folding elements 24*d*, 26*d* are made of solid paperboard. The folding elements 24*d*, 26*d* form part of the holding unit 22*d*. The folding elements 24*d*, 26*d* are connected to each other. The holding unit 22*d* comprises several base side elements 38*d*, via which the folding elements 24*d*, 26*d* are connected to each other.

The folding elements 24*d*, 26*d* each delimit four recesses 42*d*, 42*d*', 42*d*", 42*d*"', 44*d*, 44*d*', 44*d*", 44*d*" for receiving at least one subregion of the brush products 12*d*, 12*d*', 12*d*", 12*d*"'.

The first folding element 24*d* and the second folding element 26*d* of the folding elements 24*d*, 26*d* each delimit four recesses 42*d*, 42*d*', 42*d*", 42*d*"', 44*d*, 44*d*', 44*d*", 44*d*"', which are respectively configured for receiving different brush products 12*d*, 12*d*', 12*d*", 12*d*"'.

The recesses 42*d*, 42*d*', 42*d*", 42*d*"', 44*d*, 44*d*', 44*d*", 44*d*"' are in each case realized as groove-shaped recesses 42*d*, 42*d*', 42*d*", 42*d*"', 44*d*, 44*d*', 44*d*", 44*d*"'. The recesses 42*d*, 42*d*', 42*d*", 42*d*"', 44*d*, 44*d*', 44*d*", 44*d*"' are respectively introduced into two surfaces of the respective folding element 24*d*, 26*d*. In order to form the groove-shaped recesses 42*d*, 42*d*', 42*d*", 42*d*"', 44*d*, 44*d*', 44*d*", 44*d*"', two surfaces of the respective folding element 24*d*, 26*d* each have a sub-recess, wherein the sub-recesses are connected to each other on at least one side. The sub-recesses are connected at an upper edge of the folding elements 24*d*, 26*d*. The sub-recesses are herein approximately rectangular. The two outer recesses 44*d*, 44*d*"' of the second folding element 26*d* are open towards an outer edge of the folding element 26*d*. The two outer recesses 44*d*, 44*d*"' are for example realized as L-shaped recesses, wherein the two outer brush products 12*d*, 12*d*" are on one side pressed against a side wall of the hood element 36*d*. Herein the two outer recesses 44*d*, 44*d*"' are partially realized in the folding element 26*d* and one side is delimited by the hood element 36*d*. The two outer recesses 44*d*, 44*d*"' are therefore open on two sides.

The first recesses 42*d*, 42*d*', 42*d*", 42*d*"' of a first folding element 24*d* are arranged side by side and formed identically. The first recesses 42*d*, 42*d*', 42*d*", 42*d*"' of the first folding element 24*d* have a narrow shape for receiving the necks of the brush products 12*d*, 12*d*', 12*d*", 12*d*"'. Furthermore, the second recesses 44*d*, 44*d*', 44*d*", 44*d*"' of the second folding element 26*d* are arranged side by side. The second recesses 44*d*, 44*d*', 44*d*", 44*d*"' of the second folding element 26*d* have a broad basic shape for receiving the handle 16*d* of the brush products 12*d*, 12*d*', 12*d*", 12*d*"'. The first recesses 42*d*, 42*d*', 42*d*", 42*d*"' of the first folding element 24*d* of the folding elements 24*d*, 26*d* are substantially different from the second recesses 44*d*, 44*d*', 44*d*", 44*d*"' of the second folding element 26*d* and are configured for receiving a different subregion of the brush products 12*d*, 12*d*', 12*d*", 12*d*'".

FIGS. 5*a* to 5*c* show an alternative brush product packaging device 10*e* for accommodating three brush products 12*e*, 12*e*', 12*e*", which are embodied as toothbrushes, in a sidewise position. The brush product packaging device 10*e* comprises a packaging base body 18*e*. The packaging base body 18*e* comprises a folded hood element 36*e* and a card element that is applied onto the hood element 36*e*. The card element and the hood element 36*e* are largely made of a paper material.

The brush product packaging device 10*e* further comprises a holding unit 22*e*. The holding unit 22*e* projects into a receiving region 20*e* and is configured for holding the three brush products 12*e*, 12*e*', 12*e*" in position relative to the receiving region 20*e*. The holding unit 22*e* is configured for holding the brush products 12*e*, 12*e*', 12*e*" at a handle 16*e* and/or at a neck in position relative to the receiving region 20*e* and/or for reducing a movement of the brush products 12*e*, 12*e*', 12*e*". The holding unit 22*e* is configured to reduce a movement play of the brush products 12*e*, 12*e*', 12*e*". The holding unit 22*e* is largely made of a paper material. The holding unit 22*e* is realized separately from the packaging base body 18*e*.

Furthermore, the holding unit 22*e* comprises two folding elements 24*e*, 26*e*, which project at least partially into the receiving region 20*e* in different regions. The folding elements 24*e*, 26*e* are made of solid paperboard. The folding elements 24*e*, 26*e* form part of the holding unit 22*e*. The folding elements 24*e*, 26*e* are connected to each other. The holding unit 22*e* comprises several base side elements 38*e*, via which the folding elements 24*e*, 26*e* are connected to each other.

The folding elements 24*e*, 26*e* each delimit three recesses 42*e*, 42*e*', 42*e*", 44*e*, 44*e*', 44*e*" for receiving at least one subregion of the brush products 12*e*, 12*e*', 12*e*". The first folding element 24*e* and the second folding element 26*e* of the folding elements 24*e*, 26*e* each delimit three recesses 42*e*, 42*e*', 42*e*", 44*e*, 44*e*', 44*e*", which are respectively configured to accommodate different brush products 12*e*, 12*e*', 12*e*".

The recesses 42*e*, 42*e*', 42*e*", 44*e*, 44*e*', 44*e*" are in each case realized as groove-shaped recesses 42*e*, 42*e*', 42*e*", 44*e*, 44*e*', 44*e*". The recesses 42*e*, 42*e*', 42*e*", 44*e*, 44*e*', 44*e*" are respectively introduced into two surfaces of the respective folding element 24*e*, 26*e*. In order to form the groove-shaped recesses 42*e*, 42*e*', 42*e*", 44*e*, 44*e*', 44*e*", two surfaces of the respective folding element 24*e*, 26*e* each have a sub-recess, wherein the sub-recesses are connected to each other on at least one side. The sub-recesses are connected at an upper edge of the folding elements 24*e*, 26*e*. The sub-recesses are herein approximately rectangular.

The first recesses 42*e*, 42*e*', 42*e*" of a first folding element 24*e* are arranged side by side and formed identically. The first recesses 42*e*, 42*e*', 42*e*" of the first folding element 24*e* have a narrow shape for receiving the necks of the brush products 12*e*, 12*e*', 12*e*", 12*e*'". Furthermore, the second recesses 44*e*, 44*e*', 44*e*" of the second folding element 26*e* are arranged side by side and formed identically. The second recesses 44*e*, 44*e*', 44*e*" of the second folding element 26*e* have a broad basic shape for receiving the handles 16*e* of the brush products 12*e*, 12*e*', 12*e*". The first recesses 42*e*, 42*e*', 42*e*" of the first folding element 24*e* of the folding elements 24*e*, 26*e* are substantially different from the second recesses 44*e*, 44*e*', 44*e*" of the second folding element 26*e* and are configured for receiving a different subregion of the brush products 12*e*, 12*e*', 12*e*".

FIGS. 6*a* to 6*c* show an alternative brush product packaging device 10*f* for accommodating six brush products which are embodied as interdental brushes. The brush product packaging device 10*f* comprises a packaging base body 18*f*. The packaging base body 18*f* comprises a folded hood element 36*f* and a card element 34*f* that is applied onto the hood element 36*f*. The card element 34*f* and the hood element 36*f* are largely made of a paper material.

The card element 34*f* is arranged on a front side of the brush product packaging device 10*f*. The card element 34*f* is realized so as to be substantially rectangular. The hood element 36*f* is arranged on a rear side of the brush product packaging device 10*f*. The hood element 36*f* has delimiting surfaces which delimit a receiving region. The hood element 36*f* has a bottom 58*f*. The hood element 36*f* further comprises two side parts 52*f*, 52*f*' which adjoin the bottom 58*f* and are in each case configured to form a side wall of the packaging base body 18*f*. The hood element 36*f* further comprises two end walls 62*f*, 62*f*' adjoining the bottom 58*f*. The hood element 36*f* moreover has sealing edges 64*f*, which are connected to the side parts 52*f*, 52*f*' and are configured for a connection to the card element 34*f*; furthermore, a tab 66*f* is configured to be connected and/or sealed to its counterpart. The sealing edges 64*f* are connected to the side parts 52*f*, 52*f*' of the hood element 36*f* via perforations and creasings. The hood element 36*f* is produced from a precut (FIG. 6*c*). The precut of the hood element 36*f* comprises the rectangular bottom 58*f* and trapezoid-shaped end walls 62*f*, 62*f*' and side parts 52*f*, 52*f*'. At the end wall 62*f* and the side parts 52*f*, 52*f*', respectively one sealing edge 64*f* is arranged, the sealing edge 64*f* comprising the tab 66*f* in the region of the upper end wall 62*f*. Furthermore, respectively one dust tab 68*f* is arranged at the two long trapezoid-shaped end walls 62*f*, 62*f*', respectively at the two free edges.

The card element 34*f* and the hood element 36*f* are produced together as a one-piece precut 60*f*. The card element 34*f* is connected in a one-part implementation to the hood element 36*f* at the lower end wall 62*f*' of the hood element 36*f*. In a production of the brush product packaging device 10*f*, the card element 34*f* is folded over at the hood element 36*f* and placed onto the hood element 36*f*.

The brush product packaging device 10*f* further comprises a holding unit 22*f*. The holding unit 22*f* projects into the receiving region 20*f* and is configured to hold the brush products in position relative to the receiving region 20*f*. The holding unit 22*f* is configured for holding the brush products at the handle and/or at the neck in position relative to the receiving region 20*f* and/or for reducing a movement of the brush products. The holding unit 22*f* is configured to reduce a movement play of the brush products. The holding unit 22*f* is largely made of a paper material. The holding unit 22*f* is realized separately from the packaging base body 18*f*.

Furthermore, the holding unit 22*f* comprises a folding element 24*f*, which projects into the receiving region 20*f*. The folding element 24*f* is made of solid paperboard. The folding element 24*f* forms part of the holding unit 22*f*. The holding unit 22*f* comprises two base side elements 38*f*, which adjoin the folding element 24*f* and via which the folding element 24*f* is connected to the hood element 36*f*. The folding element 24*f* is realized as a plateau-shaped folding element 24*f*. In the folding element 24*f* accordingly four folding edges 72*f*, 74*f* are provided, wherein in particular two free-standing upper folding edges 74*f* are provided. A length of the folding element 24*f* is 20 mm to 160 mm, preferably 40 mm to 100 mm. In the present case, an angle of the folding of the folding elements 24*f* may in particular be approximately 90°, measured at the free-standing upper folding edge 74*f*. Preferably the folding element 24*f* has a trapezoid-shaped cross-sectional shape.

The folding element 24*f* delimits six recesses 42*f*, which are respectively configured to accommodate a subregion of the brush products. The recesses 42*f* are introduced essentially on an upper side of the plateau of the folding element 24*f*. The recesses 42*f* substantially follow a shape of the brush products. In an implementation of the folding element 24*f* as a plateau, the folding element 24*f* has recesses 42*f* for the brush products, wherein the brush products are largely surrounded by the folding element 24*f* in at least one plane. The brush products are thus surrounded by the material of the folding element 24*f* and held in a plane of the plateau. The brush products are configured to be accommodated on both sides of the plateau of the folding element 24*f*. Three recesses 42*f* are respectively arranged on both sides of the plateau of the folding element 24*f*, wherein opposite-situated recesses 42*f* are respectively arranged in an offset manner.

FIG. 7 shows an alternative brush product packaging device 10*g* for an accommodation of six brush products which are embodied as interdental brushes, corresponding to the exemplary embodiment of FIGS. 6*a* to 6*c*. The brush product packaging device 10*g* comprises a packaging base body 18*g*. The packaging base body 18*g* comprises a folded hood element 36*g* and a card element 34*g* that is applied onto the hood element 36*g*. The card element 34*g* and the hood element 36*g* are largely made of a paper material.

The card element 34*g* is arranged on a front side of the brush product packaging device 10*g*. The card element 34*g* is realized substantially rectangular. The hood element 36*g* is arranged on a rear side of the brush product packaging device 10*g*. The hood element 36*g* comprises delimiting surfaces which delimit the receiving region 20*g*. The hood element 36*g* has a bottom 58*g*. The hood element 36*g* further comprises two side parts 52*g*, 52*g*', which adjoin the bottom 58*g* and are in each case configured to form a side wall of the packaging base body 18*g*. The hood element 36*g* further comprises two end walls 62g, 62g' which adjoin the bottom 58g. The hood element 36g moreover comprises sealing edges 64g, which are connected to the end walls 62g, 62g' and to the side parts 52g, 52g' and are configured for a connection to the card element 34g. The sealing edges 64g are connected to the end walls 62g, 62g' and to the side parts 52g, 52g' of the hood element 36g via perforations and creasings. The hood element 36g is produced from a precut. The precut of the hood element 36g comprises the rectangular bottom 58g and trapezoid-shaped end walls 62g, 62g' and side parts 52g, 52g'. At the end walls 62g, 62g' and the side parts 52g, 52g' respectively one sealing edge 64g is arranged, the sealing edge 64g comprising a tab 66g in the region of the upper end wall 62g. Furthermore, respectively one dust tab 68g is arranged at the two long trapezoid-shaped side parts 52g, 52g', respectively at the two free edges.

The card element 34g and the hood element 36g are produced together as a one-piece precut 60g. At the sealing edge 64g of the lower end wall 62g' of the hood element 36g, the card element 34g is connected to the hood element 36g in a one-part implementation. In a production of the brush product packaging device 10g, the card element 34g is folded over at the hood element 36g and placed onto the hood element 36g. Furthermore, the sealing edge 64g is arranged in a region of the folding.

FIG. 8 shows an alternative brush product packaging device 10h for receiving six brush products which are embodied as interdental brushes, corresponding to the exemplary embodiment of FIGS. 6a to 6c. The brush product packaging device 10h comprises a packaging base body 18h. The packaging base body 18h comprises a folded hood element 36h and a card element 34h that is applied onto the hood element 36h. The card element 34h and the hood element 36h are largely made of a paper material.

The card element 34h is arranged on a front side of the brush product packaging device 10h. The card element 34h is realized so as to be substantially rectangular. The hood element 36h is arranged on a rear side of the brush product packaging device 10h. The hood element 36h has delimiting surfaces which delimit a receiving region. The hood element 36h has a bottom 58h. The hood element 36h furthermore comprises two side parts 52h, 52h' which adjoin the bottom 58h and are in each case configured to form a side wall of the packaging base body 18h. The hood element 36h further comprises two end walls 62h, 62h' adjoining the bottom 58h. The hood element 36h moreover has sealing edges 64h, which are connected to the end walls 62h, 62h' and to the side parts 52h, 52h' and are configured for a connection to the card element 34h. The sealing edges 64h are connected to the end walls 62h, 62h' and to the side parts 52h, 52h' of the hood element 36h via perforations and creasings. The hood element 36h is produced from a precut. The precut of the hood element 36h comprises the rectangular bottom 58h and trapezoid-shaped end walls 62h, 62h' and side parts 52h, 52h'. At the end walls 62h, 62h' and the side parts 52h, 52h' respectively one sealing edge 64h is arranged, the sealing edge 64h comprising a tab 66h in the region of the upper end wall 62h. Furthermore, respectively one dust tab 68h is arranged at the two long trapezoid-shaped end walls 62h, 62h', respectively at the two free edges.

The card element 34h and the hood element 36h are produced together as a one-piece precut 60h. At the sealing edge 64h of one of the side parts 52h of the hood element 36h, the card element 34h is connected to the hood element 36h in a one-part implementation. In a production of the brush product packaging device 10h, the card element 34h is folded over at the hood element 36h and placed onto the hood element 36h. Furthermore, the sealing edge 64h is arranged in a region of the folding.

FIGS. 9 to 17 show various exemplary embodiments of the folding elements 24, 26, respectively of the shape and design of the recesses 42, 44 of the folding elements 24, 26, wherein in each case the folding element 24 or a cutout thereof is exemplarily shown in the figures. The implementations may in principle also be combined with one another, which means, on the one hand, that the features shown and described may be combined and, on the other hand, that the features may also be transferred to recesses 44 of the folding element 26.

FIG. 9 shows a folding element 24i. The folding element 24i delimits two recesses 42i, 42i' for receiving at least one subregion of brush products. The first recesses 42i, 42i' of the first folding element 24i are arranged side by side and formed identically.

The recesses 42i, 42i' are respectively realized as groove-shaped recesses 42i, 42i'. The recesses 42i, 42i' are respectively introduced into two surfaces of the folding element 24i. In order to form the groove-shaped recesses 42i, 42i', two surfaces of the folding element 24i each have a sub-recess, wherein the sub-recesses are connected to each other on at least one side. The sub-recesses are connected at an upper edge of the folding element 24i. The sub-recesses are herein approximately rectangular, wherein a closed underside is rounded. The recesses 42i, 42i' are approximately rectangular, wherein a closed underside is rounded.

FIG. 10 shows a folding element 24j. The folding element 24j delimits two recesses 42j, 42j' for receiving at least one subregion of brush products. The first recesses 42j, 42j' of the first folding element 24j are arranged side by side and are formed identically.

The recesses 42j, 42j' are respectively realized as groove-shaped recesses 42j, 42j'. The recesses 42j, 42j' are respectively introduced into two surfaces of the folding element 24j. In order to form the groove-shaped recesses 42j, 42j', two surfaces of the folding element 24j each have a sub-recess, wherein the sub-recesses are connected to each other on at least one side. The sub-recesses are connected at an upper edge of the folding element 24j. The sub-recesses are herein approximately rectangular, wherein a closed underside is rounded. The recesses 42j, 42j' are approximately rectangular, wherein a closed underside is rounded. Furthermore, the recesses 42j, 42j' are beveled, on an open side, towards both sides. The recesses 42j, 42j' each have an insertion slope.

FIGS. 11a to 11d show a folding element 24k in different implementations. The folding element 24k delimits two recesses 42k, 42k' for receiving at least one subregion of brush products. The first recesses 42k, 42k' of the first folding element 24k are arranged side by side and are formed identically.

The recesses 42k, 42k' are respectively realized as groove-shaped recesses 42k, 42k'. The recesses 42k, 42k' are respectively introduced into two surfaces of the folding element 24k. In order to form the groove-shaped recesses 42k, 42k', two surfaces of the folding element 24k each have a sub-recess, wherein the sub-recesses are connected to each other on at least one side. The sub-recesses are connected at an upper edge of the folding element 24k. The sub-recesses are herein approximately rectangular, wherein a closed underside is rounded. The recesses 42k, 42k' are approximately rectangular, wherein a closed underside is rounded. Furthermore, the recesses 42k, 42k' each have a narrowed opening. On both sides of the opening, projections of the folding element 24*k* project into the opening such that an undercut is formed. In a folded state of the folding element 24*k*, the recess 42*k*, 42*k*' forms an undercut. The undercut is in particular configured to prevent brush products from falling out or to reduce the falling out. This consequently also contributes to the products being held or clamped by the undercuts in a favorable manner.

Alternatively, it would also be conceivable to provide the projections which form the undercut in a central region of the recesses 42*k*, 42*k*'. Moreover, the recesses 42*k*, 42*k*' could additionally be provided with insertion slopes (FIG. 11*b*).

Alternatively, it would also be conceivable to provide only one projection which forms the undercut and to provide it for example in a central region of the recesses 42*k*, 42*k*'. Moreover, the recesses 42*k*, 42*k*' could additionally be provided with insertion slopes (FIG. 11*c*).

Alternatively, it would also be conceivable to provide the projections which form the undercut in a rounded form in a central region of the recesses 42*k*, 42*k*'. Moreover, the recesses 42*k*, 42*k*' could additionally be provided with insertion slopes (FIG. 11*d*).

FIG. 12 shows a folding element 24*l*. The folding element 24*l* forms a projection 46*l*, which is configured to engage in a recess of a brush product, in particular for a fixing of the brush product. The projection 46*l* is formed by a free-standing element of the folding element 24*l*, which projects upwards and/or frontwards. The projection 46*l* is formed by a precut of the folding element 24*l* which is folded upwards and/or frontwards. The projection 46*l* is configured to engage in recesses of the product. The projection 46*l* is configured, with its geometry, to be inserted into recesses of the brush product. For a production of the projection 46*l*, half a recess is punched into the folding element 24*l*, wherein the partially punched element is not punched out and removed, but is kept on one side and is erected as the projection 46*l*. The projection 46*l* herein protrudes beyond a remaining portion of the folding element 24*l*. The shape of the projection 46*l* is adapted to the respective shape of the recess in the brush product.

FIGS. 13*a* and 13*b* show a folding element 24*m*. The folding element 24*m* forms, by means of two recesses 42*m*, 42*m*', a projection 46*m* which is configured to engage into a recess of a brush product, in particular for a fixing of the brush product. The projection 46*m* is formed by a partially free-standing element of the folding element 24*m*, which projects partially upwards and/or frontwards. The projection 46*m* is formed by two recesses 42*m*, 42*m*', which are introduced into the folding element 24*m* on both sides of the projection 46*m*. The projection 46*m* herein does not project beyond an upper folding edge 74*m* of the folding element 24*m*. The brush product can herein be inserted into the recesses 42*m*, 42*m*' and can at the same time be plugged onto the projection 46*m*.

Alternatively or additionally, it would be conceivable that the recesses 42*m*, 42*m*' have different depths. Due to the different depths of the recesses 42*m*, 42*m*', the brush product is tilted on the projection 46*m*, such that an angled arrangement of the brush product is formed. The recesses 42*m*, 42*m*' and the projection 46*m* accommodate the brush product in an arrangement that is rotated by an estimated angle of 45° around the longitudinal axis of the brush product (cf. FIG. 13*b*). The angle depends on the one hand on the recesses 42*m*, 42*m*', respectively the projection 46*m*, and on the other hand on the geometry of the recess at the brush product.

FIG. 14 shows a folding element 24*n*. The folding element 24*n* delimits a recess 42*n* for receiving at least one subregion of a brush product.

The recess 42*n* of the first folding element 24*n* is realized as a groove-shaped recess 42*n*. The recess 42*n* is introduced into two surfaces of the folding element 24*n*. In order to form the groove-shaped recess 42*n*, two surfaces of the folding element 24*n* each have a sub-recess, wherein the sub-recesses are connected to each other on at least one side. The sub-recesses are connected at an upper edge of the folding element 24*n*. The sub-recesses are herein approximately rectangular, wherein the corners are rounded. The recess 42*n* is approximately rectangular, wherein the corners are rounded.

FIG. 15 shows a folding element 240. The folding element 240 delimits a recess 420 for accommodating at least one subregion of a brush product.

The recess 420 of the first folding element 240 is realized as a groove-shaped recess 420. The recess 420 is introduced into two surfaces of the folding element 240. In order to form the groove-shaped recess 420, two surfaces of the folding element 240 each have a sub-recess, wherein the sub-recesses are connected to each other on at least one side. The sub-recesses are connected at an upper edge of the folding element 240. The recess 420 has an angled arrangement. The recess 420 is configured for an angular accommodation of the brush product. By way of example, the recess 420 extends into the folding element 240 at an angle of approximately 45° relative to a folding edge 740 of the folding element 240. This allows realizing sidewise product presentation. The recess 420 accommodates the brush product in an arrangement that is rotated by 45° around the longitudinal axis of the brush product.

FIG. 16 shows a folding element 24*p*. The folding element 24*p* delimits two recesses 42*p*, 42*p*' for receiving at least one subregion of brush products. The first recesses 42*p*, 42*p*' of the first folding element 24*p* are arranged side by side and mirror-symmetrically relative to each other.

The recesses 42*p*, 42*p*' are in each case realized as groove-shaped recesses 42*p*, 42*p*'. The recesses 42*p*, 42*p*' are respectively introduced into two surfaces of the folding element 24*p*. In order to form the groove-shaped recesses 42*p*, 42*p*', two surfaces of the folding element 24*p* each have a sub-recess, wherein the sub-recesses are connected to each other on at least one side. The sub-recesses are connected at an upper edge of the folding element 24*p*. The recesses 42*p*, 42*p*' have an angled arrangement. The recesses 42*p*, 42*p*' are configured for an angular accommodation of the brush products. By way of example, the recesses 42*p*, 42*p*' extend into the folding element 24*p* at an angle of approximately 45° relative to the folding edge 74*p* of the folding element 24*p*. This allows realizing sidewise product presentation. The recesses 42*p*, 42*p*' accommodate the brush product in an arrangement that is rotated by 45° around the longitudinal axis of the brush product. The brush products are configured to be accommodated in such a way that they are rotated against one another. The two brush products are configured to be arranged at an angle to each other, i. e. in particular with their front sides towards the center.

FIGS. 17*a* to 17*c* show a holding unit 22*q* for an alternative brush product packaging device for accommodating two brush products 12*q*, 12*q*', in the example in a position towards the front. The brush product packaging device 10*q* is configured to accommodate a brush product 12*q*, which is embodied as a toothbrush, and a brush product 12*q*', which is embodied as a tongue cleaner. The brush product packaging device 10*q* comprises a packaging base body. The packaging base body comprises a folded hood element and a card element that is applied onto the hood element.

The brush product packaging device 10$q$ further comprises a holding unit 22$q$. The holding unit 22$q$ projects into a receiving region of the packaging base body and is configured to hold two brush products 12$q$, 12$q'$ in position relative to the receiving region 20$q$. The holding unit 22$q$ is configured for holding the brush products 12$q$, 12$q'$ at a handle 16$q$, 16$q'$ and/or at a neck in position relative to the receiving region 20$q$ and/or for reducing a movement of the brush products 12$q$, 12$q'$. The holding unit 22$q$ is configured to reduce a movement play of the brush products 12$q$, 12$q'$. The holding unit 22$q$ is largely made of a paper material. The holding unit 22$q$ is realized separately from the packaging base body 18$q$.

Furthermore, the holding unit 22$q$ comprises three folding elements 24$q$, 26$q$, 28$q$, which project at least partially into the receiving region 20$q$ in different regions. The folding elements 24$q$, 26$q$, 28$q$ are made of solid paperboard. The folding elements 24$q$, 26$q$, 28$q$ form part of the holding unit 22$q$. The folding elements 24$q$, 26$q$, 28$q$ are connected to one another. The holding unit 22$q$ comprises several base side elements 38$q$, via which the folding elements 24$q$, 26$q$, 28$q$ are connected to one another.

The holding unit 22$q$ comprises a first folding element 24$q$, a second folding element 26$q$ and a third folding element 28$q$. The second folding element 26$q$ of the folding elements 24$q$, 26$q$, 28$q$ is configured to fix a first brush product 12$q$ of the brush products 12$q$, 12$q'$, and the third folding element 28$q$ is configured to fix a second brush product 12$q'$ of the brush products 12$q$, 12$q'$. The first folding element 24$q$ of the folding elements 24$q$, 26$q$, 28$q$ is configured to fix the first brush product 12$q$ and the second brush product 12$q'$.

The third folding element 28$q$ is arranged along a main extension direction 40$q$ of the brush product packaging device 10$q$ next to the second folding element 26$q$, while the first folding element 24$q$ is arranged along the main extension direction 40$q$ of the brush product packaging device 10$q$ behind the second folding element 26$q$ and the third folding element 28$q$. The third folding element 28$q$ is displaced with respect to the second folding element 26$q$. The third folding element 28$q$ is arranged spaced apart from the second folding element 26$q$ along the main extension direction 40$q$. Between the third folding element 28$q$ and the second folding element 26$q$ a slitting 76$q$ is provided, which extends parallel to the main extension direction 40$q$. The slitting 76$q$ in particular does not peter out downwards, but ends in each case at the folding elements 26$q$, 28$q$. However, the folding elements 26$q$, 28$q$ must herein use the same amount of material, such that the holding unit 22$q$ will not warp during a forming.

The first folding element 24$q$ delimits two recesses 42$q$, 42$q'$ for receiving at least one subregion of the brush products 12$q$, 12$q'$, while the second folding element 26$q$ and the third folding element 28$q$ each delimit a recess 44$q$, 44$q'$, in each case for receiving a subregion of one of the brush products 12$q$, 12$q'$.

The recesses 42$q$, 42$q'$, 44$q$, 44$q'$ are in each case realized as groove-shaped recesses 42$q$, 42$q'$, 44$q$, 44$q'$. The recesses 42$q$, 42$q'$, 44$q$, 44$q'$ are respectively introduced into two surfaces of the respective folding element 24$q$, 26$q$, 28$q$. In order form the groove-shaped recesses 42$q$, 42$q'$, 44$q$, 44$q'$, two surfaces of the respective folding element 24$q$, 26$q$, 28$q$ each have a sub-recess, wherein the sub-recesses are connected to one another on at least one side. The sub-recesses are connected at an upper edge of the folding elements 24$q$, 26$q$, 28$q$. The sub-recesses are herein approximately rectangular. The recesses 42$q$, 42$q'$, 44$q$, 44$q'$ taper conically from a free end, which brings about better clamping. The recesses 42$q$, 42$q'$, 44$q$, 44$q'$ are partially trapezoid-shaped.

The first recesses 42$q$, 42$q'$ of a first folding element 24$q$ are arranged side by side and are formed identically.

FIG. 18 shows a holding unit 22$r$ for an alternative brush product packaging device for accommodating two brush products 12$r$, 12$r'$ in a position towards the front. The brush product packaging device 10$r$ is configured to accommodate a brush product 12$r$, which is embodied as a toothbrush, and a brush product 12$r'$, which is embodied as a flosser. The brush product packaging device 10$r$ comprises a packaging base body. The packaging base body comprises a folded hood element and a card element that is applied onto the hood element.

The brush product packaging device 10$r$ further comprises the holding unit 22$r$. The holding unit 22$r$ projects into a receiving region of the packaging base body and is configured for holding two brush products 12$r$, 12$r'$ in position relative to a receiving region. The holding unit 22$r$ is configured for holding the brush products 12$r$, 12$r'$ at a handle 16$r$, 16$r'$ and/or at a neck in position relative to the receiving region 20$r$ and/or for reducing a movement of the brush products 12$r$, 12$r'$. The holding unit 22$r$ is configured to reduce a movement play of the brush products 12$r$, 12$r'$. The holding unit 22$r$ is largely made of a paper material. The holding unit 22$r$ is realized separately from the packaging base body 18$r$.

Furthermore, the holding unit 22$r$ comprises three folding elements 24$r$, 26$r$, 28$r$, which project at least partially into the receiving region 20$r$ in different regions. The folding elements 24$r$, 26$r$, 28$r$ are made of solid paperboard. The folding elements 24$r$, 26$r$, 28$r$ form part of the holding unit 22$r$. The folding elements 24$r$, 26$r$, 28$r$ are connected to one another. The holding unit 22$r$ comprises several base side elements 38$r$, via which the folding elements 24$r$, 26$r$, 28$r$ are connected to one another.

The holding unit 22$r$ comprises a first folding element 24$r$, a second folding element 26$r$ and a third folding element 28$r$. The second folding element 26$r$ of the folding elements 24$r$, 26$r$, 28$r$ is configured to fix a first brush product 12$r$ of the brush products 12$r$, 12$r'$, and the third folding element 28$r$ is configured to fix a second brush product 12$r'$ of the brush products 12$r$, 12$r'$. The first folding element 24$r$ of the folding elements 24$r$, 26$r$, 28$r$ is configured to fix the first brush product 12$r$.

The third folding element 28$r$ is arranged along a main extension direction 40$r$ of the brush product packaging device 10$r$ next to the second folding element 26$r$, while the first folding element 24$r$ is arranged along the main extension direction 40$r$ of the brush product packaging device 10$r$ behind the second folding element 26$r$ and the third folding element 28$r$. The third folding element 28$r$ is displaced with respect to the second folding element 26$r$. The third folding element 28$r$ is arranged spaced apart from the second folding element 26$r$ along the main extension direction 40$r$. Between the third folding element 28$r$ and the second folding element 26$r$ a slitting 76$r$ is provided, which extends parallel to the main extension direction 40$r$. The slitting 76$r$ peters out downwards. Therefore, here the folding elements 26$r$, 28$r$ do not have to use the same amount of material, as there is overall compensation via the slitting 76$r$ petering out downwards.

The first folding element 24$r$ delimits a recess 42$r$ for receiving at least one subregion of the first brush product 12$r$, while the second folding element 26$r$ and the third folding element 28*r* each delimit a recess 44*r*, 44*r*', respectively for receiving a subregion of one of the brush products 12*r*, 12*r*'.

The recesses 42*r*, 44*r*, 44*r*' are respectively realized as groove-shaped recesses 42*r*, 44*r*, 44*r*'. The recesses 42*r*, 44*r*, 44*r*' are respectively introduced into two surfaces of the respective folding element 24*r*, 26*r*, 28*r*. In order to form the groove-shaped recesses 42*r*, 44*r*, 44*r*', two surfaces of the respective folding element 24*r*, 26*r*, 28*r* each have a sub-recess, wherein the sub-recesses are connected to one another on at least one side. The sub-recesses are connected at an upper edge of the folding elements 24*r*, 26*r*, 28*r*. The sub-recesses are herein approximately rectangular. The recesses 42*r*, 44*r*, 44*r*' taper conically from a free end, which brings about better clamping. The recesses 42*r*, 44*r*, 44*r*' are partially trapezoid-shaped.

FIG. 19 shows an alternative brush product packaging device 10*s* for accommodating two brush products 12*s*, 12*s*'. The brush product packaging device 10*s* comprises a packaging base body 18*s*. The packaging base body 18*s* comprises a folded hood element 36*s* and a card element that is applied onto the hood element 36*s*. The card element 34*s* and the hood element 36*s* are largely made of a paper material.

The brush product packaging device 10*s* further comprises a holding unit 22*s*. The holding unit 22*s* projects into a receiving region 20*s* and is configured for holding two brush products 12*s*, 12*s*' in position relative to the receiving region 20*s*. The holding unit 22*s* is configured for holding the brush products 12*s*, 12*s*' at a handle 16*s*, 16*s*' and/or at a neck in position relative to the receiving region 20*s* and/or for reducing a movement of the brush products 12*s*, 12*s*'. The holding unit 22*s* is configured to reduce a movement play of the brush products 12*s*, 12*s*'. The holding unit 22*s* is largely made of a paper material. The holding unit 22*s* is realized separately from the packaging base body 18*s*.

Furthermore, the holding unit 22*s* comprises two folding elements 24*s*, 26*s*, which project at least partially into the receiving region 20*s* in different regions. The folding elements 24*s*, 26*s* are made of solid paperboard. The folding elements 24*s*, 26*s* form part of the holding unit 22*s*. The folding elements 24*s*, 26*s* are connected to each other. The holding unit 22*s* comprises several base side elements 38*s*, via which the folding elements 24*s*, 26*s* are connected to each other.

The folding elements 24*s*, 26*s* each delimit two recesses 42*s*, 42*s*', 44*s*, 44*s*' for receiving at least one subregion of the brush products 12*s*, 12*s*'.

The first folding element 24*s* and the second folding element 26*s* of the folding elements 24*s*, 26*s* each delimit two recesses 42*s*, 42*s*', 44*s*, 44*s*', which are respectively configured for receiving different brush products 12*s*, 12*s*'.

The recesses 42*s*, 42*s*', 44*s*, 44*s*' are respectively realized as groove-shaped recesses 42*s*, 42*b*', 44*s*, 44*s*'. The first recesses 42*s*, 42*s*' of a first folding element 24*s* are arranged side by side and are formed identically. Furthermore, the second recesses 44*s*, 44*s*' of the second folding element 26*s* are arranged side by side and are formed identically.

The holding unit 22*s* also forms a further receiving region 78*s*, which serves for receiving accessories. The receiving region 78*s* is arranged along the main extension direction 40*s* between the folding elements 24*s*, 26*s* and transversely to a main extension direction 40*s* between the brush products 12*s*, 12*s*'. The receiving region 78*s* is arranged within the receiving region 20*s* of the packaging base body 18*s*. The receiving region 78*s* exemplarily serves for receiving a head receptacle 80*s*.

FIGS. 20*a* to 20*c* show an alternative brush product packaging device 10*t* for accommodating a brush product 12*t* that is embodied as a toothbrush. The brush product packaging device 10*t* comprises a packaging base body 18*t*. The packaging base body 18*t* comprises a folded hood element 36*t* and a card element that is applied onto the hood element 36*t*. The card element 34*t* and the hood element 36*t* are largely made of a paper material.

The brush product packaging device 10*t* further comprises a holding unit 22*t*. The holding unit 22*t* projects into a receiving region 20*t* and is configured for holding the brush products 12*t* in position relative to the receiving region 20*t*. The holding unit 22*t* is configured for holding the brush products 12*t* at a handle 16*t* and/or at a neck in position relative to the receiving region 20*t* and/or for reducing a movement of the brush products 12*t*. The holding unit 22*t* is configured to reduce a movement play of the brush products. The holding unit 22*t* is largely made of a paper material. The holding unit 22*t* is realized separately from the packaging base body 18*t*.

Furthermore, the holding unit 22*t* comprises a folding element 24*t*, which projects into the receiving region 20*t*. The folding element 24*t* is made of solid paperboard. The folding element 24*t* forms part of the holding unit 22*t*. The holding unit 22*t* comprises two base side elements 38*t*, which adjoin the folding element 24*t* and via which the folding element 24*t* is connected to the hood element 36*t*. The folding element 24*t* is realized as a plateau-shaped folding element 24*t*. In the folding element 24*t* accordingly four folding edges 72*t*, 74*t* are provided, wherein in particular two free-standing upper folding edges 74*t* are provided. A length of the folding element 24*t* is 20 mm to 160 mm, preferably 40 mm to 100 mm. An angle of the folding of the folding elements 24*t* may in particular be 8° to 90° respectively. In the present case, different angles are realized.

The folding element 24*t* is combined with a support wall 82*t*, which together with a side wall of the folding element 24*t* forms a triangular structure. The holding unit 22*t* comprises the support wall 82*t*. The support wall 82*t* is realized in a one-part implementation with the folding element 24*t*. The holding unit 22*t* is produced from a precut. The support wall 82*t* is in particular cut out of a side wall of the folding element 24*t*. The support wall 82*t* directly adjoins the plateau section of the folding element 24*t* at a lower end, wherein the side wall of the folding element 24*t* extends at an angle of at least approximately 90° relative to the plateau section towards a bottom 58*t* of the hood element 36*t*, whereas the support wall 82*t* extends at an angle of 30° to 70° relative to the plateau section towards the bottom 58*t* of the hood element 36*t*. Both the support wall 82*t* and the side walls of the folding element 24*t* are in turn connected to the bottom 58*t* via base side elements 38*t*. The folding element 24*t* is in a cross-section merely a parallelogram, wherein in particular the triangular structure formed by the support wall 82*t* allows creating a statically defined system.

The folding element 24*t* delimits a recess 42*t*, which is respectively configured for receiving a subregion of the brush product 12*t*. The recess 42*t* is introduced essentially on an upper side of the plateau of the folding element 24*t*. The recess 42*t* substantially follows a shape of the brush product 12*t*. In an implementation of the folding element 24*t* as a plateau, the folding element 24*t* has a recess 42*t* for the brush product 12*t*, wherein the brush product 12*t* is largely surrounded by the folding element 24*t* in at least one plane. The brush product 12*t* is thus held in a plane of the plateau and is surrounded by the material of the folding element 24*t*.

The folding element 24*t* moreover has a further recess for receiving accessories. The recess is substantially adapted to a shape of the accessory. In an implementation of the folding element 24*t* as a plateau, the folding element 24*t* has a recess for the accessory, wherein the accessory is largely surrounded by the folding element 24*t* in at least one plane. The accessory is exemplarily embodied as a toothpaste tube 84*t*.

FIG. 21 shows a holding unit 22*u* for an alternative brush product packaging device 10*u* for accommodating a brush product in an angled position. The brush product packaging device 10*u* comprises a packaging base body. The packaging base body comprises a folded hood element and a card element that is applied onto the hood element.

The brush product packaging device 10*u* further comprises the holding unit 22*u*. The holding unit 22*u* projects into a receiving region of the packaging base body and is configured to hold two brush products in position relative to the receiving region 20*u*. The holding unit 22*u* is configured for holding the brush products at a handle and/or at a neck in position relative to the receiving region 20*u* and/or for reducing a movement of the brush products. The holding unit 22*u* is configured to reduce a movement play of the brush products. The holding unit 22*u* is largely made of a paper material. The holding unit 22*u* is realized separately from the packaging base body.

Furthermore, the holding unit 22*u* comprises three folding elements 24*u*, 26*u*, 28*u*, which project at least partially into the receiving region 20*u* in different regions. The folding elements 24*u*, 26*u*, 28*u* are made of solid paperboard. The folding elements 24*u*, 26*u*, 28*u* form part of the holding unit 22*u*. The folding elements 24*u*, 26*u*, 28*u* are connected to one another. The holding unit 22*u* comprises several base side elements 38*u*, via which the folding elements 24*u*, 26*u*, 28*u* are connected to one another.

The holding unit 22*u* comprises a first folding element 24*u*, a second folding element 26*u* and a third folding element 28*u*. The first folding element 24*u* and the second folding element 26*u* of the folding elements 24*u*, 26*u*, 28*u* are configured for a fixing of the brush product, while the third folding element 28*u* is configured for an angled orientation of the brush product. The first folding element 24*u* and the second folding element 26*u* are oriented transversely, whereas the third folding element 28*u* is oriented longitudinally. The third folding element 28*u* forms a triangular folding element 28*u*, with folding edges 72*u*, 74*u* running parallel to the longitudinal axis. The folding element 28*u* is folded in such a way that a last side part of the folding element 28*u* bears against delimiting surfaces of the hood element, thus preventing the folding element 28*u* from collapsing. The folding element 28*u* is used for placing the brush product at an angle, with the bristle field resting on the longitudinal folding element 28*u*.

FIG. 22 shows a holding unit 22*v* for an alternative brush product packaging device 10*v* for accommodating a brush product in an angular position. The brush product packaging device 10*v* comprises a packaging base body. The packaging base body comprises a folded hood element and a card element that is applied onto the hood element.

The brush product packaging device 10*v* further comprises the holding unit 22*v*. The holding unit 22*v* projects into a receiving region of the packaging base body and is configured for holding a brush product in position relative to the receiving region 20*v*. The holding unit 22*v* is configured for holding the brush product at the handle and/or at the neck in position relative to the receiving region 20*v* and/or for reducing a movement of the brush product. The holding unit 22*v* is configured to reduce a movement play of the brush product. The holding unit 22*v* is largely made of a paper material. The holding unit 22*v* is realized separately from the packaging base body.

Furthermore, the holding unit 22*v* comprises three folding elements 24*v*, 26*v*, 28*v*, which project at least partially into the receiving region 20*v* in different regions. The folding elements 24*v*, 26*v*, 28*v* are made of solid paperboard. The folding elements 24*v*, 26*v*, 28*v* form part of the holding unit 22*v*. The folding elements 24*v*, 26*v*, 28*v* are connected to one another. The holding unit 22*v* comprises several base side elements 38*v*, via which the folding elements 24*v*, 26*v*, 28*v* are connected to one another.

The holding unit 22*v* comprises a first folding element 24*v*, a second folding element 26*v* and a third folding element 28*v*. The first folding element 24*v* and the second folding element 26*v* of the folding elements 24*v*, 26*v*, 28*v* are configured for a fixing of the brush product, whereas the third folding element 28*v* is configured for an angled orientation of the brush product. The first folding element 24*v* and the second folding element 26*v* are oriented transversely, while the third folding element 28*v* is oriented longitudinally. The third folding element 28*v* forms a diagonal folding element 28*v* with only one folding edge 72*v*, with the folding edge 72*v* running parallel to the longitudinal axis. The folding element 28*v* is folded in such a way that the folding edge 72*v* adjoins the bottom of the hood element while the free edge is supported between the side part of the hood element and the card element, and thus forms a diagonal. The folding element 28*v* is used for placing the brush product at an angle, with the bristle field resting on the longitudinal folding element 28*v*.

FIG. 23 shows an alternative brush product packaging device 10*w* for accommodating a brush product 12*w*. In the present case, the brush product 12*w* is embodied as a toothbrush that is oriented with its bristle field towards the front. The brush product packaging device 10*w* comprises a packaging base body 18*w*. The packaging base body 18*w* comprises a folded hood element and a card element 34*w* that is applied onto the hood element 36*w*. The card element 34*w* and the hood element 36*w* are largely made of a paper material.

Furthermore, the packaging base body 18*w* comprises two viewing windows 54*w*, 54*w*'. The card element 34*w* of the packaging base body 18*w* delimits two recesses 56*w*, 56*w*' that form the viewing windows 54*w*, 54*w*'. The viewing windows 54*w*, 54*w*' serve to make products, a number of products, colors and the like visible. In the present example, the bristle field of the brush product 12*w* is visible through the first viewing window 54*w*, while a thumb grip of a handle 16*w* of the brush product 12*w* is visible through the second viewing window 54*w*'. The recesses 56*w*, 56*w*' are closed by a fastened film, such that the viewing windows 54*w*, 54*w*' are closed. This allows preventing entry of contaminations. The viewing windows 54*w*, 54*w*' each have a rectangular basic shape of different sizes.

The viewing windows 54*w*, 54*w*' are arranged one above the other, separated by a web. The viewing windows 54*w*, 54*w*' have a cumulated main extension area that is equivalent to 5% to 40%, preferably 8% to 20%, of a main extension area of the card element 34*w*.

FIG. 24 shows an alternative brush product packaging device 10*x* for accommodating a brush product 12*x*. In the present case, the brush product 12*x* is embodied as a tongue cleaner. The brush product packaging device 10*x* comprises a packaging base body 18*x*. The packaging base body 18*x* comprises a folded hood element and a card element 34*x* that is applied onto the hood element 36x. The card element 34x and the hood element 36x are largely made of a paper material.

Furthermore, the packaging base body 18x comprises two viewing windows 54x, 54x'. The card element 34x of the packaging base body 18x delimits two recesses 56x, 56x' that form the viewing windows 54x, 54x'. The viewing windows 54x, 54x' serve to make products, a number of products, colors and the like visible. In the present example, an application head 14x of the brush product 12x is visible through the first viewing window 54x, while a thumb grip of a handle 16x of the brush product 12x is visible through the second viewing window 54x'. The recesses 56x, 56x' are closed by a fastened film, such that the viewing windows 54x, 54x' are closed. In this way entry of contamination can be prevented. The first viewing window 54x has a triangular basic shape. The second viewing window 54x' has a rectangular basic shape. The viewing windows 54x, 54x' are arranged one above the other, separated by a web. The viewing windows 54x, 54x' have a cumulated main extension area that is equivalent to 5% to 40%, preferably 8% to 20%, of a main extension area of the card element 34x.

FIG. 25 shows an alternative brush product packaging device 10y for accommodating a brush product 12y. In the present case, the brush product 12y is embodied as a toothbrush that is arranged in a sidewise position. The brush product packaging device 10y comprises a packaging base body 18y. The packaging base body 18y comprises a folded hood element 36y and a card element 34y that is applied onto the hood element. The card element 34y and the hood element 36y are largely made of a paper material.

Furthermore, the packaging base body 18y comprises two viewing windows 54y, 54y'. The card element 34y of the packaging base body 18y delimits two recesses 56y, 56y' that form the viewing windows 54y, 54y'. The viewing windows 54y, 54y' serve to make products, a number of products, colors and the like visible. In the present example, the bristle field of the brush product 12y is visible through the first viewing window 54y, while a thumb grip of a handle 16y of the brush product 12y is visible through the second viewing window 54y'. The recesses 56y, 56y' are closed by a fastened film, such that the viewing windows 54y, 54y' are closed. This allows preventing entry of contaminations. The viewing windows 54y, 54y' each have a rectangular basic shape of different sizes. The viewing windows 54y, 54y' are arranged one above the other, separated by a web. The viewing windows 54y, 54y' have a cumulated main extension area that is equivalent to 5% to 40%, preferably 8% to 20%, of a main extension area of the card element 34y.

FIG. 26 shows an alternative brush product packaging device 10z for accommodating a brush product 12z. In the present case, the brush product 12z is embodied as a toothbrush that is arranged in a sidewise position. The brush product packaging device 10z comprises a packaging base body 18z. The packaging base body 18z comprises a folded hood element 36z and a card element 34z that is applied onto the hood element 36z. The card element 34z and the hood element 36z are largely made of a paper material.

Furthermore, the packaging base body 18z comprises a viewing window 54z. The hood element 36z of the packaging base body 18z delimits a recess 56z that forms the viewing window 54z. The recess 56z is arranged in a bottom 58z of the hood element 36z. The viewing window 54z serves to make products, a number of products, colors and the like visible. In the present example, the bristle field of the brush product 12z is visible through the viewing window 54z. The recess 56z is closed by a fastened film, such that the viewing window 54z is closed. This allows preventing entry of contaminations. The viewing window 54z has a rectangular basic shape. The viewing window 54z has a main extension area that is equivalent to 5% to 40%, preferably 8% to 20%, of a main extension area of the card element 34z.

FIGS. 27a to 27f show a brush product packaging device 10aa for accommodating two brush products 12aa, 12aa' in an orientation with the bristle field towards the front. The brush product packaging device 10aa comprises a packaging base body 18aa. The packaging base body 18aa forms a base body of the brush product packaging device 10aa. The packaging base body 18aa is configured to form a substantially closed receiving region 20aa for the brush product 12aa. The packaging base body 18aa materially delimits the receiving region 20aa.

The packaging base body 18aa comprises a folded hood element 36aa and a card element 34aa that is applied onto the hood element 36aa. In an assembled state the hood element 36aa is fixedly connected to the card element 34aa. Furthermore, an extent of the hood element 36aa along a main extension direction 40aa of the brush product packaging device 10aa is substantially equivalent to an extent of the card element 34aa along the main extension direction 40aa of the brush product packaging device 10aa. The card element 34aa is arranged on a front side of the brush product packaging device 10aa. The card element 34aa is realized substantially rectangular. The hood element 36aa is arranged on a rear side of the brush product packaging device 10aa. The hood element 36aa has delimiting surfaces which delimit the receiving region 20aa. The hood element 36aa has a bottom 58aa. The hood element 36aa furthermore comprises two side parts 52aa, 52aa', which adjoin the bottom 58aa and are in each case configured to form a side wall of the packaging base body 18aa. The hood element 36aa further comprises two end walls 62aa, 62aa' which adjoin the bottom 58aa. The hood element 36aa moreover has sealing edges 64aa, which are connected to the end walls 62aa, 62aa' and to the side parts 52aa, 52aa' and are configured for a connection to the card element 34aa. The sealing edges 64aa are connected to the end walls 62aa, 62a' and to the side parts 52aa, 52aa' of the hood element 36aa via perforations and creasings. The hood element 36aa is produced from a precut. The precut of the hood element 36aa has the rectangular bottom 58aa and trapezoid-shaped end walls 62aa, 62aa' and side parts 52aa, 52aa'. On the end walls 62aa, 62aa' and the side parts 52aa, 52aa', respectively one sealing edge 64aa is arranged. Furthermore, in each case one dust tab 68aa is arranged at the two long trapezoid-shaped side parts 52aa, 52aa', respectively at the two free edges. In a flat state, the hood element 36aa has a length of 70 mm to 320 mm, preferably of 110 mm to 280 mm. The hood element 36aa furthermore has in a flat state a width of 40 mm to 150 mm, preferably of 50 mm to 120 mm. In a formed state of the hood element 36aa, the inner dimensions of the trough that forms the receiving region 20aa have, on a side facing towards the card element 34aa, a length of 50 mm to 250 mm, preferably of 100 mm to 200 mm, and a width of 15 mm to 60 mm, preferably of 20 mm to 40 mm. The hood element 36aa presents a conicity from a side facing towards the card element 34aa towards the bottom 58aa, wherein the conicity is identical on opposite-situated sides, in particular on all four sides. An angle of the conicity is 2° to 40°, preferably 2° to 30°. Furthermore, the height of the hood element 36aa is in a formed state 10 mm to 25 mm, preferably 14 mm to 20 mm. The total height of the packaging base body 18aa is 8 mm to 35 mm, preferably 12 mm to 25 mm. The front side and the rear side of the packaging base body 18*aa* are substantially parallel.

The packaging base body 18*aa* comprises the dust tabs 68*aa*. The hood element 36*aa* comprises the dust tabs 68*aa*. The dust tabs 68*aa* are configured to prevent or reduce the entry of dust. The dust tabs 68*aa* are fixed, like in particular by sealing, folded and laid on in order to form the hood element 36*aa*; but they may also be arranged in unfixed or non-fixed fashion, and may be merely adjacent. During production, the dust tabs 68*aa* are in particular sealed with the end walls 62*aa*, 62*aa*' of the hood element 36*aa*.

The hood element 36*aa* has the planar bottom 58*aa*, the main extension plane of which extends at an angle of 2° to 15° relative to a main extension plane of the card element 34*aa*. Preferably the angle is 3° to 10°. The brush product packaging device 10*aa* and the brush products 12*aa*, 12*aa*' are configured to interact in such a way that due to their shape no holding unit is required. The hood element 36*aa* is formed conically in depth. Furthermore, a dimension of the hood element 36*aa* decreases from the front side to the rear side and from front to rear. Furthermore, a dimension of the hood element 36*aa* decreases from the lefthand side to the righthand side and from front to rear. In a plane perpendicular to the longitudinal axis, the side parts 52*aa*, 52*aa*' have an angle, in particular relative to a perpendicular of the main extension plane of the card element 34*aa*, of 2° to 30°, preferably 3° to 40°. The end walls 62*aa*, 62*aa*' of the hood element 36*aa* are not perpendicular but are also situated at an angle. The angle of the end walls 62*aa*, 62*aa*' relative to a perpendicular of the main extension plane of the card element 34*aa* is 2° to 30°, preferably 3° to 40°. In particular, each opposite-situated pair of delimiting surfaces of the hood element 36*aa* is arranged at an angle.

The hood element 36*aa* and the card element 34*aa* in each case have at least one contact region which is respectively configured for a defined contacting of the brush products 12*aa*, 12*aa*', wherein the packaging base body 18*aa* is configured to accommodate the brush product 12*aa*, 12*aa*' in a clamped fashion between the at least one contact region of the hood element 36*aa* and the at least one contact region of the card element 34*aa*. At an upper and a lower end, the brush products 12*aa*, 12*aa*' bear against the packaging base body 18*aa*. The brush products 12*aa*, 12*aa*' with a rear side respectively adjoin the bottom 58*aa* of the hood element 36*aa* in a defined fashion in two regions of the handle 16*aa* and in a region of the neck. Furthermore, on the front side, in a region of the handle 16*aa*, the brush products 12*aa*, 12*aa*' bear against the card element 34*aa* in a defined manner.

Furthermore, the packaging base body 18*aa* comprises three viewing windows 54*aa*, 54*aa*', 54*aa*". The card element 34*aa* of the packaging base body 18*aa* delimits the recesses 56*aa*, 56*aa*', 56*aa*" that form the viewing windows 54*aa*, 54*aa*', 54*aa*". The viewing windows 54*aa*, 54*aa*', 54*aa*" serve to make products, a number of products, colors and the like visible. In the present example, the bristle fields of the brush products 12*aa*, 12*aa*' are visible through the first viewing window 54*aa*, whereas a thumb grip of the handle 16*aa* of one of the brush products 12*aa*, 12*aa*' is visible through the second viewing window 54*aa*', and while a thumb grip of the handle 16*aa* of one of the brush products 12*aa*, 12*aa*' is visible through the third viewing window 54*aa*". The recesses 56*aa*, 56*aa*', 56*aa*" are closed by a fastened film, such that the viewing windows 54*aa*, 54*aa*', 54*aa*" are closed. This allows preventing entry of contaminations. The first viewing window 54*aa* has a rectangular basic shape. The second and third viewing windows 54*aa*', 54*aa*" each have an oval basic shape. The viewing windows 54*aa*, 54*aa*', 54*aa*" are arranged one above the other and side by side, separated by a web. The viewing windows 54*aa*, 54*aa*', 54*aa*" have a cumulated main extension area that is equivalent to 5% to 40%, preferably 8% to 20%, of a main extension area of the card element 34*aa*.

FIGS. 28*a* to 28*c* show a brush product packaging device 10*bb* for accommodating a brush product 12*bb* in an orientation with the bristle field towards the front. The brush product packaging device 10*bb* comprises a packaging base body 18*bb*. The packaging base body 18*bb* forms a base body of the brush product packaging device 10*bb*. The packaging base body 18*bb* is configured to form a substantially closed receiving region 20*bb* for the brush product 12*bb*. The packaging base body 18*bb* materially delimits the receiving region 20*bb*.

The packaging base body 18*bb* comprises a hood element 36*bb* and a card element 34*bb* that is applied onto the hood element 36*bb*. In an assembled state the hood element 36*bb* is fixedly connected to the card element 34*bb*. Furthermore, an extent of the hood element 36*bb* along a main extension direction 40*bb* of the brush product packaging device 10*bb* is substantially equivalent to an extent of the card element 34*bb* along the main extension direction 40*bb* of the brush product packaging device 10*bb*. The card element 34*bb* is arranged on a front side of the brush product packaging device 10*bb*. The card element 34*bb* is realized substantially rectangular. The hood element 36*bb* is arranged on a rear side of the brush product packaging device 10*bb*. The hood element 36*bb* comprises delimiting surfaces which delimit the receiving region 20*bb*. The hood element 36*bb* has a triangular cross-sectional shape. The triangular cross-section allows achieving that the brush product 12*bb* is laid into the hood element 36*bb*, wherein the delimiting surfaces of the receiving region 20*bb* define the manner in which the product is eventually fixed in the receiving region 20*bb*. The hood element 36*bb* furthermore comprises two side parts 52*bb*, 52*bb*' which directly adjoin each other and are configured to form legs of the triangular cross-sectional shape of the hood element 36*bb*. The hood element 36*bb* further comprises two end walls 62*bb*, 62*bb*' which adjoin the side parts 52*bb*, 52*bb*'. The hood element 36*bb* moreover has sealing edges 64*bb*, which are connected to the end walls 62*bb*, 62*bb*' and to the side parts 52*bb*, 52*bb*' and are configured for a connection to the card element 34*bb*. The sealing edges 64*bb* are connected to the end walls 62*bb*, 62*bb*' and to the side parts 52*bb*, 52*bb*' of the hood element 36*bb* via perforations and creasings. The hood element 36*bb* is produced from a precut. The precut of the hood element 36*bb* has triangular end walls 62*bb*, 62*bb*' and rectangular side parts 52*bb*, 52*bb*'. The triangles of the end walls 62*bb*, 62*bb*' do not have to be symmetrical or isosceles-shaped. It is possible to define an angular position of the brush product 12*bb* in the receiving region 20*bb* via the shape of the triangle. In the precut the end walls 62*bb*, 62*bb*' in each case directly adjoin one of the side parts 52*bb*, 52*bb*'. Respectively one sealing edge 64*bb* is arranged at the end walls 62*bb*, 62*bb*' and at the side parts 52*bb*, 52*bb*'. Furthermore, respectively one dust tab 68*bb* is arranged at one of the side parts 52*bb*, 52*bb*' at the two free edges. In a triangular cross-sectional shape, the dust tabs 68*bb* are triangle-shaped.

FIGS. 29*a* to 29*c* show a brush product packaging device 10*cc* for accommodating a brush product 12*cc* in an orientation with the bristle field towards the front. The brush product packaging device 10*cc* comprises a packaging base body 18*cc*. The packaging base body 18*cc* forms a base body of the brush product packaging device 10*cc*. The packaging base body 18*cc* is configured to form a substantially closed receiving region 20*cc* for the brush product 12*cc*. The packaging base body 18*cc* materially delimits the receiving region 20*cc*.

The packaging base body 18*cc* comprises a hood element 36*cc* and a card element that is applied onto the hood element 36*cc*. In an assembled state the hood element 36*cc* is fixedly connected to the card element. Furthermore, an extent of the hood element 36*cc* along a main extension direction 40*cc* of the brush product packaging device 10*cc* is substantially equivalent to an extent of the card element along the main extension direction 40*cc* of the brush product packaging device 10*cc*. The card element is arranged on a front side of the brush product packaging device 10*cc*. The card element is realized substantially rectangular. The hood element 36*cc* is arranged on a rear side of the brush product packaging device 10*cc*. The hood element 36*cc* has delimiting surfaces which delimit the receiving region 20*cc*. The hood element 36*cc* has a triangular cross-sectional shape. The triangular cross-section allows achieving that the brush product 12*cc* is laid into the hood element 36*cc*, wherein the delimiting surfaces of the receiving region 20*cc* define the manner in which the product is eventually fixed in the receiving region 20*cc*. The hood element 36*cc* furthermore comprises two side parts 52*cc*, 52*cc*' which directly adjoin each other and are configured to form legs of the triangular cross-sectional shape of the hood element 36*cc*. The hood element 36*cc* further comprises two end walls 62*cc*, 62*cc*' which adjoin the side parts 52*cc*, 52*cc*'. The hood element 36*cc* moreover has sealing edges 64*cc*, which are connected to the end walls 62*cc*, 62*cc*' and to the side parts 52*cc*, 52*cc*' and are configured for a connection to the card element. The sealing edges 64*cc* are connected to the end walls 62*cc*, 62*cc*' and to the side parts 52*cc*, 52*cc*' of the hood element 36*cc* via perforations and creasings. The hood element 36*cc* is produced from a precut. The precut of the hood element 36*cc* has triangular end walls 62*cc*, 62*cc*' and rectangular side parts 52*cc*, 52*cc*'. The triangles of the end walls 62*cc*, 62*cc*' do not have to be symmetrical or isosceles-shaped. It is possible to define an angular position of the brush product 12*cc* in the receiving region 20*cc* via the shape of the triangle. In the precut the end walls 62*cc*, 62*cc*' in each case directly adjoin one of the side parts 52*cc*, 52*cc*'. At the end walls 62*cc*, 62*cc*' and the side parts 52*cc*, 52*cc*' respectively one sealing edge 64*cc* is arranged, wherein the sealing edge 64*cc* comprises a tab 66*cc* in the region of the upper end wall 62*cc*. Furthermore, respectively one dust tab 68*cc* is arranged at one of the side parts 52*cc*, 52*cc*' at the two free edges. In the case of a triangular cross-sectional shape, the dust tabs 68*cc* are triangle-shaped.

Furthermore, the packaging base body 18*cc* has a suspension recess 48*cc* at an upper end. The suspension recess 48*cc* is realized as a euroslot recess. The suspension recess 48*cc* is introduced into an upwards-protruding tab 66*cc*. The tab 66*cc* has a double cardboard guide. The tab 66*cc* for the suspension recess 48*cc* is realized in a two-layer implementation, wherein one layer of the tab 66*cc* is realized by the card element and one layer of the tab 66*cc* is realized by the hood element 36*cc*. The hood element 36*cc* and the card element are sealed in the region of the tab 66*cc*.

FIGS. 30*a* to 30*c* show a brush product packaging device 10*dd* for accommodating a brush product. The brush product packaging device 10*dd* comprises a packaging base body 18*dd*. The packaging base body 18*dd* forms a base body of the brush product packaging device 10*dd*. The packaging base body 18*dd* is configured to form a substantially closed receiving region 20*dd* for a brush product 12*dd*. The packaging base body 18*dd* materially delimits the receiving region 20*dd*.

The packaging base body 18*dd* comprises a folded hood element 36*dd* and a card element 34*dd* that is applied onto the hood element 36*dd*. The card element 34*dd* and the hood element 36*dd* are largely made of a paper material. The card element 34*dd* and the hood element 36*dd* are made of solid paperboard. The card element 34*dd* and the hood element 36*dd* have the same material thickness. In an assembled state the hood element 36*dd* is fixedly connected to the card element 34*dd*. Furthermore, an extent of the hood element 36*dd* along a main extension direction 40*dd* of the brush product packaging device 10*dd* is substantially equivalent to an extent of the card element 34*dd* along the main extension direction 40*dd* of the brush product packaging device 10*dd*. The hood element 36*dd* is arranged on a rear side of the brush product packaging device 10*dd*. The hood element 36*dd* comprises delimiting surfaces which delimit the receiving region 20*dd*. The hood element 36*dd* has a bottom 58*dd*. The hood element 36*dd* further comprises two side parts 52*dd*, 52*dd*' which adjoin the bottom 58*dd* and are in each case configured to form a side wall of the packaging base body 18*dd*. The hood element 36*dd* further comprises two end walls 62*dd*, 62*dd*' which adjoin the bottom 58*dd*. The hood element 36*dd* moreover comprises sealing edges 64*dd*, which are connected to the lower end wall 62*dd*' and to the side parts 52*dd*, 52*dd*' and are configured for a connection to the card element 34*dd*. The sealing edges 64*dd* are connected to the end wall 62*dd*' and to the side parts 52*dd*, 52*dd*' of the hood element 36*dd* via perforations and creasings.

Furthermore, in each case one dust tab 68*dd* is arranged at the two long trapezoid-shaped side parts 52*dd*, 52*dd*', respectively at the two free edges.

The packaging base body 18*dd* further has a suspension recess 48*dd* at an upper end. The suspension recess 48*dd* is realized as a euroslot recess. The card element 34*dd* comprises the suspension recess 48*dd*. The suspension recess 48*dd* is introduced into an upwards-protruding tab 66*dd* of the card element 34*dd*.

The hood element 36*dd* further comprises, in a proximity of the suspension recess 48*dd*, a reinforcing element 50*dd*, which is configured for a stabilization of the card element 34*dd* in a region of the suspension recess 48*dd* and whose main extension plane is angled with respect to a main extension plane of the card element 34*dd*. The reinforcing element 50*dd* directly adjoins the upper end wall 62*dd*. The reinforcing element 50*dd* comprises a rectangular spacing wall 86*dd*, which is directly connected to the upper end wall 62*dd* and extends parallel to the end wall 62*dd* towards the bottom 58*dd*. The spacing wall 86*dd* is sealed with the end wall 62*dd*. A rectangular reinforcing wall 88*dd* of the reinforcing element 50*dd*, which at a height of the bottom 58*dd* extends diagonally across the suspension recess 48*dd* to the card element 34*dd*, adjoins the spacing wall 86*d*. The reinforcing wall 88*dd* comprises a recess 90*dd* that corresponds to the suspension recess 48*dd*. A sealing edge 64*dd*, via which the reinforcing element 50*dd* is sealed to the card element 34*dd*, in turn adjoins the reinforcing wall 88*d*.

FIGS. 31*a* to 31*d* show a brush product packaging device 10*ee* for accommodating a brush product. The brush product packaging device 10*ee* comprises a packaging base body 18*ee*. The packaging base body 18*ee* forms a base body of the brush product packaging device 10*ee*. The packaging base body 18*ee* is configured to form a substantially closed receiving region for the brush product 12*ee*. The packaging base body 18*ee* materially delimits the receiving region 20*ee*.

The packaging base body 18*ee* comprises a folded hood element 36*ee* and a card element 34*ee* that is applied onto the hood element 36*ee*. The card element 34*ee* and the hood element 36*ee* are largely made of a paper material. The card element 34*ee* and the hood element 36*ee* are made of solid paperboard. The card element 34*ee* and the hood element 36*ee* have the same material thickness. In an assembled state the hood element 36*ee* is fixedly connected to the card element 34*ee*. Furthermore, an extent of the hood element 36*ee* along a main extension direction 40*ee* of the brush product packaging device 10*ee* is substantially equivalent to an extent of the card element 34*ee* along the main extension direction 40*ee* of the brush product packaging device 10*ee*. The hood element 36*ee* is arranged on a rear side of the brush product packaging device 10*ee*. The hood element 36*ee* comprises delimiting surfaces which delimit the receiving region 20*ee*. The hood element 36*ee* has a bottom 58*ee*. The hood element 36*ee* further has two side parts 52*ee*, 52*ee*', which adjoin the bottom 58*ee* and are in each case configured to form a side wall of the packaging base body 18*ee*. The hood element 36*ee* further comprises two end walls 62*ee*, 62*ee*' which adjoin the bottom 58*ee*. The hood element 36*ee* moreover comprises sealing edges 64*ee*, which are connected to the lower end walls 62*ee*, 62*ee*' and to the side parts 52*ee*, 52*ee*' and are configured for a connection to the card element 34*ee*. The side parts 52*ee*, 52*ee*' and the end walls 62*ee*, 62*ee*' in each case extend perpendicularly to the bottom 58*ee*. The end walls 62*ee*, 62*ee*' are substantially rectangular. The sealing edges 64*ee* are connected to the end walls 62*ee*, 62*ee*' and to the side parts 52*ee*, 52*ee*' of the hood element 36*ee* via perforations and creasings.

The packaging base body 18*ee* further comprises a suspension recess 48*ee* at an upper end. The suspension recess 48*ee* is realized as a euroslot recess. The card element 34*ee* comprises the suspension recess 48*ee*. The suspension recess 48*ee* is introduced into an upwards-protruding tab 66*ee* of the card element 34*ee*.

The hood element 36*ee* further comprises, in a proximity of the suspension recess 48*ee*, two reinforcing elements 50*ee*, 50*ee*', which are configured for a stabilization of the card element 34*ee* in a region of the suspension recess 48*ee* and the main extension planes of which are respectively angled with respect to a main extension plane of the card element 34*ee*. The hood element 36*ee* comprises two side parts 52*ee*, 52*ee*' which extend beyond the receiving region 20*ee* and which in the region of the suspension recess 48*ee* each form a stabilizing wall 53*ee*, 53*ee*' that forms the reinforcing element 50*ee*, 50*ee*'. The stabilizing walls 53*ee*, 53*ee*' are in each case formed by a triangular wall portion that extends directly in prolongation to a main extension plane of the respective side part 52*ee*, 52*ee*'. In the assembled state the stabilizing walls 53*ee*, 53*ee*' directly bear against a surface of the side part 52*ee*, 52*ee*', while an inner side facing towards the suspension recess 48*ee* extends as far as the upper end wall 62*ee*. As a result, a closed cross-section is formed in the region of the upper end wall 62*ee*, such that dust tabs can be dispensed with in the region of the upper end wall 62*ee*. During production the stabilizing walls 53*ee*, 53*ee*' are partially folded inwards, such that an actual gap between the side parts 52*ee*, 52*ee*' and the upper end wall 62*ee* is closed. The stabilizing walls 53*ee*, 53*ee*' extend substantially perpendicularly to the card element 34*ee*. The stabilizing walls 53*ee*, 53*ee*' are arranged on both sides of the suspension recess 48*ee*.

FIG. 32 shows a precut of a hood element 36*ff* of a brush product packaging device for accommodating a brush product. Apart from an implementation of the hood element 36*ff*, the brush product packaging device 10*ff* is equivalent to the brush product packaging device 10*ee* of FIGS. 32*a* to 32*d*.

The hood element 36*ff* is arranged on a rear side of the brush product packaging device 10*ff*. The hood element 36*ff* has delimiting surfaces which delimit a receiving region. The hood element 36*ff* has a bottom 58*ff*. The hood element 36*ff* furthermore comprises two side parts 52*ff*, 52*ff*' which adjoin the bottom 58*ff* and are in each case configured to form a side wall of a packaging base body 18*ff*. The hood element 36*ff* further comprises two end walls 62*ff*, 62*ff*' which adjoin the bottom 58*ff*. The hood element 36*ff* moreover comprises sealing edges 64*ff*, which are connected to the end walls 62*ff*, 62*ff*' and to the side parts 52*ff*, 52*ff*' and are configured for a connection to a card element, the sealing edge 64*ff* comprising a tab 66*ff* in the region of the upper end wall 62*ff*. The side parts 52*ff*, 52*ff*' and the end walls 62*ff*, 62*ff*' in each case extend perpendicularly to the bottom 58*ff*. The end walls 62*ff*, 62*ff*' are substantially rectangular. The sealing edges 64*ff* are connected to the end wall 62*ff*' and to the side parts 52*ff*, 52*ff*' of the hood element 36*ff* via perforations and creasings.

The packaging base body 18*ff* further comprises a suspension recess 48*ff* at an upper end. The suspension recess 48*ff* is realized as a euroslot recess. The suspension recess 48*ff* is introduced into an upwards-protruding tab 66*ff*. The tab 66*ff* has a double cardboard guide. The tab 66*ff* for the suspension recess 48*ff* is realized in a two-layer implementation, wherein one layer of the tab 66*ff* is realized by the card element 34*ff* and one layer of the tab 66*ff* is realized by the hood element 36*ff*.

The hood element 36*ff* further comprises, in a proximity of the suspension recess 48*ff*, two reinforcing elements 50*ff*, 50*ff*', which are configured for a stabilization of the card element 34*ff* in a region of the suspension recess 48*ff* and the main extension planes of which are in each case angled with respect to a main extension plane of the card element 34*ff*. The hood element 36*ff* comprises two side parts 52*ff*, 52*ff*', which extend beyond the receiving region 20*ff* and which in the region of the suspension recess 48*ff* form respectively one stabilizing wall 53*ff*, 53*ff*' that forms the reinforcing element 50*ff*, 50*ff*'. The stabilizing walls 53*ff*, 53*ff*' are in each case realized as a triangular wall portion that extends directly in prolongation to a main extension plane of the respective side part 52*ff*, 52*ff*'. In the assembled state the stabilizing walls 53*ff*, 53*ff*' directly bear against a surface of the side part 52*ff*, 52*ff*', while an inner side facing towards the suspension recess 48*ff* extends as far as the upper end wall 62*ff*. The stabilizing walls 53*ff*, 53*ff*' extend substantially perpendicularly to the card element 34*ff*. The stabilizing walls 53*ff*, 53*ff*' are arranged on both sides of the suspension recess 48*ff*.

FIGS. 33*a* and 33*b* show a brush product packaging device 10*gg* for accommodating a brush product. The brush product packaging device 10*gg* comprises a packaging base body 18*gg*. The packaging base body 18*gg* forms a base body of the brush product packaging device 10*gg*. The packaging base body 18*gg* is configured to form a substantially closed receiving region for the brush product 12*gg*. The packaging base body 18*gg* materially delimits the receiving region 20*gg*.

The packaging base body 18*gg* comprises a folded hood element 36*gg* and a card element 34*gg* that is applied onto the hood element 36*gg*. The card element 34*gg* and the hood element 36*gg* are largely made of a paper material. The card element 34*gg* and the hood element 36*gg* are made of solid paperboard. The card element 34*gg* and the hood element 36*gg* have the same material thickness. In an assembled state the hood element 36*gg* is fixedly connected to the card element 34*gg*. Furthermore, an extent of the hood element 36*gg* along a main extension direction 40*gg* of the brush product packing device 10*gg* is substantially equivalent to an extent of the card element 34*gg* along the main extension direction 40*gg* of the brush product packing device 10*gg*. The hood element 36*gg* is arranged on a rear side of the brush product packaging device 10*gg*. The hood element 36*gg* comprises delimiting surfaces which delimit the receiving region 20*gg*. The hood element 36*gg* has a bottom 58*gg*. The hood element 36*gg* furthermore comprises two side parts 52*gg*, 52*gg*', which adjoin the bottom 58*gg* and are in each case configured to form a side wall of the packaging base body 18*gg*. The hood element 36*gg* further comprises two end walls 62*gg*, 62*gg*' which adjoin the bottom 58*gg*. The hood element 36*gg* moreover comprises sealing edges 64*gg*, which are connected to the end walls 62*gg*, 62*gg*' and to the side parts 52*gg*, 52*gg*' and are configured for a connection to the card element 34*gg*. The side parts 52*gg*, 52*gg*' and the lower end wall 62*gg*' respectively extend perpendicularly to the bottom 58*gg*. The upper end wall 62*gg* is substantially trapezoid-shaped. The upper end wall 62*gg* extends at an angle to the bottom 58*gg*. The upper end wall 62*gg* extends away from the lower end wall 62*gg*' towards the card element 34*gg*. The sealing edges 64*gg* are connected to the end walls 62*gg*, 62*gg*' and to the side parts 52*gg*, 52*gg*' of the hood element 36*gg* via perforations and creasings.

The packaging base body 18*gg* further comprises a suspension recess 48*gg* at an upper end. The suspension recess 48*gg* is realized as a euroslot recess. The card element 34*gg* comprises the suspension recess 48*gg*. The suspension recess 48*gg* is introduced into an upwards-protruding tab 66*gg* of the card element 34*gg*.

The hood element 36*gg* further comprises, in a proximity of the suspension recess 48*gg*, two reinforcing elements 50*gg*, 50*gg*', which are configured for a stabilization of the card element 34*gg* in a region of the suspension recess 48*gg* and whose main extension planes are each angled with respect to a main extension plane of the card element 34*gg*. The hood element 36*gg* comprises two side parts 52*gg*, 52*gg*', which extend beyond the receiving region 20*gg* and which in the region of the suspension recess 48*gg* each form a stabilizing wall 53*gg*, 53*gg*' that forms the reinforcing element 50*gg*, 50*gg*'. The stabilizing walls 53*gg*, 53*gg*' are in each case realized as a triangular wall portion that extends directly in prolongation to a main extension plane of the respective side part 52*gg*, 52*gg*'. As a result, a closed cross-section is formed in the region of the upper end wall 62*gg*, such that in the region of the upper end wall 62*gg* dust tabs can be dispensed with. During production the inner sides of the stabilizing walls 53*gg*, 53*gg*' are partially folded inwards, such that an actual gap between the side parts 52*gg*, 52*gg*' and the upper end wall 62*gg* is closed. The inner side of the stabilizing walls 53*gg*, 53*gg*' is in each case arranged partially spaced apart from the outer side of the stabilizing walls 53*gg*, 53*gg*', in particular on a side facing towards the upper end wall 62*gg*. The stabilizing walls 53*gg*, 53*gg*' extend substantially perpendicularly to the card element 34*gg*. The stabilizing walls 53*gg*, 53*gg*' are arranged on both sides of the suspension recess 48*gg*. In a precut of the hood element 36*gg* the stabilizing walls 53*gg*, 53*gg*' extend along the main extension direction 40*gg* beyond the upper end wall 62*gg*.

FIGS. 34*a* and 34*b* show a brush product packaging device 10*hh* for accommodating a brush product. The brush product packaging device 10*hh* comprises a packaging base body 18*hh*. The packaging base body 18*hh* forms a base body of the brush product packaging device 10*hh*. The packaging base body 18*hh* is configured to form a substantially closed receiving region for the brush product. The packaging base body 18*hh* materially delimits the receiving region 20*hh*.

The packaging base body 18*hh* comprises a folded hood element 36*hh* and a card element 34*hh* that is applied onto the hood element 36*hh*. The card element 34*hh* and the hood element 36*hh* are largely made of a paper material. The card element 34*hh* and the hood element 36*hh* are made of solid paperboard. The card element 34*hh* and the hood element 36*hh* have the same material thickness. In an assembled state the hood element 36*hh* is fixedly connected to the card element 34*hh*. Furthermore, an extent of the hood element 36*hh* along a main extension direction 40*hh* of the brush product packaging device 10*hh* is substantially equivalent to an extent of the card element 34*hh* along the main extension direction 40*hh* of the brush product packaging device 10*hh*. The hood element 36*hh* is arranged on a rear side of the brush product packaging device 10*hh*. The hood element 36*hh* comprises delimiting surfaces which delimit the receiving region 20*hh*. The hood element 36*hh* has a bottom 58*hh*. The hood element 36*hh* further comprises two side parts 52*hh*, 52*hh*' which adjoin the bottom 58*hh* and are in each case configured to form a side wall of the packaging base body 18*hh*. The hood element 36*hh* further comprises two end walls 62*hh*, 62*hh*' which adjoin the bottom 58*hh*. The hood element 36*hh* moreover comprises sealing edges 64*hh*, which are connected to the end walls 62*hh*, 62*hh*' and to the side parts 52*hh*, 52*hh*' and are configured for a connection to the card element 34*hh*. The side parts 52*hh*, 52*hh*' and the lower end wall 62*hh*' respectively extend perpendicularly to the bottom 58*hh*. The upper end wall 62*hh* is substantially trapezoid-shaped. The upper end wall 62*hh* extends at an angle with respect to the bottom 58*hh*. Towards the card element 34*hh*, the upper end wall 62*hh* extends towards the lower end wall 62*hh*', such that in part an undercut is formed in the receiving region 20*hh*. The sealing edges 64*hh* are connected to the end walls 62*hh*, 62*hh*' and to the side parts 52*hh*, 52*hh*' of the hood element 36*hh* via perforations and creasings.

The packaging base body 18*hh* further comprises a suspension recess 48*hh* at an upper end. The suspension recess 48*hh* is realized as a euroslot recess. The card element 34*hh* comprises the suspension recess 48*hh*. The suspension recess 48*hh* is introduced into an upwards-protruding tab 66*hh* of the card element 34*hh*.

The hood element 36*hh* further comprises, in a proximity of the suspension recess 48*hh*, two reinforcing elements 50*hh*, 50*hh*', which are configured for a stabilization of the card element 34*hh* in a region of the suspension recess 48*hh* and the main extension planes of which are respectively angled with respect to a main extension plane of the card element 34*hh*. The hood element 36*hh* comprises two side parts 52*hh*, 52*hh*', which extend beyond the receiving region 20*hh* and which in the region of the suspension recess 48*hh* each form a stabilizing wall 53*hh*, 53*hh*' that forms the reinforcing element 50*hh*, 50*hh*'. The stabilizing walls 53*hh*, 53*hh*' are in each case realized as a triangular wall portion that extends directly in prolongation to a main extension plane of the respective side part 52*hh*, 52*hh*'. As a result, a closed cross-section is created in the region of the upper end wall 62*hh*, such that in the region of the upper end wall 62*hh* dust tabs can be dispensed with. During production the inner sides of the stabilizing walls 53*hh*, 53*hh*' are partially folded inwards, such that an actual gap between the side parts 52*hh*, 52*hh*' and the upper end wall 62*hh* is closed. The inner side of the stabilizing walls 53*hh*, 53*hh*' is in each case arranged partially spaced apart from the outer side of the stabilizing walls 53*hh*, 53*hh*', in particular on a side facing towards the upper end wall 62*hh*. The stabilizing walls 53*hh*, 53*hh*' extend substantially perpendicularly to the card element 34*hh*. The stabilizing walls 53*hh*, 53*hh*' are arranged on both sides of the suspension recess 48*hh*. In a precut of the hood element 36*hh*, the stabilizing walls 53*hh*, 53*hh*' do not extend beyond the upper end wall 62*hh* along the main extension direction 40*hh*. The free corners of the stabilizing walls 53*hh*, 53*hh*' are set back with respect to the upper end wall 62*hh* along the main extension direction 40*hh*.

FIGS. 35*a* and 35*b* show an alternative brush product packaging device 10*ii* for accommodating several brush products 12*ii*, 12*ii*', 12*ii*". In the present case, the brush products 12*ii*, 12*ii*', 12*ii*" are embodied as plug-on brushes. The brush product packaging device 10*ii* comprises a packaging base body 18*ii*. The packaging base body 18*ii* comprises a folded hood element 36*ii* and a card element that is applied onto the hood element 36*ii*. The card element 34*ii* and the hood element 36*ii* are largely made of a paper material.

The brush product packaging device 10*ii* further comprises a holding unit 22*ii*. The holding unit 22*ii* projects into a receiving region 20*ii* and is configured for holding the brush products 12*ii*, 12*ii*', 12*ii*" in position relative to the receiving region 20*ii*. The holding unit 22*ii* is configured for holding the brush products 12*ii*, 12*ii*', 12*ii*" at a handle and/or at a neck in position relative to the receiving region 20*ii* and/or for reducing a movement of the brush products 12*ii*, 12*ii*', 12*ii*". The holding unit 22*ii* is configured to reduce a movement play of the brush products 12*ii*, 12*ii*', 12*ii*". The holding unit 22*ii* is largely made of a paper material. The holding unit 22*ii* is realized separately from the packaging base body 18*ii*.

The holding unit 22*ii* further comprises two folding elements 24*ii*, 26*ii*, which project at least partially into the receiving region 20*ii* in different regions. The folding elements 24*ii*, 26*ii* are made of solid paperboard. The folding elements 24*ii*, 26*ii* form part of the holding unit 22*ii*. The folding elements 24*ii*, 26*ii* are connected to each other. The holding unit 22*ii* comprises several base side elements 38*ii*, via which the folding elements 24*ii*, 26*ii* are connected to each other.

The folding elements 24*ii*, 26*ii* each delimit several recesses 42*ii*, 44*ii* for receiving at least one subregion of the brush products 12*ii*, 12*ii*', 12*ii*". The recesses 42*ii*, 44*ii* are respectively realized as one-sided recesses. The recesses 42*ii*, 44*ii* are introduced into only one surface of the respective folding element 24*ii*, 26*ii* and are not connected to recesses in the other surface of the folding element 24*ii*, 26*ii*. One recess 42*ii* is respectively arranged in the folding element 24*ii* on the one side of the folding element 24*ii*, while two further recesses 42*ii* are arranged on the side facing away from the folding element 24*ii*. The recesses 42*ii* are respectively implemented in such a way that the brush products 12*ii* extend only into the respective folding element 24*ii*, 26*ii*, but not through the corresponding folding element 24*ii*, 26*ii*. The recesses 42*ii* in each case serve as an end abutment for the brush products 12*ii*, wherein the brush products 12*ii* may partially latch in the recesses 42*ii*. In the folding element 26*ii*, on one side a recess 44*ii* is formed which is designed in such a way that the brush product 12*ii* can only extend into the folding element 26*ii*, but not through the folding element 26*ii*. In a packaging of the brush product packaging device 10*ii*, a brush product 12*ii* arranged between the folding elements 24*ii*, 26*ii* is latched between the two opposite-situated recesses 42*ii*, 44*ii* of the folding elements 24*ii*, 26*ii*. The brush products 12*ii*', 12*ii*" arranged between the folding element 24*ii* and an end wall 62*ii* are inserted into the recesses 42*ii* of the folding element 24*ii*; on the other hand they bear against the end wall 62*ii* and are clamped and fixed in this way.

FIGS. 36*a* to 36*c* show an alternative brush product packaging device 10*jj* for accommodating a brush product 12*j*. In the present case, the brush product 12*jj* is embodied as a tongue cleaner. The brush product packaging device 10*jj* comprises a packaging base body 18*j*. The packaging base body 18*jj* comprises a folded hood element 36*jj* and a card element that is applied onto the hood element 36*j*. The card element and the hood element 36*jj* are largely made of a paper material. The hood element 36*jj* has a bottom 58*j*. The hood element 36*j* further comprises two side parts 52*jj*, 52*jj*' which adjoin the bottom 58*jj*. The hood element 36*jj* further comprises two end walls 62*j*, 62*j*' which adjoin the bottom 58*j*.

The brush product packaging device 10*j* further comprises a holding unit 22*j*. The holding unit 22*jj* projects into a receiving region 20*jj* and is configured for holding the brush product 12*jj* in position relative to the receiving region 20*j*. The brush product 12*jj* comprises an application head 14*j* and a handle 16*j*. The holding unit 22*jj* is configured for holding the brush product 12*j* at the handle 16*jj* and/or at a neck in position relative to the receiving region 20*jj* and/or for reducing a movement of the brush product 12*j*. The holding unit 22*j* is configured to reduce a movement play of the brush product 12*jj*. The holding unit 22*jj* is largely made of a paper material. The holding unit 22*jj* is realized separately from the packaging base body 18*jj*.

Furthermore, the holding unit 22*jj* comprises two folding elements 24*jj*, 26*jj*, which project at least partially into the receiving region 20*jj* in different regions. The folding elements 24*j*, 26*jj* are made of solid paperboard. The folding elements 24*jj*, 26*jj* form part of the holding unit 22*jj*. The folding elements 24*jj*, 26*jj* are connected to each other. The holding unit 22*jj* comprises several base side elements 38*jj*, via which the folding elements 24*jj*, 26*jj* are connected to each other.

Furthermore, the edges of the base side elements 38*jj* have at least one indentation 92*jj*. The edges of the base side elements 38*jj* have several indentations 92*jj*. The edges of the base side elements 38*jj* which are oriented at least substantially parallel in the longitudinal direction exemplarily have four indentations 92*jj*. Furthermore, indentations 92*j* at edges including an angle with the longitudinal direction are also conceivable. The holding unit 22*jj* is in the region of the folding elements 24*jj*, 26*j* realized in full width, the indentations 92*jj* being formed between the region of the folding elements 24*jj* and 26*jj* and on the opposite side of the folding element 24*jj*. The indentations 92*j* are formed as isosceles trapezoids. However, another geometric shape, deemed expedient by a person skilled in the art, would also be conceivable. The indentations 92*jj* at the edges of the base side elements 38*jj* end before and after the folding element 24*jj*, 26*jj* and then reach the complete width of the holding unit 22*jj*.

Furthermore, the corners of the base side elements 38*jj* have at least one edge finishing 94*j*. The corners of the base side elements 38*j* have several edge finishings 94*jj*. Each corner of the base side element 38*j* has an edge finishing 94*j*. For example, the four corners of the base side elements 38*jj* have precisely four edge finishings 94*jj*, such that in the region of the corners the holding unit 22*jj* contacts neither the respective end wall 62*j*, 62*jj*' nor the respective side part 52*jj*, 52*jj*', respectively the edges connecting the respective end wall 62*j*, 62*j*' and the respective side part 52*jj*, 52*j*'.

FIG. 36*c* shows that as a result of the indentations 92*jj* and edge finishings 94*jj*, spacings are formed between the holding unit 22*jj* and the hood element 36*jj* and thus the mutual influence by mutual contact is reduced.

Furthermore, the base side element 38*jj* has an anti-twist guard 96*jj*, which ensures correct processing in the packaging machine. The anti-twist guard 96*jj* serves to take care that the holding unit 22*jj* is in its flat state laid correctly into the magazine in the packaging machine. The anti-twist guard 96*jj* is formed in one of the indentations 92*jj* as an additional indentation. Alternatively, an anti-twist guard 96*jj* in any edge of the base side elements 38*j* is also conceivable. The anti-twist guard 96*jj* is realized eccentrically in a round shape and/or in a circle segment. However, another geometric shape, deemed expedient by a person skilled in the art, would also be conceivable.

The folding elements 24*jj*, 26*jj* each delimit a recess 42*jj*, 44*jj* for receiving at least one subregion of the brush product 12*jj*. A first recess 42*jj* is realized as a groove-shaped recess 42*jj*. The recess 42*j* is introduced into two surfaces of the first folding element 24*j*. In order to form the groove-shaped recess 42*j*, two surfaces of the first folding element 24*jj* each have a sub-recess, wherein the sub-recesses are connected to one another on a side. The sub-recesses are connected at an upper edge of the folding element 24*jj*. The sub-recesses are herein approximately rectangular. The first recess 42*jj* tapers conically from a free end, which brings about better clamping. A second recess 44*jj* of the second folding element 26*jj* comprises only a one-sided recess. The second recess 44*jj* is introduced into only one surface of the second folding element 26*jj*. The second recess 44*jj* is introduced into the second folding element 26*jj* on a side that faces towards the first folding element 24*j*. The second recess 44*jj* is in particular formed in such a way that the brush product 12*jj* extends only into the second folding element 26*jj* but not through the second folding element 26*jj*. The second recess 44*jj* serves as an end abutment for the brush product 12*j*. The second recess 44*jj* is configured to accommodate an end of the handle 16*jj* of the brush product 12*jj*, which faces away from the application head 14*j*.

A first recess 42*jj* of a first folding element 24*jj* of the folding elements 24*jj*, 26*jj* is substantially different from a second recess 44*jj* of a second folding element 26*jj* and is configured for receiving a different subregion of the brush product 12*j*.

The explanations referring to the drawings indicate that the hood element is in each case arranged on the rear side and the card element on the front side. Of course, the construction may also be reversed. The construction is related to the manner of presentation of the packaging at the point of sale.

The descriptions made for specific figures may of course also be transferred to other figures which show the same or similar implementations and in which the implementations are not described in the same detail.

Of course, the implementation variants shown in this document are given by way of example. Within the scope of the invention, the individual implementations and elements of these implementation variants may be combined with other implementation variants without departing from the scope of this invention.

The invention claimed is:

1. A brush product packaging device for receiving a brush product with an application head and with a handle, with at least one packaging base body which is configured to form an at least substantially closed receiving region for the brush product and comprises a folded hood element and a card element that is applied onto the hood element, the hood element and the card element being in each case at least largely made of a paper material, the brush product packaging device further comprising at least one holding unit, which projects at least partially into the receiving region and is configured for holding the brush product at least partially in position relative to the receiving region, and is at least largely made of a paper material, wherein the holding unit is realized separately from the packaging base body, wherein:

the at least one holding unit comprises at least two folding elements which project at least partially into the receiving region in different regions, the holding unit comprises at least one base side element via which the folding elements are connected to one another, and the folding elements are connected to one another integrally via the base side element.

2. The brush product packaging device according to claim 1, wherein the holding unit extends at least over a large portion of a main extent of the packaging base body.

3. The brush product packaging device according to claim 1, wherein the folding elements in each case delimit at least one recess for receiving at least one subregion of the brush product, wherein a first recess of a first folding element of the folding elements essentially differs from a second recess of a second folding element and is configured for receiving a different subregion of the brush product.

4. The brush product packaging device according to claim 1, wherein at least one folding element of the folding elements forms a projection which is configured to engage in a recess of the brush product.

5. The brush product packaging device according to claim 1, wherein at least one first folding element of the folding elements delimits at least two recesses, which are respectively configured for receiving different brush products.

6. The brush product packaging device according to claim 5, wherein the at least one holding unit comprises a third folding element, wherein the second folding element of the folding elements is configured to fix a first brush product of the brush products and the third folding element is configured to fix a second brush product of the brush products.

7. The brush product packaging device according to claim 6, wherein the third folding element is arranged spaced apart from the second folding element along the main extension direction.

8. The brush product packaging device according to claim 1, wherein a distance of a first folding element of the folding elements from a second folding element of the folding elements is equivalent to 20% to 60% of a total extent of the receiving region along the main extension direction.

9. The brush product packaging device according to claim 1, wherein at least one of the folding elements delimits a recess for an accommodation of at least one subregion of the brush product, which in a folded state of the folding element forms an undercut.

* * * * *